US008833975B2

(12) United States Patent
Kishimoto et al.

(10) Patent No.: US 8,833,975 B2
(45) Date of Patent: Sep. 16, 2014

(54) LIGHT-EMITTING DEVICE, ILLUMINATING DEVICE, VEHICLE HEADLAMP, AND METHOD FOR PRODUCING LIGHT-EMITTING DEVICE

(75) Inventors: Katsuhiko Kishimoto, Osaka (JP); Hidenori Kawanishi, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 464 days.

(21) Appl. No.: 13/222,772

(22) Filed: Aug. 31, 2011

(65) Prior Publication Data

US 2012/0057364 A1 Mar. 8, 2012

(30) Foreign Application Priority Data

| | | |
|---|---|---|
| Sep. 7, 2010 | (JP) | 2010-199958 |
| Sep. 7, 2010 | (JP) | 2010-199959 |
| Dec. 28, 2010 | (JP) | 2010-294098 |
| Dec. 28, 2010 | (JP) | 2010-294100 |

(51) Int. Cl.

| | |
|---|---|
| ***F21V 29/00*** | (2006.01) |
| ***F21V 9/16*** | (2006.01) |
| ***F21S 8/10*** | (2006.01) |
| *F21Y 101/02* | (2006.01) |

(52) U.S. Cl.

CPC ..... *F21V 9/16* (2013.01); *F21S 48/321* (2013.01); *F21S 48/115* (2013.01); *F21S 48/1241* (2013.01); *F21V 29/004* (2013.01); *F21Y 2101/025* (2013.01)

USPC ..... 362/294; 362/84; 362/260; 362/373

(58) Field of Classification Search

USPC ..... 362/84, 259, 260, 294, 373

See application file for complete search history.

(56) References Cited

U.S. PATENT DOCUMENTS

| | | | | |
|---|---|---|---|---|
| 7,588,351 | B2 * | 9/2009 | Meyer | 362/294 |
| 2005/0105301 | A1 | 5/2005 | Takeda et al. | |
| 2006/0279950 | A1 | 12/2006 | Hama et al. | |
| 2007/0080362 | A1 | 4/2007 | Scotch et al. | |
| 2007/0131954 | A1 | 6/2007 | Murayama et al. | |
| 2008/0290357 | A1 | 11/2008 | Lin et al. | |
| 2009/0040781 | A1 | 2/2009 | Ito | |
| 2009/0095960 | A1 | 4/2009 | Murayama | |
| 2011/0051449 | A1 | 3/2011 | Biebl et al. | |
| 2012/0039072 | A1 | 2/2012 | Lell et al. | |

FOREIGN PATENT DOCUMENTS

| | | |
|---|---|---|
| JP | 2005-150041 | 6/2005 |
| JP | 2005-294185 | 10/2005 |
| JP | 2007-27688 | 2/2007 |
| JP | 2007-294754 | 11/2007 |
| JP | 2007-335514 | 12/2007 |

(Continued)

OTHER PUBLICATIONS

Sasaki, M. (2005). "Applications of White LED Lighting to Automobile Onboard Devices," *Oyo Buturi* 74(11):1463-1466.

*Primary Examiner* — Stephen F Husar
(74) *Attorney, Agent, or Firm* — Morrison & Foerster LLP

(57) ABSTRACT

A headlamp disclosed includes: a laser diode for emitting a laser beam; a light emitting section including a fluorescent material which emits light in response to excitation light emitted from the laser diode; a light-transmitting heat conducting member which is provided so as to face a laser beam irradiation surface of the light emitting section and receive heat of the light emitting section; and an adhesive layer filling a gap between the heat conducting member and the laser beam irradiation surface. This arrangement improves efficiency of the heat conducting member in absorbing the heat of the light emitting section, and consequently cools the light emitting section efficiently.

13 Claims, 22 Drawing Sheets

(56) References Cited

FOREIGN PATENT DOCUMENTS

| | | |
|---|---|---|
| JP | 2008-28245 | 2/2008 |
| JP | 2008-53477 | 3/2008 |
| JP | 2008-294438 | 12/2008 |
| JP | 2009-39438 | 2/2009 |
| JP | 2009-513003 | 3/2009 |
| WO | WO-2009/089903 | 7/2009 |
| WO | WO-2010/069282 | 6/2010 |

* cited by examiner

FIG. 28

| | LED DOWNLIGHT 500 | LASER DOWNLIGHT 400 |
|---|---|---|
| EXTERNAL DIMENSION | DIAMETER 117×91mm | DIAMETER 60×20mm |
| DIMENSION OF INSERTION HOLE | DIAMETER 100mm | 50mm |
| HEIGHT OF UNEXPOSED PORTION OF DEVICE INSERTED | 85mm | 15mm |
| MASS | 0.7Kg | 0.1Kg |

LIGHT-EMITTING DEVICE, ILLUMINATING DEVICE, VEHICLE HEADLAMP, AND METHOD FOR PRODUCING LIGHT-EMITTING DEVICE

This Nonprovisional application claims priority under 35 U.S.C. §119(a) on (i) Patent Application No. 2010-199958 filed in Japan on Sep. 7, 2010, (ii) Patent Application No. 2010-199959 filed in Japan on Sep. 7, 2010, (iii) Patent Application No. 2010-294098 filed in Japan on Dec. 28, 2010, and (iv) Patent Application No. 2010-294100 filed in Japan on Dec. 28, 2010, the entire contents of all of which are hereby incorporated by reference.

TECHNICAL FIELD

The present invention relates to (i) a light emitting device functioning as a high-luminance light source and (ii) an illuminating device and a vehicle headlamp each including the light emitting device.

BACKGROUND ART

In recent years, studies have been intensively carried out for a light emitting device that uses, as illumination light, fluorescence emitted from a light emitting section (wavelength converting member) which includes a fluorescent material. The light emitting section emits the fluorescence upon irradiation with excitation light which is emitted from an excitation light source. The excitation light source is a semiconductor light emitting element such as a light emitting diode (LED) and a laser diode (LD).

Patent Literature 1 discloses a lamp as an example technique related to such a light emitting device. In order to produce a high-luminance light source, the lamp disclosed in Patent Literature 1 includes a laser diode as the excitation light source. Laser beams emitted from the laser diode are coherent light: These laser beams have strong directivity, and therefore can be converged and used as the excitation light without waste. A light emitting device (hereinafter referred to as "LD light-emitting device") including such a laser diode as the excitation light source is suitably applicable for vehicle headlamps. The use of a laser diode as an excitation light source allows production of a high-luminance light source which could not otherwise be produced with use of an LED.

In a case where such laser beams are used as excitation light, the excitation light irradiates and is thus absorbed by a minute light emitting section, that is, a light emitting section having an extremely small volume. The excitation light, however, includes a component which is not converted into fluorescence by a fluorescent material and which is instead converted into heat. Such a component easily raises a temperature of the light emitting section, and consequently impaired properties of the light emitting section or thermally damages the light emitting section.

To solve the above problem, Patent Literature 2 discloses an invention which includes a light-transmitting heat conducting member that is in a shape of a thin film and that is thermally connected to a wavelength converting member (corresponding to a light emitting section). The heat conducting member reduces heat generated by the wavelength converting member.

Patent Literature 3 discloses an invention which includes (i) a cylindrical ferrule that supports a wavelength converting member and (ii) a wire-shaped heat conducting member that is thermally connected to the ferrule. This arrangement reduces heat generated by the wavelength converting member.

Patent Literature 4 discloses an invention which includes a heat dissipating member having a passage for allowing a refrigerant to flow. The heat dissipating member is disposed at such a location as to face a surface of a light converting member (corresponding to a light emitting section) which surface is present on a side on which a semiconductor light emitting element is present. This arrangement cools the light converting member.

Patent Literature 5 discloses an arrangement of thermally connecting a light-transmitting heat sink to a surface of a high-output LED chip serving as a light source. This arrangement cools the high-output LED chip.

CITATION LIST

Patent Literature 1

Japanese Patent Application Publication, Tokukai, No. 2005-150041 A (Publication Date: Jun. 9, 2005)

Patent Literature 2

Japanese Patent Application Publication, Tokukai, No. 2007-27688 A (Publication Date: Feb. 1, 2007)

Patent Literature 3

Japanese Patent Application Publication, Tokukai, No. 2007-335514 A (Publication Date: Dec. 27, 2007)

Patent Literature 4

Japanese Patent Application Publication, Tokukai, No. 2005-294185 A (Publication Date: Oct. 20, 2005)

Patent Literature 5

Japanese Patent Application Publication (Translation of PCT Application), Tokuhyo, No. 2009-513003 (Publication Date: Mar. 26, 2009)

SUMMARY OF INVENTION

Technical Problem

In a case where a light emitting section with no heat conducting member provided is irradiated with excitation light having a high output and a high light density, a portion of the light emitting section which portion is irradiated with the excitation light will locally have a raised temperature. In comparison, in a case where a light emitting section is in contact with a light-transmitting heat conducting member and is irradiated with excitation light via the light-transmitting heat conducting member, it is possible to prevent a temperature rise in the vicinity of an excitation light irradiation surface, that is, a portion of the light emitting section which portion would have a temperature that has been raised most.

Patent Literatures 2 through 5 each disclose an arrangement that thermally connects (i) a first member in which a temperature rise occurs, the first member being, for example, a wavelength converting member, a light converting member, or a high-output LED (hereinafter collectively referred to as "light emitting section") to (ii) a second member which conducts heat generated by the light emitting section, the second member being, for example, a heat conducting member, a heat dissipating member, or a heat sink (hereinafter collectively referred to as "heat conducting member"). This arrangement reduces heat generated by the light emitting section.

However, in an arrangement in which (i) a light emitting section is a member separate from a heat conducting member and (ii) the heat conducting member is in contact with a surface of the light emitting section, the heat conducting member has a decreased heat absorption efficiency because the light emitting section is separated from the heat conducting member by a gap. The inventors of the present invention have found this problem as a result of diligent studies, and none of the above Patent Literatures teaches a method for solving this problem.

The invention of Patent Literature 2, for example, forms a heat conductive layer as the heat conducting member on a surface of the light emitting section by a method such as sputtering, deposition, and plating. Thus, the light emitting section and the heat conducting member are not provided separately from each other. Further, Patent Literature 2 states that the heat conductive layer is preferably approximately from 1 μm to 100 μm in thickness. This indicates an insufficient heat dissipation effect. In addition, the invention of Patent Literature 2 includes an optical fiber as an essential constituent.

The invention of Patent Literature 4 forms the light emitting section (light converting member) on a surface of the heat dissipating member by, for example, screen printing or ink jet application. Thus, the light emitting section and the heat conducting member are not provided separately from each other.

In a case where a light emitting section is repeatedly irradiated with excitation light over time, the light emitting section may generate heat in an extremely large amount. In this case, however much the heat generated by the wavelength converting member is dissipated via a heat conducting member, such heat generated by the light emitting section may not be reduced sufficiently if an amount of the heat generation greatly exceeds an amount of the heat dissipation.

Such a situation gives rise to a difference in thermal expansion between the light emitting section and the heat conducting member, the difference arising from a difference in coefficient of thermal expansion between them. The difference in thermal expansion weakens close contact between the light emitting section and the heat conducting member in a case where they are adhered to each other via an adhesive. Further, in a case where the light emitting section is provided, on a surface thereof, with a heat conducting member formed in the shape of a thin film, the heat conducting member may be detached from the light emitting section.

Such weakening in close contact between the light emitting section and the heat conducting member naturally impairs reliability of thermal connection between them. Further, in a case where, for example, the light emitting section is supported by the heat conducting member, the above reduction makes it difficult to keep supporting the light emitting section at a predetermined location. In other words, the reduction results in a positional shift of the light emitting section.

A light emitting section is positioned relative to an excitation light source such as a laser diode so that the light emitting section is efficiently irradiated with excitation light emitted by the excitation light source. A positional shift of the light emitting section will thus greatly reduce efficiency in irradiation with excitation light.

In a case where a light emitting section closely contacts a heat conducting member and is thus fixed at a location, a difference in thermal expansion will weaken close contact between the light emitting section and the heat conducting member as described above, and may further cause the light emitting section to drop.

In the invention of Patent Literature 2, in particular, the light emitting section is inseparable from the heat conducting member having the shape of a thin film such as a film shape or a layer shape. Thus, if the heat conducting member has been detached, it becomes difficult to keep supporting the light emitting section. This is because if the heat conducting member has a shape, such as a film shape and a layer shape, which renders the heat conducting member easily breakable by an external force, the pressure applied as above will break the heat conducting member.

The inventors of the present invention have further found the following problem: A light emitting section has a heat dissipation efficiency which greatly varies at different portions depending on where a light-transmitting heat conducting member is positioned. In a case where the light emitting section is irradiated with intense excitation light, a portion of the light emitting section which portion is farther away from the heat conducting member has a higher temperature. This may lead to a significant decrease in luminous efficiency of the light emitting section or a reduction in life of the light emitting section.

In particular, in the invention of Patent Literature 2, the light emitting section is inseparable from the heat conducting member having a film shape or a layer shape. It is thus difficult to fix the light emitting section with use of such a heat conducting member so that the light emitting section is supported by the heat conducting member. This is because the heat conducting member (i) has a shape, such as a film shape and a layer shape, which renders the heat conducting member easily breakable by an external force, and (ii) is thus too fragile to support the light emitting section.

The above conventional arrangements each focus on how to cool a light emitting section. None of the above Patent Literatures discloses a technical idea of utilizing heat generated by a light emitting section.

The invention of Patent Literature 1 pays attention to heat dissipation for a laser diode element, but pays no attention to heat dissipation for a light emitting section. Further, the invention of Patent Literature 1 includes a light-transmitting member which fixes a light emitting section, the light-transmitting member being positioned outside the light emitting section as viewed from the laser diode element. Patent Literature 1 thus fails to disclose an arrangement in which a laser beam is emitted to a light emitting section through a light-transmitting heat conducting member.

The invention of Patent Literature 3 includes (i) a ferrule provided at an end of an optical fiber and (ii) a heat conducting member thermally connected to the ferrule. Patent Literature 3 thus fails to disclose the arrangement in which a laser beam is emitted to a light emitting section through a light-transmitting heat conducting member.

The invention of Patent Literature 4 involves no light-transmitting heat conducting member.

The invention of Patent Literature 5 is related to heat dissipation of an LED chip. Patent Literature 5 thus fails to disclose the arrangement in which a laser beam is emitted to a light emitting section through a light-transmitting heat conducting member.

The present invention has been accomplished to solve the above problems. It is a first object of the present invention to provide a light-emitting device, an illuminating device, and a vehicle headlamp, in each of which, in an arrangement in which a light emitting section is provided separately from a heat conducting member for absorbing heat of the light emitting section, the heat conducting member has an improved heat absorption efficiency so that the light emitting section can be cooled efficiently.

It is a second object of the present invention to provide a light-emitting device, an illuminating device, and a vehicle headlamp in each of which a light emitting section closely contacting and thus supported by a supporting member can keep supported by the supporting member even if close contact between the light emitting section and the supporting member weakens due to heat generated by the light emitting section.

It is a third object of the present invention to provide a light-emitting device, an illuminating device, a vehicle headlamp, and a method for producing a light-emitting device in each of which a heat conducting member that absorbs heat of a light emitting section is positioned so as to improve its heat absorption efficiency and to prevent a temperature rise in the light emitting section.

It is a fourth object of the present invention to provide a light-emitting device and a vehicle headlamp each of which effectively utilizes heat of a light emitting section.

Solution to Problem

In order to solve the above problem, a light-emitting device of the present invention includes: an excitation light source for emitting excitation light; a light emitting section including a fluorescent material which emits light in response to the excitation light, the light emitting section having an excitation light irradiation surface which is irradiated with the excitation light; a light-transmitting heat conducting member which is provided so as to (i) face the excitation light irradiation surface and (ii) receive heat of the light emitting section; and a gap layer which fills a gap between the heat conducting member and the excitation light irradiation surface.

The above arrangement achieves the following: The light emitting section emits light in response to excitation light, a portion of which is converted into heat. The light emitting section thus generates heat. The heat conducting member, provided so as to face the excitation light irradiation surface of the light emitting section, absorbs heat of the light emitting section so as to cool the light emitting section. Since the heat conducting member transmits light, the excitation light passes through the heat conducting member and reaches the light emitting section.

The fluorescent material included in the light emitting section has a diameter ranging from 1 to 20 μm. In a case where the fluorescent material is present along the excitation light irradiation surface of the light emitting section, bringing the excitation light irradiation surface into contact with a surface of the light-transmitting heat conducting member (made of sapphire, for example) leaves a relatively large gap between them. The gap substantially reduces a region (area of contact) by which the excitation light irradiation surface is in contact with the heat conducting member. The present invention provides a gap layer between the heat conducting member and the excitation light irradiation surface so as to fill the gap. The gap layer substantially increases the area of contact between the heat conducting member and the excitation light irradiation surface.

The above arrangement thus allows heat generated by the light emitting section to be efficiently dissipated with use of the heat conducting member (that is, improves heat absorption efficiency of the heat conducting member).

In order to solve the above problem, a light-emitting device of the present invention includes: an excitation light source for emitting excitation light; a light emitting section which emits light in response to the excitation light; and a first heat conducting member connected to the light emitting section so as to receive heat from the light emitting section, the first heat conducting member being provided so as to conduct the heat to a member different from the first heat conducting member for use in the different member.

The above arrangement achieves the following: When the light emitting section emits light in response to excitation light, a portion of the excitation light is converted not into fluorescence but into heat, which in turn raises a temperature of the light emitting section. The heat is first conducted to the first heat conducting member, connected to the light emitting section so that heat can be conducted thereto, and is then conducted to a member different from the first heat conducting member for use in the different member. The heat is used to, for example, (i) prevent or remove dew condensation, (ii) prevent freezing or unfreeze, or (iii) thaw snow.

The above arrangement allows effective use of heat of the light emitting section, and thus eliminates the need to consume extra energy in order to, for example, thaw snow.

In order to solve the above problem, a light-emitting device of the present invention includes: a light emitting section for emitting illumination light in response to excitation light emitted from an excitation light source; a supporting member for supporting the light emitting section at such a location that the light emitting section is irradiated with the excitation light; and a fall preventing mechanism which is in contact with at least part of an outer surface of the light emitting section and which, in a case where the supporting member has become unable to support the light emitting section, prevents the light emitting section from falling off the supporting member.

The light emitting section, which emits light upon receipt of excitation light, generates heat while emitting light as it is irradiated with the excitation light. In a case where the light emitting section is repeatedly irradiated with the excitation light, the light emitting section generates an increasing amount of heat. This leads to a difference in thermal expansion between the supporting member and the light emitting section due to a difference in coefficient of thermal expansion between them.

Thus, in a case where the light emitting section closely and fixedly contacts the supporting member via an adhesive or a close contact material such as grease without use of the fall preventing mechanism, the above difference in thermal expansion causes a mechanical stress to a portion at which the supporting member and the light emitting section closely contact each other, and thus weakens close contact at the close contact portion. This makes it difficult for the supporting member to keep supporting the light emitting section, possibly letting the light emitting section fall.

In view of this, the above arrangement causes the fall preventing mechanism to be in contact with at least a portion of the outer surface of the light emitting section so as to prevent the light emitting section from falling off the supporting member.

Thus, even in the case where the difference in thermal expansion between the supporting member and the light emitting section causes a mechanical stress, which in turn weakens close contact at the above-mentioned portion at which the supporting member and the light emitting section closely contact each other, the above arrangement prevents the light emitting section from falling off the supporting member. The supporting member can thus keep supporting the light emitting section.

In order to solve the above problem, a light-emitting device of the present invention includes: an excitation light source for emitting excitation light; a light emitting section including a fluorescent material which emits light in response to the excitation light, the light emitting section having an excitation light irradiation surface which is irradiated with the excitation light; a first heat conducting member which is provided so as to (i) face the excitation light irradiation surface and (ii) receive heat of the light emitting section; and a second heat conducting member which is provided so as to (i) face an opposite surface of the light emitting section which opposite surface is opposite to the excitation light irradiation surface and (ii) receive heat of the light emitting section.

The above arrangement achieves the following: The light emitting section emits light upon receipt of excitation light emitted from the excitation light source. The excitation light is partially converted into heat. The light emitting section thus generates heat. The light emitting section has a temperature rise over the excitation light irradiation surface, from which the first heat conducting member receives heat.

The first heat conducting member is lower in heat dissipation efficiency for a portion of the light emitting section which portion is farther away from the excitation light irradiation surface. However, the second heat conducting member receives heat from the opposite surface of the light emitting section, the opposite surface being a portion which is opposite to the excitation light irradiation surface and for which the first heat conducting member is lowest in heat dissipation efficiency.

As described above, the heat conducting members can be used to efficiently dissipate heat generated by the light emitting section (that is, improve heat absorption efficiency of the heat conducting members). This makes it possible to prevent a temperature rise in the light emitting section.

The excitation light irradiation surface and the opposite surface opposite to the excitation light irradiation surface are each a flat surface in a case where, for example, the light emitting section is in a cuboid or cube shape. The light emitting section is naturally not limited in shape to a cuboid or a cube, and may be in any shape as long as the light emitting section has a solid body having a three dimensional spatial extent. In a case where, for example, the light emitting section is in a spherical shape, the above surfaces are each a spherical surface. The above surfaces, as described above, each vary according to the shape of the light emitting section.

In order to solve the above problem, a method of the present invention for producing a light-emitting device includes the steps of: forming a heat conducting member in a shape of a cup; sintering inside the cup-shaped heat conducting member a combination of (i) a fluorescent material and (ii) a fluorescent material retention substance, having a melting point lower than a melting point of the cup-shaped heat conducting member, so as to form a light emitting section; polishing the light emitting section and the cup-shaped heat conducting member to make a planar surface including an opening of the cup-shaped heat conducting member; and bonding (i) the cup-shaped heat conducting member to (ii) a second heat conducting member, having a planar surface at least at a portion, so that the respective planar surfaces of the cup-shaped heat conducting member and the second heat conducting member face each other.

According to the above method, the forming step forms a heat conducting member in a desired cup shape so that the sintering step automatically forms a light emitting section which closely contacts an inner surface of the cup. The method thus improves a thermal bond of the light emitting section to the cup-shaped heat conducting member, and simplifies a production process. This remarkably improves a production yield as a result.

Further, the polishing step and the bonding step cause the light emitting section to strongly bond to a second heat conducting member via a surface including an opening of the cup-shaped heat conducting member. This improves heat dissipation efficiency of the second heat conducting member with respect to the light emitting section.

In addition, the above method causes the heat conducting members to bond strongly to each other, and thus prevents (i) a problem of a positional shift of the heat conducting members relative to each other and (ii) a problem of a fall of either of the heat conducting members.

Advantageous Effects of Invention

As described above, a light-emitting device of the present invention includes: an excitation light source for emitting excitation light; a light emitting section including a fluorescent material which emits light in response to the excitation light, the light emitting section having an excitation light irradiation surface which is irradiated with the excitation light; a light-transmitting heat conducting member which is provided so as to (i) face the excitation light irradiation surface and (ii) receive heat of the light emitting section; and a gap layer which fills a gap between the heat conducting member and the excitation light irradiation surface.

The above arrangement allows heat generated by the light emitting section to be efficiently dissipated with use of the heat conducting member.

As described above, a light-emitting device of the present invention includes: an excitation light source for emitting excitation light; a light emitting section which emits light in response to the excitation light; and a first heat conducting member connected to the light emitting section so as to receive heat from the light emitting section, the first heat conducting member being provided so as to conduct the heat to a second member for use in the second member.

The above arrangement allows effective use of heat of the light emitting section, and thus eliminates the need to consume extra energy in order to, for example, thaw snow.

As described above, a light-emitting device of the present invention includes: a light emitting section for emitting illumination light in response to excitation light emitted from an excitation light source; a supporting member for supporting the light emitting section at such a location that the light emitting section is irradiated with the excitation light; and a fall preventing mechanism which is in contact with at least part of an outer surface of the light emitting section and which, in a case where the supporting member has become unable to support the light emitting section, prevents the light emitting section from falling off the supporting member.

With the above arrangement, a light emitting section adhered to and thus supported by a supporting member can keep supported by the supporting member even if close contact between the light emitting section and the supporting member weakens due to heat generated by the light emitting section.

As described above, a light-emitting device of the present invention includes: an excitation light source for emitting excitation light; a light emitting section including a fluorescent material which emits light in response to the excitation light, the light emitting section having an excitation light irradiation surface which is irradiated with the excitation light; a first heat conducting member which is provided so as to (i) face the excitation light irradiation surface and (ii) receive heat of the light emitting section; and a second heat conducting member which is provided so as to (i) face an opposite surface of the light emitting section which opposite surface is opposite to the excitation light irradiation surface and (ii) receive heat of the light emitting section.

With the above arrangement, a heat conducting member that absorbs heat of a light emitting section is positioned so as to improve its heat absorption efficiency and to prevent a temperature rise in the light emitting section.

BRIEF DESCRIPTION OF DRAWINGS

FIG. 28 is a table comparing specifications of the laser downlight and those of the LED downlight.

DESCRIPTION OF EMBODIMENTS

Embodiment 1

The following describes a first embodiment of the present invention with reference to FIGS. 1 through 6. In the first embodiment, a vehicle headlamp (light emitting device; illuminating device; vehicle headlamp) 1 is described as an example of an illuminating device of the present invention. The illuminating device of the present invention may, however, be in the form of (i) a headlamp for a vehicle or a moving object other than a vehicle (e.g., a human, a ship, an aircraft, a submarine, and a rocket), or (ii) other illuminating devices. The other illuminating devices encompass, for example, a searchlight, a projector, a streetlight, a traffic light, and a home illuminating device.

The headlamp 1 may comply with (i) a light distribution characteristic standard of a running headlamp (high beam) or (ii) a light distribution characteristic standard of a dipped headlamp (low beam).

(Configuration of Headlamp 1)

Figure 1:
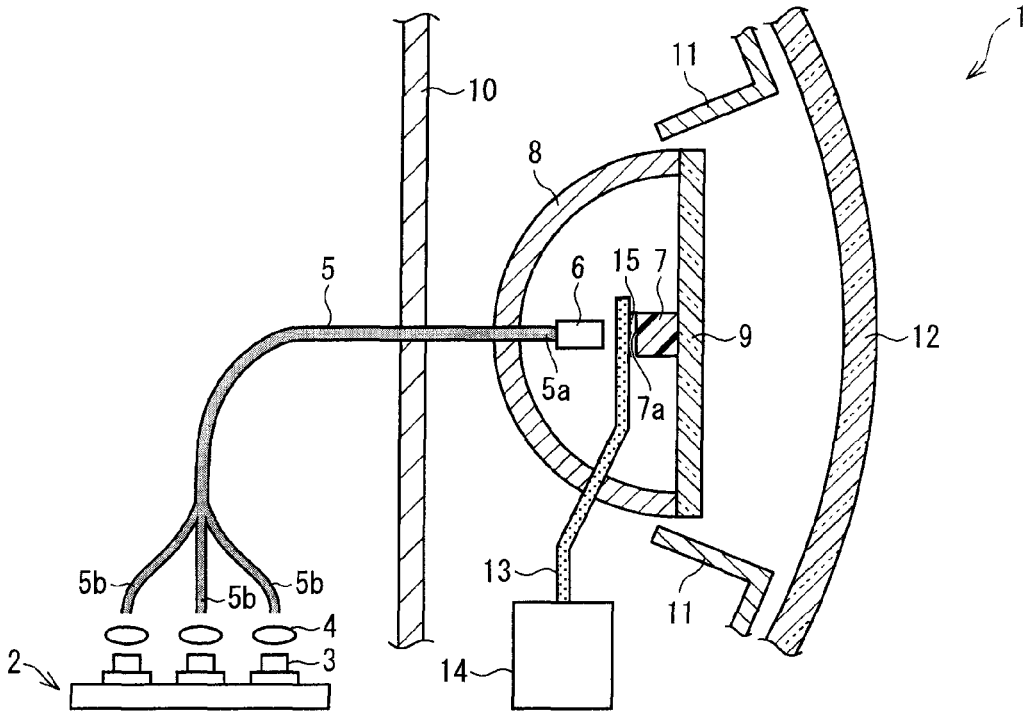
FIG. 1 is a cross-sectional view illustrating a configuration of a headlamp in accordance with a first embodiment of the present invention.
Figure 2:
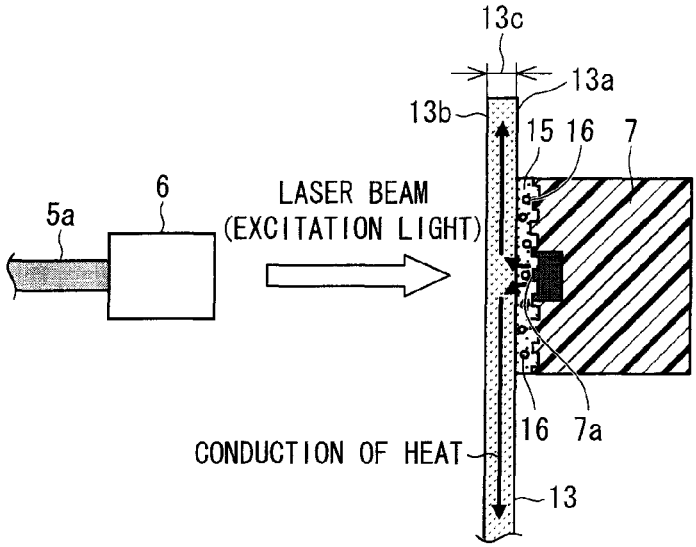
FIG. 2 is a structural view illustrating how a light emitting section and a heat conducting member both included in the headlamp are adhered to each other with use of an adhesive layer.

The description below first deals with a configuration of the headlamp 1 with reference to FIG. 1. FIG. 1 is a cross-sectional view illustrating the configuration of the headlamp 1. As illustrated in FIG. 1, the headlamp 1 includes a laser diode array 2, aspherical lenses 4, an optical fiber 5, a ferrule 6, a light emitting section 7, a reflecting mirror 8, a transparent plate 9, a housing 10, an extension 11, a lens 12, a heat conducting member 13, a cooling section 14, and an adhesive layer 15. The adhesive layer 15 functions as a gap layer filling a gap between the heat conducting member 13 and the light emitting section 7. Further, as illustrated in FIG. 2, the adhesive layer 15 includes a diffusing agent 16. FIG. 2 is a structural diagram illustrating how the light emitting section 7 and the heat conducting member 13 are adhered to each other with use of the adhesive layer 15.

(Laser Diode Array 2 and Laser Diode 3)

The laser diode array 2 functions as an excitation light source which emits excitation light, and includes a plurality of laser diodes (excitation light sources) 3 that are provided on a substrate. Each of the laser diodes 3 emits a laser beam as excitation light. It is not always necessary to use a plurality of the laser diodes 3 as the excitation light source: The laser diode array 2 may alternatively include a single laser diode 3. It is, however, easier to use a plurality of laser diodes 3 in order to obtain a high-output laser beam.

The laser diodes 3 each have a single light emitting point per chip and emit a laser beam of, for example, 405 nm (violet). The laser diode 3 has an output of 1.0 W, an operating voltage of 5 V, and an operating current of 0.6 A, and is contained in a package that has a diameter of 5.6 mm. The laser beam emitted from the laser diode 3 is not limited to a laser beam of 405 nm, and may be any laser beam as long as the laser beam has a peak wavelength in a wavelength range of not less than 380 nm but not more than 470 nm.

If it is possible to produce a high-quality short wavelength laser diode which can emit a laser beam having a wavelength smaller than 380 nm, the laser diode 3 of the present embodiment can be a laser diode which is designed to emit a laser beam having a wavelength smaller than 380 nm.

The present embodiment uses laser diodes as the excitation light source. The laser diodes may, however, be replaced with light emitting diodes.

(Aspherical Lens 4)

The aspherical lenses 4 are each a lens for causing the laser beam (excitation light) emitted from a laser diode 3 to enter an entering end 5*b*, which is one end of the optical fiber 5. The aspherical lens 4 may be, for example, a FLKN1 405 manufactured by ALPS ELECTRIC CO., LTD. The aspherical lens 4 is not particularly limited in its shape or material as long as the lens has the foregoing function. It is, however, preferable that the material have a high transmittance for a wavelength in the vicinity of 405 nm, which is a wavelength of the excitation light, and have a high heat resistance.

(Optical Fiber 5)

(Disposition of Optical Fiber 5)

The optical fiber 5 is a light guiding member which guides to the light emitting section 7 the laser beams emitted by the laser diodes 3, and is a bundle of a plurality of optical fibers. The optical fiber 5 has (i) a plurality of entering ends 5*b* each of which receives a laser beam, and (ii) a plurality of emitting ends 5*a* each of which emits a laser beam entered via a corresponding one of the entering ends 5*b*. The plurality of emitting ends 5*a* emit laser beams to respective regions on a laser beam irradiation surface (excitation light irradiation surface) 7*a* of the light emitting section 7.

For example, the plurality of emitting ends 5*a* of the optical fiber 5 are aligned on a plane that is parallel to the laser beam irradiation surface 7*a*. With such an alignment, the respective laser beams emitted from the plurality of emitting ends 5*a* to the laser beam irradiation surface 7*a* of the light-emitting section 7 can be dispersed on a two-dimensional plane. This is because respective first components of the laser beams irradiate different regions of the laser beam irradiation surface 7*a* of the light-emitting section 7. A first component of a laser beam is a component which falls upon a central portion (peak portion in light intensity) of an irradiation region formed by the laser beam on the laser beam irradiation surface 7*a*.

The above arrangement prevents a part of the light emitting section 7 from remarkable impairment (property change and life reduction) due to local irradiation of the light emitting section 7 with the laser beam.

The optical fiber 5 is not necessarily required to include a bundle of optical fibers (that is, a plurality of emitting ends 5*a*), and may thus include a single emitting end 5*a*.

The emitting ends 5*a* may be in contact with the laser beam irradiation surface 7*a*, or may be disposed so that a slight gap is secured therebetween. In particular, in a case where the emitting ends 5*a* are disposed so that a gap is secured between the emitting ends 5*a* and the laser beam irradiation surface 7*a*, the gap is preferably set so that a laser beam emitted from each emitting end 5*a* and spreading in a shape of a circular cone falls in its entirely onto the laser beam irradiation surface 7*a*.

(Material and Configuration of Optical Fiber 5)

The optical fiber 5 has a double-layered structure in which a center core is covered with a clad having a refractive index lower than that of the core. The core includes quartz glass (silicon oxide) as its main component, which quartz glass hardly has any absorption loss of a laser beam. The clad includes, as its main component, quartz glass or a synthetic resin material, each of which has a refractive index lower than that of the core. The optical fiber 5 is made of, for example, quartz having a core diameter of 200 μm, a clad diameter of 240 μm, and a numerical aperture NA of 0.22. The optical fiber 5 are, however, not limited in configuration, thickness or material to the foregoing values. Further, the optical fiber 5 may be rectangular along a cross section perpendicular to its long axis direction.

The optical fiber 5 is flexible, which makes it easy to change how to dispose the emitting ends 5*a* relative to the laser beam irradiation surface 7*a* of the light emitting section 7. The emitting ends 5*a* can thus be disposed so as to extend along the shape of the laser beam irradiation surface 7*a* of the light emitting section 7. This makes it possible to mildly irradiate the entire laser beam irradiation surface 7*a* of the light emitting section 7 with the laser beams.

The flexibility of the optical fiber 5 further makes it possible to easily change a relative positional relationship of the laser diode 3 with the light emitting section 7. In addition, adjusting a length of the optical fiber 5 allows the laser diode 3 to be disposed at a location far from the light emitting section 7.

The above arrangement thus increases the freedom in design of the headlamp 1; for example, the laser diodes 3 can be disposed at such a location as to be cooled replaced easily. In other words, the freedom in design of the headlamp 1 can be improved because it is possible to easily change (i) a positional relation between the entering ends 5*b* and the emitting ends 5*a* and thus (ii) the positional relation between the laser diodes 3 and the light emitting section 7.

The light guiding member may alternatively be (i) a member other than the optical fibers or (ii) a combination of the optical fibers and another member. For example, the light guiding member may alternatively be a single or a plurality of light guiding members each of which (i) has an entering end and an emitting end for a laser beam and (ii) has a shape of a conical frustum or a square frustum.

(Ferrule 6)

The ferrule 6 supports the plurality of emitting ends 5*a* of the optical fiber 5 in a predetermined pattern with respect to the laser beam irradiation surface 7*a* of the light emitting section 7. The ferrule 6 may (i) have holes formed in a predetermined pattern for inserting the respective emitting ends 5*a*, or (ii) include separable upper and lower parts each of which has, on a bonding surface, grooves formed for sandwiching the emitting ends 5*a*.

The ferrule 6 may be fixed with respect to (i) the reflecting mirror 8 by use of, for example, a bar-shaped or tube-shaped member that extends out from the reflecting mirror 8, or (ii) the heat conducting member 13. The ferrule 6 is not particularly limited in terms of material, and may be stainless steel, for example. Alternatively, a plurality of ferrules 6 may be provided for each light emitting section 7.

The ferrule 6 can be omitted in the case where the optical fiber 5 includes a single emitting end 5*a*. However, the ferrule 6 is preferably provided in such a case as well so as to accurately fix the emitting end 5*a* at a position relative to the laser beam irradiation surface 7*a*.

(Light Emitting Section 7)

(Composition of Light Emitting Section 7)

The light emitting section (wavelength conversion member) 7 emits light upon receipt of the laser beams emitted via the emitting ends 5*a*, and is provided in the vicinity of a focal point of the reflecting mirror 8. The light emitting section 7 includes a fluorescent material which emits light upon receipt of the laser beams. More specifically, the light emitting section 7 is a member in which a fluorescent material is dispersed inside silicone resin that serves as a fluorescent material retention substance (sealing material). The silicone resin and the fluorescent material are present in a ratio of approximately 10:1. The light emitting section 7 may alternatively be made up by pressing the fluorescent material together into a solid. The fluorescent material retention substance is not limited to a resin material such as silicone resin, and may be what is called organic-inorganic hybrid glass or inorganic glass.

In a case where, for example, the fluorescent material retention substance is inorganic glass, the light emitting section 7 can be a sintered body obtained by first (i) mixing the inorganic glass with the fluorescent material and then (ii) sintering a resulting mixture at a predetermined temperature. In a case where the sintering temperature is above a melting point of the inorganic glass serving as the fluorescent material retention substance, it is possible to disperse the fluorescent material uniformly in the inorganic glass by first melting the inorganic glass temporarily.

The above inorganic glass can be, for example, a material which is normally referred to as low melting glass and which has a melting point of 600° C. or lower. The mixture of the inorganic glass and the fluorescent material is sintered typically with use of a mold for forming as a sintered body serving as the light emitting section 7. Specifically, the mixture of the inorganic glass and the fluorescent material is filled in the mold and is then sintered. The sintered body serving as the light emitting section 7 is formed so as to have a shape that fits an inner shape of the mold. Naturally, the inorganic glass preferably has a melting point which is lower than a melting point of the mold.

The fluorescent material is, for example, an oxynitride fluorescent material or a nitride fluorescent substance which includes, dispersed in silicone resin, at least one of (i) a fluorescent material emitting blue light, (ii) a fluorescent material emitting green light, and (iii) a fluorescent material emitting red light. The laser diodes 3 each emit a laser beam of 405 nm (violet), thereby causing a mixture of a plurality of colors and generation of white light upon irradiation of the light emitting section 7 with the laser beam. On this account, it can be said that the light emitting section 7 is a wavelength converting material.

The laser diode 3 may emit a laser beam of 450 nm (blue) (or a laser beam close to what is called "blue" having a peak wavelength in a wavelength range from not less than 440 nm to not more than 490 nm). In this case, the fluorescent material is a yellow fluorescent material or a mixture of a green fluorescent material and a red fluorescent material. The yellow fluorescent material is a fluorescent material which emits light having a peak wavelength in a wavelength range of not less than 560 nm to not more than 590 nm. The green fluorescent material is a fluorescent material which emits light having a peak wavelength in a wavelength range of not less than 510 nm to not more than 560 nm. The red fluorescent material is a fluorescent material which emits light having a peak wavelength in a wavelength range of not less than 600 nm to not more than 680 nm.

(Kind of Fluorescent Material)

The fluorescent material included in the light emitting section 7 can be a nitride fluorescent material, an oxynitride fluorescent material, or a III-V compound semiconductor nanoparticle fluorescent material. In particular, an oxynitride fluorescent material and a III-V compound semiconductor nanoparticle fluorescent material are both highly resistant to the extremely intense laser beam (that is, its output and light density) emitted by the laser diode 3, and are thus suitable for a laser illumination source.

The oxynitride fluorescent material can be what is commonly called sialon fluorescent material. Sialon fluorescent material is a substance in which (i) silicon atoms of silicon nitride are partially substituted with aluminum atoms and (ii) nitrogen atoms of the silicon nitride are partially substituted with oxygen atoms. The sialon fluorescent material may be prepared as a solid solution by combining alumina ($Al_2O_3$), silica ($SiO_2$), rare earth elements and the like into silicon nitride ($Si_3N_4$).

One feature of the semiconductor nanoparticle fluorescent material is that even in a case where only a single type of compound semiconductor (e.g., indium phosphide: InP) is used, it is possible to change its luminous color by quantum size effect by changing its particle diameter to a nanometer-size diameter. For instance, InP emits red light when the particle size is around 3 nm to 4 nm. The particle size is measured under a transmission electron microscope (TEM).

The semiconductor nanoparticle fluorescent material has a short fluorescence duration since it is semiconductor-based. The fluorescent material is, on the other hand, highly resistant to high power excitation light since it can rapidly emit fluorescence with use of power of the excitation light. This is because the light emission duration of the semiconductor nanoparticle fluorescent material is around 10 nanoseconds, which duration is five digits smaller than that of a normal fluorescent material which includes a rare earth as a luminescence center.

Since the light emission duration is short as described above, the semiconductor nanoparticle fluorescent material can rapidly repeat absorption of a laser beam and light emission of the fluorescent material. As a result, it is possible to (i) maintain a high efficiency with respect to a strong laser beam and (ii) reduce heat generated by the fluorescent material.

This further prevents the light emitting section 7 from impairment (discoloring and deformation) caused by heat. Accordingly, in a case where a light emitting element having a high optical output is used as a light source, it is possible to prevent the life of the light emitting device from shortening.

(Shape and Size of Light Emitting Section 7)

The light emitting section 7 is, for example, a cylindrical column in shape, and is either (i) 3.2 mm in diameter and 1 mm in thickness or (ii) 2 mm in diameter and 0.5 mm in thickness. The light emitting section 7 receives laser beams from the emitting ends 5*a* at the laser beam irradiation surface 7*a*, which corresponds to a bottom surface of the cylindrical column.

The light emitting section 7 may alternatively be a cuboid in shape instead of a cylindrical column. The cuboid is, for example, a 3 mm×1 mm×1 mm cuboid. In this case, the laser beam irradiation surface at which the laser beams from the laser diode 3 are received is 3 $mm^2$ in area. A light distribution pattern (light distribution) of a vehicle headlamp lawfully stipulated domestically in Japan is narrow in a vertical direction and broad in a horizontal direction; hence, in order to easily achieve the light distribution pattern, the shape of the light emitting section 7 is made wide in the horizontal direction (cross section being substantially rectangular shaped).

A required thickness of the light-emitting section 7 is varied in accordance with a ratio of the fluorescent material retention substance of the light-emitting section 7 to the fluorescent material thereof. The more the fluorescent material is contained in the light-emitting section 7, the higher a conversion efficiency of the laser light to the white light becomes. Thus, an increase in a content of the fluorescent material in the light-emitting-section 7 allows a reduction in thickness of the light-emitting section 7. Reducing the thickness of the light emitting section 7 increases an effect of dissipating heat toward the heat conducting member 13. Reducing the thickness excessively may, however, cause the laser beams to be emitted to the outside without being converted into fluorescence. From the viewpoint of excitation light absorption by the fluorescent material, the light emitting section 7 preferably has a thickness which is at least 10 times as large as a particle size of the fluorescent material. From this viewpoint, the light emitting section 7 is simply required to have a thickness of not less than 0.01 μm in the case where it includes a nanoparticle fluorescent material. The thickness in this case is, however, preferably not less than 10 μm (not less than 0.01 mm) for ease of production steps such as dispersing the nanoparticle fluorescent material into the sealing material. Increasing the thickness of the light emitting section 7 will, on the other hand, increase a shift from a focus point of the reflecting mirror 8, and consequently blur the light distribution pattern.

Thus, the light emitting section 7 preferably has a thickness which is not less than 0.2 mm and not greater than 2 mm in a case where the light emitting section 7 includes an oxynitride fluorescent material. The lower limit of the thickness does not apply to a case in which the fluorescent material has an extremely large content (typically, in a case where the light emitting section 7 contains 100% fluorescent material).

The laser beam irradiation surface 7*a* of the light emitting section 7 is not necessarily required to be a flat surface, and may be a curved surface. The laser beam irradiation surface 7*a* is, however, preferably a flat surface in order to control reflection of the laser beam.

The light emitting section 7 is, as illustrated in FIGS. 1 and 2, fixed via the adhesive layer 15 to a surface of the heat conducting member 13 which surface is opposite to a surface which is irradiated with the laser beam.

(Reflecting Mirror 8)

The reflecting mirror 8 reflects the light emitted from the light emitting section 7, and thus forms a pencil of rays which travels within a predetermined solid angle. In other words, the reflecting mirror 8 reflects the light from the light emitting section 7 so as to form a pencil of rays which travels in a direction of a front of the headlamp 1. The reflecting mirror 8 is, for example, a (cup-shaped) member which has a curved surface provided with a metal thin film formed thereon.

The reflection mirror 8 may alternatively be a hemispherical mirror, an ellipsoidal mirror, a parabolic mirror, or a mirror which has a hemispherical, ellipsoidal, or parabolic portion. In other words, the reflection mirror 8 is simply required to include, in its reflection surface, at least a portion having a curved surface formed by rotating a shape (an ellipse, a circle, or a parabola) about a rotation axis.

(Transparent Plate 9)

The transparent plate 9 is a transparent resin plate which is provided at an opening of the reflecting mirror 8 and which transmits fluorescence emitted from the light emitting section 7 as illumination light. The transparent plate 9 is preferably made of a material which (i) blocks the laser beams emitted from the laser diodes 3, and (ii) transmits fluorescence (for example, white light) that is generated by converting the laser beams in the light emitting section 7. With the light emitting section 7, most of the coherent laser beams is converted to incoherent light. There may be, however, cases where a portion of the laser beams is not converted due to some kind of cause. Even in such a case, it is possible, by blocking the laser beams with the transparent plate 9, to prevent the laser beams from leaking outside.

The transparent plate 9 may be used to fix the light emitting section 7 in combination with the heat conducting member 13. In other words, the light emitting section 7 may be sandwiched between the heat conducting member 13 and the transparent plate 9. The transparent plate 9 in this case functions as a fixing section for fixing a relative positional relationship between the light emitting section 7 and the heat conducting member 13. Sandwiching the light emitting section 7 between the heat conducting member 13 and the transparent plate 9 more reliably fixes the light emitting section 7 at a location even if the adhesive layer 15 has a low adhesive strength.

In a case where the transparent plate 9 is made of a material which is higher in thermal conductivity than the light emitting section 7 (e.g., glass, in the case where the light emitting section 7 includes a sealing material made of silicone resin), the transparent plate 9 can produce an effect of cooling the light emitting section 7.

The transparent plate 9 may be omitted in a case where the light emitting section 7 is fixed with use of only the heat conducting member 13.

(Housing 10)

The housing 10 forms the body of the headlamp 1, and stores members such as the reflecting mirror 8. The optical fiber 5 penetrates through the housing 10, whereas the laser diode array 2 is disposed outside the housing 10. Although the laser diode array 2 generates heat when emitting laser beams, since the laser diode array 2 is provided outside the housing 10, it is possible to efficiently cool the laser diode array 2. This in turn prevents the light emitting section 7 from, for example, having decreased properties or being thermally damaged due to heat generated by the laser diode array 2.

In case the laser diode 3 should possibly break down, it is preferable to dispose the laser diodes 3 at such a location as to be replaced easily. If these points can be ignored, the laser diode array 2 may be stored inside the housing 10.

(Extension 11)

The extension 11 is disposed at a location away from the reflection mirror 8 in the forward direction. The extension 11 hides the inner configuration of the headlamp 1 so as to (i) improve appearance of the headlamp 1 and (ii) improve a sense of unity between the reflecting mirror 8 and the vehicle body. This extension 11 also has a metal thin film formed on its surface, as with the reflecting mirror 8.

(Lens 12)

The lens 12 is disposed at the opening of the housing 10, and hermetically seals the headlamp 1. Light emitted from the light emitting section 7 and reflected off the reflecting mirror 8 is emitted towards the front of the headlamp 1 through the lens 12. In other words, the lens 12 is a light-transmitting member which transmits fluorescence emitted from the light emitting section 7 as illumination light and which thus emits the fluorescence to the outside of the vehicle headlamp.

(Heat Conducting Member 13)

The heat conducting member (highly heat conducting member) 13 is provided so as to face the laser beam irradiation surface (excitation light irradiation surface) 7*a* of the light emitting section 7. The laser beam irradiation surface 7*a* is a surface which is irradiated with excitation light. The heat conducting member 13 is a light-transmitting member which receives heat of the light emitting section 7, and is thus thermally connected to the light emitting section 7 (that is, connected so that thermal energy can be transferred from the light emitting section 7). Specifically, the heat conducting member 13 and the light emitting section 7 are, as illustrated in FIG. 2, adhered to each other via the adhesive layer (gap layer) 15.

FIG. 2 is a diagram illustrating how the light emitting section 7 is adhered to the heat conducting member 13 via the adhesive layer 15.

The heat conducting member 13 is a plate-shaped member which has (i) a first end in thermal contact with the laser beam irradiation surface 7*a* of the light emitting section 7 and (ii) a second end in thermal connection with the cooling section 14.

The heat conducting member 13, shaped and connected as above, (i) holds the minute light emitting section 7 at a light emitting section fixing location and (ii) dissipates, to the outside of the headlamp 1, heat generated by the light emitting section 7.

The heat conducting member 13 preferably has a thermal conductivity of not less than 20 W/mK so as to efficiently dissipate heat of the light emitting section 7. Since the laser beam emitted from the laser diode 3 passes through the heat conducting member 13 before reaching the light emitting section 7, the heat conducting member 13 is preferably made of a material which is highly light-transmitting property.

In view of the above preferable points, the heat conducting member 13 is preferably made of a material such as sapphire ($Al_2O_3$), magnesia (MgO), gallium nitride (GaN), and spinel ($MgAl_2O_4$). Using one of the above materials achieves a thermal conductivity of 20 W/mK or greater.

The heat conducting member 13 preferably has a thickness 13*c* (see FIG. 2) which is not less than 0.3 mm and not greater than 3.0 mm. The thickness 13*c* refers to a thickness along a direction extending from a first surface 13*a* of the heat conducting member 13 to a second surface 13*b* of the heat conducting member 13, the first surface 13*a* facing the laser beam irradiation surface 7*a* and the second surface 13*b* being opposite to the first surface 13*a*. If the thickness is less than 0.3 mm, the heat conducting member 13 cannot sufficiently dissipate heat of the light emitting section 7, and the light emitting section 7 may thus be impaired. If the thickness is greater than 3.0 mm, the heat conducting member 13 will absorb more of the laser beam emitted thereto, and efficiency in use of excitation light will in consequence decrease significantly.

With an arrangement in which the heat conducting member 13 having an appropriate thickness is in contact with the light emitting section 7, it is possible to dissipate heat of the light emitting section 7 rapidly and efficiently, particularly in a case where a laser beam irradiating the light emitting section 7 is so extreme in intensity, for example, greater than 1 W. The above arrangement thus prevents the light emitting section 7 from being damaged (impaired).

The heat conducting member 13 may be in a shape of a plate with no bend, or have a bent portion and/or a curved portion. The heat conducting member 13 is, however, preferably flat (in the plate shape) at a portion to which the light emitting section 7 is adhered. This allows the light emitting section 7 to be adhered securely.

(Variation of Heat Conducting Member 13)

The heat conducting member 13 may alternatively include a portion which is light-transmitting (light-transmitting section) and a portion which is not light-transmitting (light blocking section). In this case, the light-transmitting section is disposed so as to cover the laser beam irradiation surface 7*a* of the light emitting section 7, whereas the light blocking section is disposed so as to surround the light-transmitting section.

The light blocking section may be a heat dissipating member made of a metal (for example, copper or aluminum). The light blocking section may alternatively be made of a light-transmitting material having a surface that is provided with a film, such as a film made of aluminum or silver, which reflects illumination light.

(Cooling Section 14)

The cooling section 14 is a member for cooling the heat conducting member 13. The cooling section 14 is, for example, a heat dissipating block which is made of a metal such as aluminum and copper and which is thus high in heat conductivity. In a case where the reflecting mirror 8 is made of a metal, the reflecting mirror 8 may further serve the function of the cooling section 14. The cooling section 14 may alternatively be (i) a cooling device which cools the heat conducting member 13 by circulating a coolant inside itself, or (ii) a cooling device (fan) which air-cools the heat conducting member 13.

In a case where the cooling section 14 is a metal block, the metal block may include on a top surface a plurality of heat dissipating fins. This arrangement increases a surface area of the metal block, and thus improves efficiency in heat dissipation from the metal block.

The cooling section 14 is not essential to the headlamp 1. Heat received by the heat conducting member 13 from the light emitting section 7 may alternatively be allowed to dissipate spontaneously from the heat conducting member 13. Providing the cooling section 14, however, allows heat to efficiently dissipate from the heat conducting member 13. The cooling section 14 is particularly useful in a case where an amount of heat from the light emitting section 7 is 3 W or greater.

Adjusting a length of the heat conducting member 13 allows the cooling section 14 to be disposed at a location away from the light emitting section 7. In this case, the cooling section 14 is not necessarily contained in the housing 10 as illustrated in FIG. 1. The cooling section 14 may be disposed outside the housing 10 with the heat conducting member 13 penetrating the housing 10.

This arrangement (i) allows the cooling section 14 to be disposed at such a location that it can be easily repaired or replaced if broken down, and (ii) increases the freedom in design of the headlamp 1.

(Adhesive Layer 15)

The adhesive layer 15 is a layer of an adhesive filling a gap between the heat conducting member 13 and the laser beam irradiation surface 7*a*. The fluorescent material included in the light emitting section 7 is approximately from 1 to 20 μm in diameter. The gap is thus relatively large in a case where, for example, (i) the heat conducting member 13 is made of sapphire and has a polished surface and (ii) the light emitting section 7 is disposed in contact with the polished surface. The gap can be filled by providing the adhesive layer 15 between the heat conducting member 13 and the laser beam irradiation surface 7*a* of the light emitting section 7.

Providing the adhesive layer 15 substantially increases an area by which the heat conducting member 13 and the laser beam irradiation surface 7*a* are in contact with each other, and thus improves heat absorption efficiency of the heat conducting member 13. The heat conducting member 13 can have a higher heat absorption efficiency in a case where the adhesive layer 15 has a thermal conductivity which is equivalent to or greater than that of the light emitting section 7.

The adhesive layer 15 can be formed of, for example, Epixacolle EP433 (visible light polymerizable optical adhesive manufactured by Adell Corporation). The thermal conductivity of Epixacolle EP433 is not disclosed, but is presumed to fall within a range approximately from 0.1 to 0.3 W/mK since Epixacolle EP433 is an acrylic adhesive.

The adhesive layer 15 preferably has a flexibility (or a viscosity) sufficient to absorb a difference in coefficient of thermal expansion between the light emitting section 7 and the heat conducting member 13. Since the light emitting section 7 and the heat conducting member 13 are different from each other in coefficient of thermal expansion, the light emitting section 7 may become detached from the heat conducting member 13 due to the difference in coefficient of thermal expansion in a case where the light emitting section 7 generates heat.

In a case where the adhesive layer 15 has a flexibility (or a viscosity) sufficient to absorb the difference in coefficient of thermal expansion between the light emitting section 7 and the heat conducting member 13, it is possible to prevent the light emitting section 7 from becoming detached from the heat conducting member 13 due to heat generated by the light emitting section 7.

The adhesive layer 15 preferably has a thickness (a thickness between the heat conducting member 13 and the laser beam irradiation surface 7*a*) which is not less than 1 μm and not greater than 30 μm. In a case where the adhesive layer 15 has a thickness which is not less than 1 μm and not greater than 30 μm, even if the adhesive layer 15 is lower in thermal conductivity than the light emitting section 7, it is possible to reduce a thermal resistance of the adhesive layer 15 and thus to efficiently transfer heat generated by the light emitting section 7 to the heat conducting member 13 via the adhesive layer 15. The thermal resistance is identical between, for example, (i) a case in which the adhesive layer 15 has a thermal conductivity of 1 W/mK and a thickness of 0.1 mm and (ii) a case in which the adhesive layer 15 has a thermal conductivity of 0.2 W/mK and a thickness of 20 μm (=0.02 mm).

Note that embodiments below may refer to the adhesive layer 15 as a gap layer 15.

(Dispersing Agent 16)

The adhesive layer 15 may include a diffusing agent 16. Since the laser beam has an extremely small light emitting point and is coherent light, it may harm the human body if it is emitted directly to the outside without being converted into fluorescence or diffused by the light emitting section 7. The diffusing agent 16 included in the adhesive layer 15 diffuses the laser beam emitted from the optical fiber 5 so that the light emitting point is expanded and the laser beam is converted into incoherent light.

Thus, even if the laser beam is not entirely converted into fluorescence or diffused by the light emitting section 7, the diffusing agent 16, which diffuses the laser beam in advance, reduces the possibility of coherent light leaking to the outside.

The diffusing agent 16 is preferably made of a material such as $SiO_2$ beads, $Al_2O_3$ beads, and diamond beads. The $SiO_2$ beads are in a perfectly spherical shape, and have a particle size which ranges from several nanometers to several micrometers. The $SiO_2$ beads are mixed in the adhesive layer 15 at 0.1 to several percent. The diffusing agent 16 is preferably contained in an amount which falls within a range approximately from 1 mg to 30 mg per gram of the adhesive layer 15 because containing an excessive amount of the diffusing agent 16 reduces an amount of the laser beam which reaches the light emitting section 7.

Containing a transparent, inorganic substance such as the above also improves the thermal conductivity of the adhesive layer 15. $SiO_2$ has a thermal conductivity of 1.38 W/mK, which is higher than that of acrylic resin. The diamond beads have a thermal conductivity which ranges from 800 to 2000 W/mK, which is significantly higher than that of acrylic resin. Containing a transparent, inorganic substance as above significantly improves the thermal conductivity of the adhesive layer 15 in consequence.

(Combination of Material of Gap Layer and Light Emitting Section 7)

The adhesive layer 15, as described above, preferably has a thermal conductivity which is equivalent to or greater than that of the light emitting section 7. Since the adhesive layer 15 is an example of the gap layer of the present invention which example includes an adhesive, the following description uses the term "gap layer," which is broader in concept, to deal with an example material of the adhesive layer 15.

Table 1 shows example materials for the gap layer and the light emitting section 7. Examples for the gap layer include a material which, in order to improve the thermal conductivity of the gap layer, contains a highly heat conductive filler (highly heat conductive additive) made of a material similar to that of the diffusing agent 16. The highly heat conductive filler refers to light-transmitting particles including a material having a high heat conductivity.

The description below uses (i) the term "highly heat conductive filler A" to refer to a portion of the highly heat conductive filler which portion is higher in thermal conductivity than resin and (ii) the term "highly heat conductive filler B" to refer to a portion of the highly heat conductive filler A which portion is higher in thermal conductivity than glass.

Example materials of the highly heat conductive filler A include $SiO_2$ beads, $Al_2O_3$ beads, and diamond beads. Example materials of the highly heat conductive filler B include $Al_2O_3$ beads and diamond beads.

TABLE 1

| Gap layer | | Light emitting section | |
|---|---|---|---|
| Material | Thermal conductivity (W/mK) | Material for sealing material | Thermal conductivity (W/mK) |
| Acrylic adhesive | 0.1-0.3 | Resin | 0.1 to 0.3 |
| Acrylic adhesive + highly heat conductive filler A | 0.3< | | |
| Glass paste | 1.0 | Inorganic glass | 1.0 |
| Glass paste + highly heat conductive filler B | 1.0< | | |

In a case where, for example, (i) the gap layer is formed of an acrylic adhesive and (ii) the sealing material of the light emitting section 7 is a resin material (for example, epoxy resin or silicone resin) or HBG (organic-inorganic hybrid glass), the gap layer is equivalent in thermal conductivity to the light emitting section 7.

The two instances below each exemplify a combination of the gap layer and the light emitting section 7 where the gap layer is higher in thermal conductivity than the light emitting section 7.

(1) In a case where the sealing material of the light emitting section 7 is a resin material, the gap layer can be formed of (i) an acrylic adhesive, (ii) an acrylic adhesive prepared by kneading an acrylic adhesive with the highly heat conductive filler A, (iii) a glass paste (typically including low melting glass), or (iv) a glass paste prepared by kneading a glass paste with either the highly heat conductive filler A or the highly heat conductive filler B.

In this combination, the highly heat conductive filler A is formed of beads which are more highly heat conductive than an acrylic adhesive, such beads being (i) $SiO_2$ (silica) beads, which have a thermal conductivity of approximately 1 W/mK, (ii) $Al_2O_3$ (sapphire) beads, which have a thermal conductivity ranging approximately from 20 to 40 W/mK, or (iii) diamond beads, which have a thermal conductivity ranging approximately from 1000 to 2000 W/mK.

(2) In a case where the sealing material of the light emitting section 7 is inorganic glass, the gap layer can be formed of (i) a glass paste including low melting glass or (ii) a glass paste prepared by mixing a glass paste with the highly heat conductive filler B.

Although low melting glass is used, it is necessary to heat a glass paste to at least 400° C. in order to melt it and adhere the gap layer to the light emitting section 7. The highly heat conductive filler is thus required to not melt or change in quality at a fusing temperature of a glass paste in use.

The above examples of the highly heat conductive filler, namely $SiO_2$ beads (silica), $Al_2O_3$ beads, and diamond beads, have their respective melting points of 1713° C., 2030° C., and 3550° C. The above examples of the highly heat conductive filler thus do not melt or change in quality at the fusing temperature of low melting glass.

In either (1) or (2), it is simply necessary to select a highly heat conductive filler for mixture in the gap layer so that the gap layer is higher in thermal conductivity than the light emitting section 7.

The thermal conductivity of the gap layer, however, depends not only on the material of the highly heat conductive filler to be mixed, but also on its concentration. The thermal conductivity is higher in, for example, (i) a case where sapphire beads are mixed in a relatively large number than (ii) a case where diamond paste is mixed in an extremely small number. The thermal conductivity of the gap layer can thus be simply adjusted by (i) selecting a material of the highly heat conductive filler to be mixed in the gap layer and (ii) adjusting an amount of the highly heat conductive filler.

Alternatively, a plurality of kinds of the highly heat conductive filler may be mixed in the gap layer.

(Shape of Dispersing Agent 16)

The description above cites $SiO_2$ beads and the like as examples of the highly heat conductive filler. The highly heat conductive filler is, however, not necessarily spherical, and may thus be in a bar shape or an indefinite shape. The highly heat conductive filler is preferably perfectly spherical and identical in diameter in order to control the thickness of the gap layer.

Figure 3:
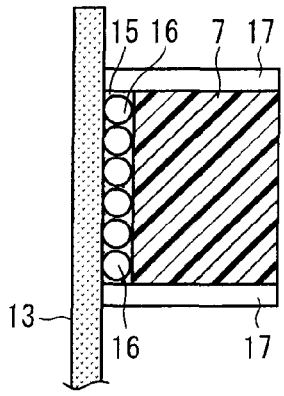
FIG. 3 is a cross-sectional view illustrating a preferable example of a diffusing agent.

FIG. 3 is a cross-sectional view illustrating a preferable example of the diffusing agent 16. As illustrated in FIG. 3, the diffusing agent 16 is made of particles (heat conducting particles) which are each substantially spherical (preferably, perfectly spherical) and have a predetermined diameter. The diffusing agent 16 thus maintains a fixed distance between the light emitting section 7 and the heat conducting member 13. Further, the diffusing agent 16 is in contact with the heat conducting member 13 and the light emitting section 7 so as to conduct heat of the light emitting section 7 to the heat conducting member 13.

The diffusing agent 16 is preferably present only in a single layer between the heat conducting member 13 and the light emitting section 7, and a gap filler (an adhesive or a glass paste, for example) fills gaps between the particles of the diffusing agent 16. Providing the diffusing agent 16 arranged as such allows efficient conduction of heat of the light emitting section 7 to the heat conducting member 13 even in a case where the gap filler is made of a material, such as an acrylic adhesive, which is low in thermal conductivity.

The diffusing agent 16 may alternatively be provided in a plurality of layers as long as a fixed distance is maintained between the heat conducting member 13 and the light emitting section 7.

As illustrated in FIG. 3, a reflective film 17 may be provided not only to a side surface of the adhesive layer 15, but also to a side surface of the light emitting section 7. This arrangement allows the reflective film 17 to also cool the light emitting section 7. This effect can be improved by making the reflective film 17 of a material which is higher in heat conductivity than the light emitting section 7.

(Configuration of Laser Diode 3)

Figure 4:
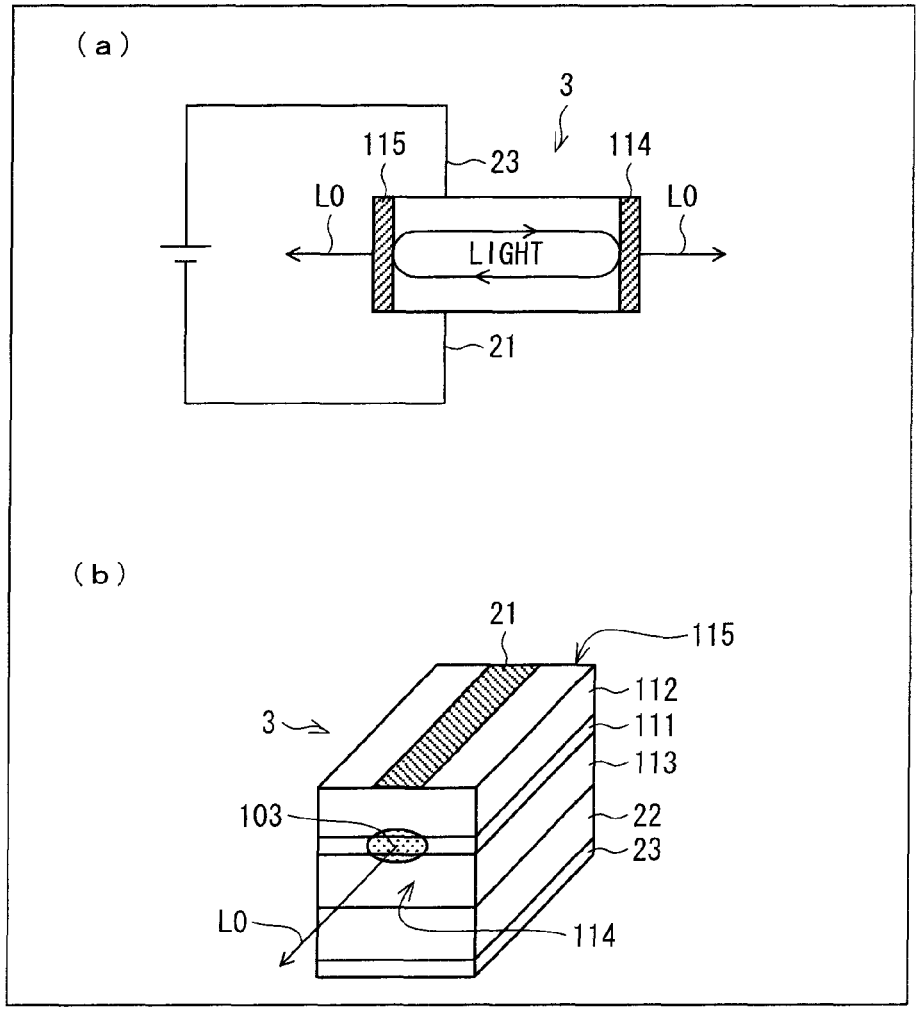
FIG. 4(*a*) is a diagram schematically illustrating a circuit of a laser diode, and (*b*) is a perspective view illustrating a basic configuration of the laser diode.

Next described is a basic configuration of the laser diodes 3. FIG. 4(*a*) is a circuit diagram schematically illustrating a laser diode 3, and FIG. 4(*b*) is a perspective view illustrating the basic configuration of the laser diode 3. As illustrated in FIG. 4(*b*), the laser diode 3 is made up by stacking a cathode electrode 23, a substrate 22, a clad layer 113, an active layer 111, a clad layer 112, and an anode electrode 21 in this order.

The substrate 22 is a semiconductor substrate, and in order to obtain a blue to ultraviolet excitation light for exciting a fluorescent material as in the present application, it is preferable to use GaN, sapphire, or SiC as a material of the substrate 22. Generally, other examples of a substrate for use in a laser diode encompass substrates made of a material such as: IV semiconductors such as Si, Ge, and SiC; III-V compound semiconductors such as GaAs, GaP, InP, AlAs, GaN, InN, InSb, GaSb, and AlN; II-VI compound semiconductors such as ZnTe, ZeSe, ZnS, and ZnO; oxide insulators such as ZnO, $Al_2O_3$, $SiO_2$, $TiO_2$, $CrO_2$, and $CeO_2$; and nitride insulators such as SiN.

The anode electrode 21 is provided for injecting current into the active layer 111 via the clad layer 112.

The cathode electrode 23 is provided for injecting current into the active layer 111 via the clad layer 113 from under the substrate 22. The current is injected by applying a forward bias to the anode electrode 21 and the cathode electrode 23.

The active layer 111 is sandwiched between the clad layer 113 and the clad layer 112.

In order to obtain a blue to ultraviolet excitation light, a mixed crystal semiconductor including AlInGaN is used as a material of the active layer 111 and the clad layers 112 and 113. Generally, a mixed crystal semiconductor whose main component is Al, Ga, In, As, P, N, or Sb is optionally used as the active layer 111 and clad layers 112 and 113 of the laser diode. Alternatively, the active layer 111 and the clad layers 112 and 113 may be made up of a II-VI compound semiconductor such as Zn, Mg, S, Se, Te, or ZnO.

The active layer 111 is a region which emits light upon the injection of the current. The light emitted is trapped within the active layer 111 due to the difference in refractive index between the clad layer 112 and the clad layer 113.

The active layer 111 is further formed so as to have a front cleaved surface 114 and a rear cleaved surface 115 which are disposed opposite to each other so as to trap the light amplified by stimulated emission. The front cleaved surface 114 and rear cleaved surface 115 serve as mirrors.

As different from a case of a mirror which completely reflects light, a portion of the light amplified by the stimulated emission is emitted from the front cleaved surface 114 and the rear cleaved surface 115 (in the present embodiment, from the front cleaved surface 114, for convenience) of the active layer 111. The light thus emitted serves as the excitation light L0. The active layer 111 may have a multilayer quantum well structure.

The rear cleaved surface 115 opposite to the front cleaved surface 114 has a reflective film (not shown) provided thereon, which reflective film is used for laser emission. A difference in reflectance between the front cleaved surface 114 and the rear cleaved surface 115 causes most of the excitation light L0 to be emitted from a low-reflectance edge surface, for example the front cleaved surface 114, via a light emitting point 103.

The clad layer 113 and the clad layer 112 may each be made up of a semiconductor of any one of (i) III-V compound semiconductors represented by GaAs, GaP, InP, AlAs, GaN, InN, InSb, GaSb, and MN and (ii) II-VI compound semiconductors such as ZnTe, ZeSe, ZnS, and ZnO, each of which is of an n-type or a p-type. Applying a forward bias to the anode electrode 21 and the cathode electrode 23 can cause current to be injected into the active layer 111.

Film formation of the semiconductor layers such as the clad layer 113, clad layer 112, and active layer 111, may be carried out by a general film forming method such as MOCVD (metal-organic chemical vapor deposition), MBE (molecular beam epitaxy), CVD (chemical vapor deposition), laser ablasion, sputtering, or like method. The film formation of the metal layers may be carried out by a general film forming method such as vacuum deposition, plating, laser ablasion, sputtering or like method.

(Light Emitting Principle of Light Emitting Section 7)

Next described is a principle on which a laser beam emitted from a laser diode 3 causes a fluorescent material to emit light.

First, laser beams emitted from the laser diodes 3 are emitted to the fluorescent material included in the light emitting section 7. This causes electrons existing inside the fluorescent material to be excited from a low energy state to a high energy state (excited state).

Since this excited state is unstable, the energy state of the electrons inside the fluorescent material thereafter switches back to the original low energy state (ground level energy state or metastable level energy state between excitation level and ground level) after elapse of a given time.

As such, the fluorescent material emits light upon a transition of electrons in the excited, high energy state back to the low energy state.

White light can be made up by a mixture of three colors which meet an isochromatic principle or by a mixture of two colors which have a relation of complementary colors for each other. It is possible to emit white light by as above combining, based on the principle and the relation, (i) the color of the laser beam emitted from the laser diode with (ii) the color of light emitted from the fluorescent material.

(Variation)

Figure 5:
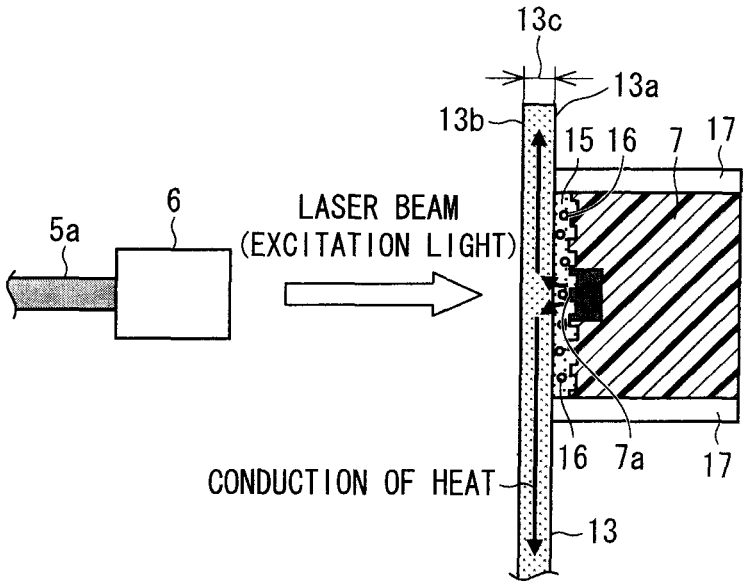
FIG. 5 is a cross-sectional view illustrating a variation of the light emitting section.

FIG. 5 is a cross-sectional view illustrating a variation of the light emitting section 7. As illustrated in FIG. 5, a reflective film 17 may be provided on a side surface of the light emitting section 7 and the adhesive layer 15. The reflective film 17 is a light-reflecting film which covers at least a portion of an outward surface of the adhesive layer 15 (the outward surface being a surface which is in contact with neither the light emitting section 7 nor the heat conducting member 13). The reflective film 17 is, for example, a metal thin film such as an aluminum thin film.

Since the adhesive layer 15 includes the diffusing agent 16, the laser beam is diffused by the diffusing agent 16. This results in generation of a laser beam (hereinafter referred to as "stray light") which does not travel in a direction of the light emitting section 7 and which instead leaks out from the side surface of the adhesive layer 15. With the above arrangement, the stray light is reflected by the reflective film 17, provided on the side surface of the adhesive layer 15, and thus remains inside the adhesive layer 15. This improves efficiency in use of the laser beam.

The reflective film 17 is simply required to cover the side surface of at least the adhesive layer 15, and is thus not necessarily required to cover the side surface of the light emitting section 7 as well. Covering the side surface of the light emitting section 7 with the reflective film 17, however, allows the reflective film 17 to cool the light emitting section 7. This effect can be improved by making the reflective film 17 of a material which is higher in heat conductivity than the light emitting section 7.

(Advantage of Headlamp 1)

The inventors of the present invention have found that the light emitting section 7 is remarkably impaired in a case where the light emitting section 7 is excited with a high-power laser beam. Impairment of the light emitting section 7 is mainly caused by (i) impairment of the fluorescent material itself included in the light emitting section 7 and further by (ii) impairment of the sealing material (for example, silicone resin) that surrounds the fluorescent material. The foregoing sialon fluorescent material and nitride fluorescent material each emit light with an efficiency of 60% to 80% upon irradiation with the laser beams. However, the remainder merely serves as a cause for generation and discharging of heat. It is thought that the material surrounding the fluorescent material is impaired due to this heat.

In the headlamp 1, which includes the adhesive layer 15 between the light emitting section 7 and the heat conducting member 13, the adhesive layer 15 fills the gap between the light emitting section 7 and the heat conducting member 13 and allows the heat conducting member 13 to cool the light emitting section 7 more effectively. As such, it is possible to (i) lengthen a life of a headlamp serving as a light source which uses a laser beam as excitation light and which has an extremely high luminance, and thus (ii) improve reliability of the headlamp.

Example

Figure 6:
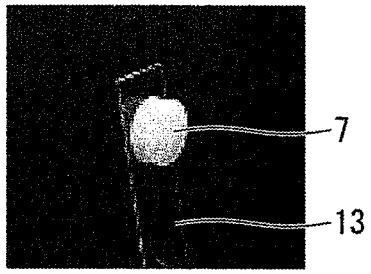
FIG. 6 is a view illustrating specific examples of the light emitting section and the heat conducting member both included in the headlamp.

The following description deals with an Example of the present invention with reference to FIG. 6. FIG. 6 is a view illustrating specific examples of the light emitting section 7 and the heat conducting member 13.

The Example used as the light emitting section 7*a* wavelength conversion member including (i) a sealing material and (ii) an oxynitride fluorescent material (Caα-SiAlON:Ce) and a nitride fluorescent material dispersed in the sealing material. The light emitting section 7 had a discoid shape, and was 3 mm in diameter and 1.5 mm in thickness.

The Example used as the heat conducting member 13 a sapphire plate (thermal conductivity: 42 W/mK) having a thickness of 0.5 mm. The light emitting section 7 was adhered, as illustrated in FIG. 6, to the heat conducting member 13 by using Epixacolle EP433 (visible light polymerizable optical adhesive manufactured by Adell Corporation) as the adhesive layer 15.

A light emitting section including Caα-SiAlON:Ce and CASN:Eu has an efficiency of approximately 70% in converting excitation light into illumination light (fluorescence). Thus, in a case where 10 W of excitation light is emitted to the light emitting section, 3 W out of the 10 W is converted not into illumination light but into heat.

The sealing material that encloses the fluorescent material has a thermal conductivity which (i) in a case of silicone resin or organic-inorganic hybrid glass, ranges approximately from 0.1 to 0.2 W/mK or (ii) in a case of inorganic glass, ranges approximately from 1 to 2 W/mK. According to calculation based on a simulation, a temperature of 500° C. or higher (555.6° C.) is reached for a heat generating body which, for example, (i) is 3 mm in height, 3 mm in width, and 1 mm in thickness, (ii) has a thermal conductivity of 0.2 W/mK, (iii) is thermally insulated from the outside, and (iv) generates heat of 1 W at a 3 mm×3 mm surface.

If the thermal conductivity of the sealing material is 2 W/mK, the temperature rises by 55.6° C. for a heat generating body which is identical in size and heat generation amount to the above heat generating body. This indicates that the thermal conductivity of the sealing material is an extremely important factor. Further, if (i) the thermal conductivity of the sealing material is 2 W/mK and (ii) the heat generating body is 3 mm in height, 1 mm in width, and 1 mm in thickness, the temperature rises by 166.7° C. Thus, reducing the size of the light emitting section 7 to increase its luminance increases the temperature rise even with the same heat generation amount, and imposes a heavier load on the light emitting section 7 as a result.

In contrast, in a case where a heat conducting plate (3 mm in height, 10 mm in width, and 0.5 mm in thickness) having a thermal conductivity of 40 W/mK is thermally adhered to the above heat generating body (3 mm in height, 3 mm in width, and 1 mm in thickness; thermal conductivity: 0.2 W/mK), the temperature rise of the heat generating body is reduced to approximately 170° C. Increasing the thickness of the heat conducting plate from 0.5 mm to 1.0 mm reduces the temperature rise to approximately 85° C., which is half the above temperature rise. Further, reducing the thickness of the heat generating body from 1 mm to a smaller value (for example, to 0.5 mm) allows heat to be more efficiently dissipated to the heat conducting plate, and further reduces the temperature rise of the heat generating body as a result.

In a case where (i) the light emitting section including a fluorescent material has a set temperature of approximately 200° C. and (ii) the fluorescent material is an oxynitride fluorescent material, a nitride fluorescent material, or a III-V compound semiconductor nanoparticle fluorescent material, heat is dissipated rapidly and efficiently even if, in particular, the light emitting section 7 is irradiated with excitation light so extremely intense that the light emitting section 7 generates heat of greater than 1 W. The above arrangement thus prevents the light emitting section 7 from being damaged (impaired).

The sealing material included in the light emitting section 7 is preferably organic-inorganic hybrid glass or inorganic glass. In a case where the sealing material is silicone resin, it is preferable to keep the temperature rise at approximately 150° C. or lower on the basis of close simulation for heat. Organic-inorganic hybrid glass tolerates temperatures approximately from 250° C. to 300° C. Inorganic glass tolerates temperatures of even 500° C. and above.

Embodiment 2

Figure 7:
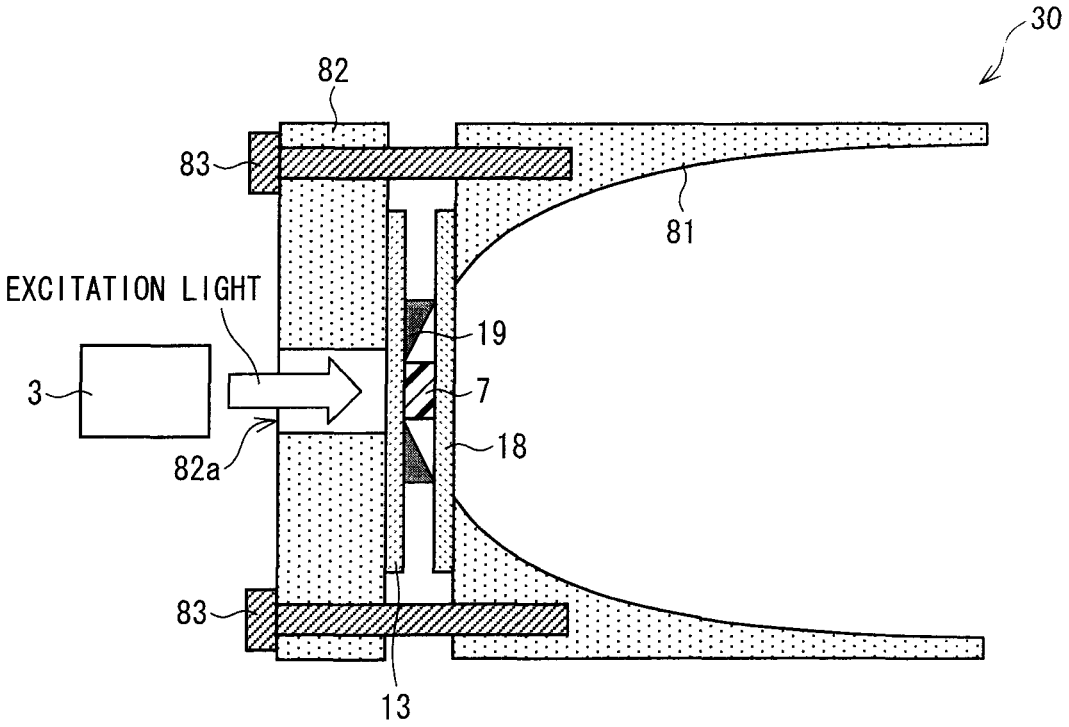
FIG. 7 is a view schematically illustrating a configuration of a headlamp in accordance with a second embodiment of the present invention.
Figure 8:
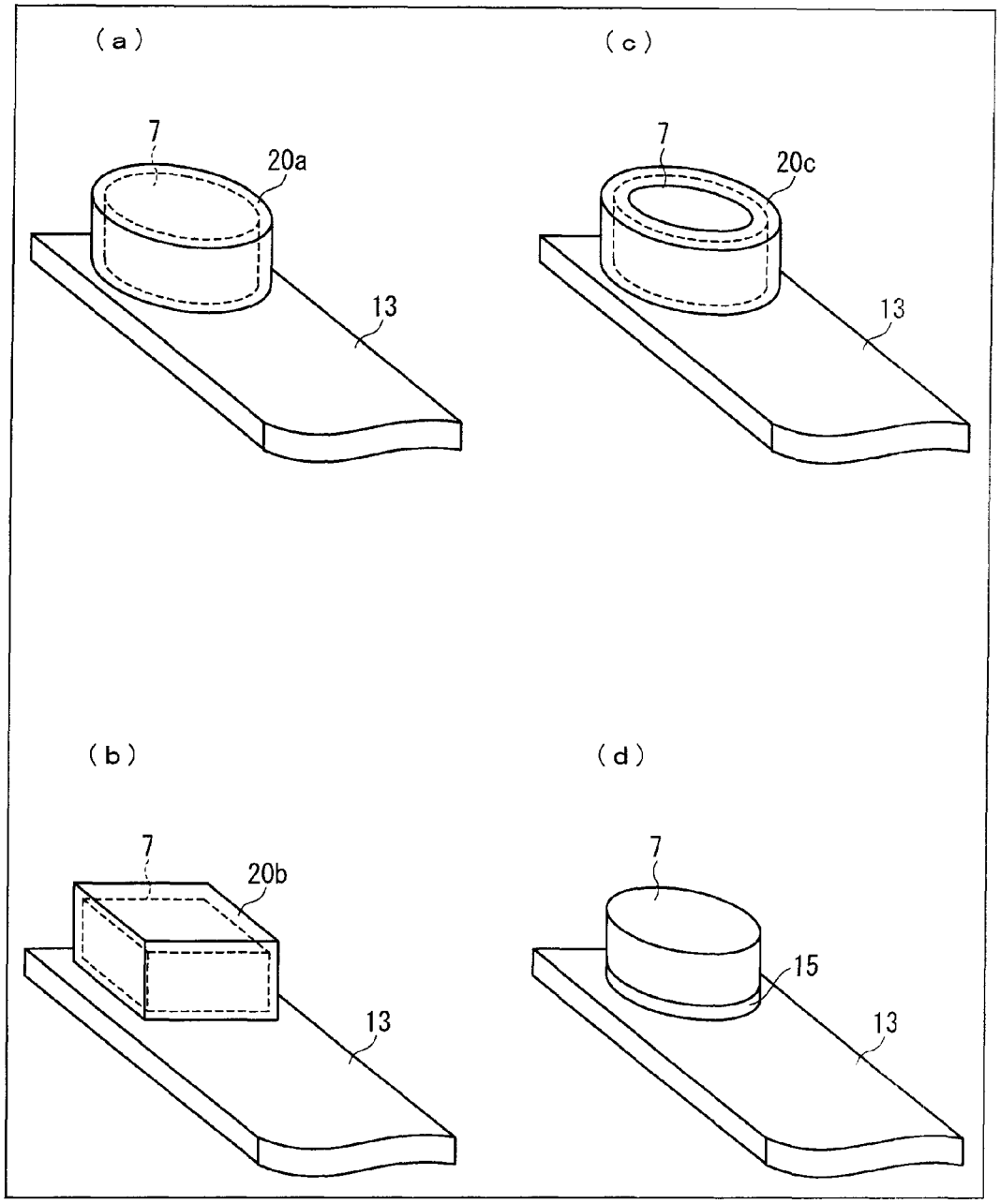
FIG. 8(*a*) through (*c*) are each a view illustrating a variation of a fixing section, and (*d*) is a view illustrating a configuration in which a light emitting section is connected to a heat conducting member via an adhesive layer.

The following describes a second embodiment of the present invention with reference to FIGS. 7 and 8. Members similar to their respective equivalents in Embodiment 1 are each assigned the same reference numeral, and are thus not described here. The present embodiment describes another example member which is used in combination with the heat conducting member 13 to sandwich the light emitting section 7.

FIG. 7 is a view schematically illustrating a configuration of a headlamp 30 of the present embodiment. As illustrated in FIG. 7, the headlamp 30 includes a transparent plate (fixing section; pressure applying mechanism; facing member) 18, a metal ring (storing member) 19, a reflecting mirror (reflecting member) 81, a substrate 82, and screws (pressure applying mechanism) 83. The light emitting section of the headlamp 30 is sandwiched between the heat conducting member 13 and the transparent plate 18.

The reflecting mirror 81 is similar in function to the reflecting mirror 8. The reflecting mirror 81 has a shape which is formed substantially by cutting the reflecting mirror 8 along a plane which is (i) at a location near a focal point of the reflecting mirror 81 and (ii) perpendicular to an optical axis. The reflecting mirror 81 is not particularly limited in terms of material. To achieve a sufficient reflectance, however, the reflecting mirror 81 is preferably produced by (i) making a reflecting mirror of copper or SUS (stainless steel) and then (ii) providing silver plating, chromate coating and the like to the reflecting mirror. Alternatively, the reflecting mirror 81 may be produced by (i) making a reflecting mirror of aluminum and (ii) providing an antioxidant film to a surface of the reflecting mirror. The reflecting mirror 81 may further alternatively be produced by (i) making a reflecting mirror of resin and (ii) forming a metal thin film on a surface of the reflecting mirror.

The metal ring 19 is a ring in a shape of a mortar having an opening in a bottom section. The metal ring 19 (*i*) supplements the reflecting mirror 81 to constitute a complete reflecting mirror and (ii) corresponds in shape to a part near a focal point of the complete reflecting mirror. The mortar shape of the metal ring 19 is surrounded by an inclined sidewall surface with which the opening is larger in area as farther away from the bottom section. The light emitting section 7 is provided in the opening of the bottom section.

The metal ring 19 includes a mortar-shaped portion having a surface which functions as a reflecting mirror. The metal ring 19 combines with the reflecting mirror 81 to constitute a reflecting mirror which is complete in shape. The metal ring 19 is thus a partial reflecting mirror which functions as a part of a reflecting mirror. In a case where the reflecting mirror 81 is referred to as "first partial reflecting mirror," the metal ring 19 can be referred to as "second partial reflecting mirror" corresponding to the part near the focal point. When the light emitting section 7 emits fluorescence, a portion of the fluorescence is reflected by the surface of the metal ring 19, and is thus emitted as illumination light in a direction of a front of the headlamp 30.

The metal ring 19 is not particularly limited in terms of material, but is preferably made of a material such as silver, copper, and aluminum for sufficient heat dissipation. The metal ring 19 is, in the case where it is made of silver or aluminum, preferably produced by (i) providing a mirror finish to the mortar-shaped portion and then (ii) providing a protecting layer (for example, chromate coating or a resin layer) to the mortar-shaped portion for protection against blackening and oxidation. The metal ring 19 is, in the case where it is made of copper, preferably produced by (i) carrying out silver plating or aluminum deposition and then (ii) providing thereto the above protecting layer.

The light emitting section 7 is adhered to (or closely contacts) the heat conducting member 13 via the adhesive layer 15 (not shown in FIG. 7; alternatively, a close contact material such as grease). The metal ring 19 is in contact with the heat conducting member 13 as well. The metal ring 19, in contact with the heat conducting member 13, produces an effect of cooling the heat conducting member 13. In other words, the metal ring 19 also functions as a cooling section for cooling the heat conducting member 13.

The metal ring 19 and the reflecting mirror 81 sandwich the transparent plate 18. The transparent plate 18 is in contact with a surface of the light emitting section 7 which surface is opposite to the laser beam irradiation surface 7*a*. The transparent plate 18 thus serves to press the light emitting section 7 against the heat conducting member 13 so that the light emitting section 7 will not be detached from the heat conducting member 13. The mortar-shaped portion of the metal ring 19 has a depth which is substantially identical to a height of the light emitting section 7. The transparent plate 18 is thus in contact with the light emitting section 7 while the transparent plate 18 is separated from the heat conducting member 13 by a fixed distance. As such, there is no possibility that the light emitting section 7 will be crushed by the heat conducting member 13 and the transparent plate 18, which sandwich the light emitting section 7.

The transparent plate 18 may be made of any material that is at least light-transmitting. The transparent plate 18 is, however, preferably has a high thermal conductivity (20 W/mK or greater) as with the heat conducting member 13. The transparent plate 18 preferably includes, for example, sapphire, gallium nitride, magnesia, or diamond. The transparent plate 18 is in this case higher in thermal conductivity than the light emitting section 7. The transparent plate 18 thus efficiently absorbs heat generated by the light emitting section 7, and consequently cools the light emitting section 7.

The heat conducting member 13 and the transparent plate 18 each preferably have a thickness which is approximately not less than 0.3 mm and not greater than 3.0 mm. If the thickness is less than 0.3 mm, the heat conducting member 13 and the transparent plate 18 cannot sandwich the light emitting section 7 and the metal ring 19 with a force sufficient to fix them. If the thickness is greater than 3.0 mm, the heat conducting member 13 and the transparent plate 18 will (i) absorb more than an ignorable level of the laser beam and (ii) be more expensive as well.

The substrate 82 is a plate-shaped member having an opening 82*a* through which the laser beam emitted from the laser diode 3 passes. The reflecting mirror 81 is fixed to the substrate 82 with the screws 83. The reflecting mirror 81 is disposed away from the substrate 82 as separated by the heat conducting member 13, the metal ring 19, and the transparent plate 18. The opening 82*a* has a center which substantially coincides with a center of the opening in the bottom section of the metal ring 19. As such, the laser beam emitted from the laser diode 3 passes through the opening 82*a* of the substrate 82, the heat conducting member 13, and the opening of the metal ring 19 to reach the light emitting section 7.

The substrate 82 is not particularly limited in terms of material. However, in a case where the substrate 82 is made of a metal which is high in thermal conductivity, the substrate 82 can also function as a cooling section for cooling the heat conducting member 13. The heat conducting member 13 is in contact in its entirety with the substrate 82. Thus, in a case where the substrate 82 is made of a metal such as iron and copper, it is possible to more efficiently cool the heat conducting member 13 and consequently cool the light emitting section 7.

The metal ring 19 is preferably securely fixed to the heat conducting member 13. The metal ring 19 can be fixed to the heat conducting member 13 to a certain extent with use of pressure caused by fixing the reflecting mirror 81 to the substrate 82 with the screws 83. However, the risk of the light emitting section 7 being detached due to a positional shift of the metal ring 19 can be avoided by securely fixing the metal ring 19 by a method of, for example, (i) adhering the metal ring 19 to the heat conducting member 13 with use of an adhesive or (ii) screwing the metal ring 19 to the substrate 82 via the heat conducting member 13.

The metal ring 19 is simply required to (i) function as the above-mentioned partial reflecting mirror and (ii) withstand the pressure caused by fixing the reflecting mirror 81 to the substrate 82 with the screws 83. The metal ring 19 may be replaced with a ring which is not made of a metal. The metal ring 19 may be replaced with, for example, a resin ring which withstands the above pressure and which has a surface that is provided with a metal thin film.

(Advantage of Headlamp 30)

In the headlamp 30, the light emitting section 7 is sandwiched between the heat conducting member 13 and the transparent plate 18. This allows the light emitting section 7 and the heat conducting member 13 to have a fixed relative positional relationship. As such, even if (i) the adhesive layer 15 is low in adhesiveness or (ii) there is a difference in coefficient of thermal expansion between the light emitting section 7 and the heat conducting member 13, it is possible to prevent the light emitting section 7 from being detached from the heat conducting member 13.

(Another Example of Fixing Section)

The fixing section for fixing a location of the light emitting section 7 relative to the heat conducting member 13 is not necessarily a plate-shaped member. The fixing section is simply required to have (i) a pressing surface which presses and is in contact with at least a part of a surface (hereinafter referred to as "fluorescence emitting surface") opposite to the laser beam irradiation surface 7*a* of the light emitting section 7 and (ii) a pressing surface fixing section which fixes a relative positional relationship between the pressing surface and the heat conducting member 13.

The light emitting section 7 can be fixed to the heat conducting member 13 by (i) fixing respective relative positions of the pressing surface and the heat conducting member 13 and (ii) pressing the pressing surface against the fluorescence emitting surface of the light emitting section 7 (that is, causing the pressing surface to be in contact with the fluorescence emitting surface with some pressure).

FIGS. 8(*a*) through (*c*) are each a view illustrating a variation of the fixing section. In a case where the light emitting section 7 is, for example, a cylindrical column in shape as illustrated in FIG. 8(*a*), the fixing section may be a cylinder-shaped hollow member 20*a* which has a surface that is in contact with the fluorescence emitting surface of the light emitting section 7 and which is connected (that is, adhered or welded) to the heat conducting member 13. In a case where the light emitting section 7 is a cuboid or a cube in shape as illustrated in FIG. 8(*b*), the fixing section may be a hollow member 20*b* in a shape of a cuboid or a cube. The hollow members 20*a* and 20*b* each have a surface connected to the heat conducting member 13, the surface having an opening.

Alternatively, the fixing section may be a fixing section 20*c* which has, as illustrated in FIG. 8(*c*), a surface that is in contact with the fluorescence emitting surface and that is partially open (particularly, in a central portion). This configuration prevents fluorescence loss which is caused by the fixing section absorbing fluorescence emitted from the light emitting section 7. The fixing section is preferably a light-transmitting member, but may be made of a material which is not light-transmitting (for example, a metal) as long as the fixing section is open at the central portion.

The fixing section may alternatively include a plurality of wires each of which has (i) a first end that is connected to the light emitting section 7 and (ii) a second end connected to the heat conducting member 13.

Further alternatively, the light emitting section 7 may be connected to the heat conducting member 13 with use of the adhesive layer 15, as illustrated in FIG. 8(*d*), instead of a fixing section 20.

Embodiment 3

Figure 9:
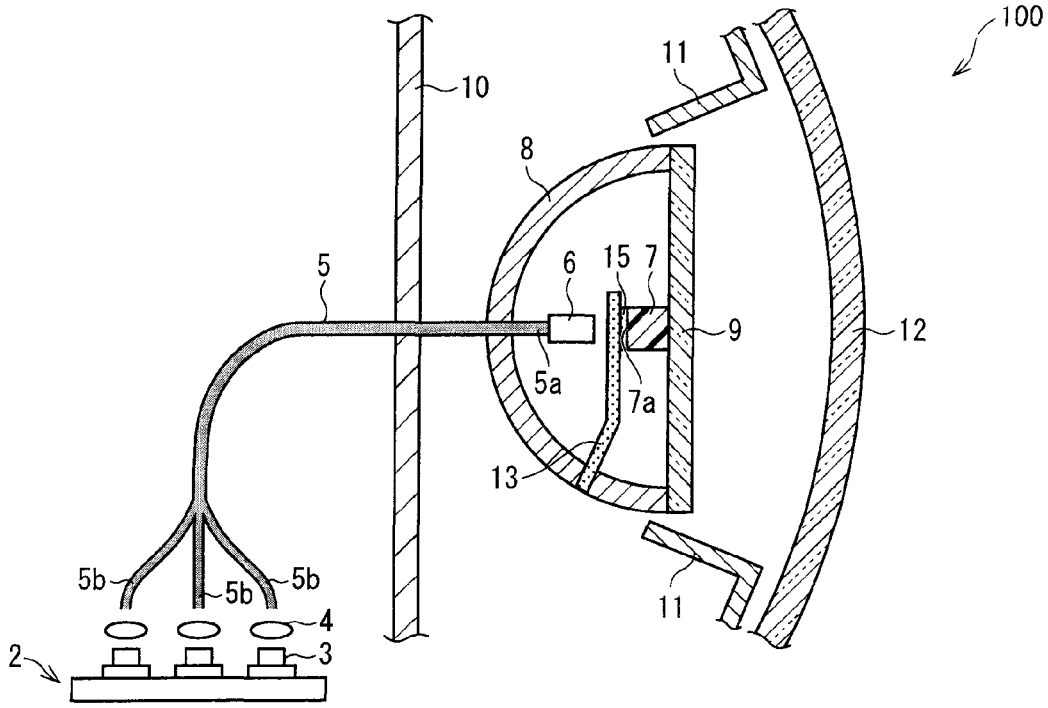
FIG. 9 is a cross-sectional view illustrating a configuration of a headlamp in accordance with a third embodiment of the present invention.

The following describes a third embodiment of the present invention with reference to FIG. 9. The present embodiment is described as a headlamp 100 which serves as an example of the illuminating device of the present invention. Members similar to their respective equivalents in Embodiments 1 and 2 are each assigned the same reference numeral, and are thus not described here.

(Configuration of Headlamp 100)

FIG. 9 is a cross-sectional view illustrating the configuration of the headlamp 100. As illustrated in FIG. 9, the headlamp 100 includes a laser diode array 2, aspherical lenses 4, an optical fiber 5, a ferrule 6, a light emitting section 7, a reflecting mirror 8, a transparent plate (first light-transmitting member) 9, a housing 10, an extension 11, a lens (second light-transmitting member) 12, a heat conducting member (first heat conducting member) 13, and an adhesive layer 15. The headlamp 100 differs from the headlamp 1 in that it does not include a cooling section 14.

In the headlamp 100, the light emitting section 7 may be caused to contact the heat conducting member 13 by a physical force. In this case, the adhesive layer 15 is not necessarily required.

The heat conducting member 13 is a plate-shaped member which has (i) a first end in thermal contact with the laser beam irradiation surface 7*a* of the light emitting section 7 and (ii) a second end connected to the reflecting mirror 8. In other words, the heat conducting member 13 is provided so as to (i) receive heat from the light emitting section 7 and (ii) conduct it to another member so that the heat can be utilized.

The heat conducting member 13, shaped and connected as above, (i) holds the minute light emitting section 7 at a light emitting section fixing location and (ii) conducts heat generated by the light emitting section 7 to the reflecting mirror 8. This arrangement warms the reflecting mirror 8 so as to prevent or remove dew condensation on a surface of the reflecting mirror 8.

Since the heat conducting member 13 is warmed by the light emitting section 7, the above arrangement removes dew condensation (cloudiness) on the heat conducting member 13 itself as well.

The reflecting mirror 8 is preferably made of a metal so that heat of the heat conducting member 13 is efficiently conducted to the entire reflecting mirror 8. In a case where the reflecting mirror 8 is made of a resin so as to be light in weight, the reflecting mirror 8 may be provided, on the surface thereof, with a wire thermally connected to the heat conducting member 13. This allows heat of the heat conducting member 13 to be conducted to the entire reflecting mirror 8. The heat conducting member 13 preferably has a thermal conductivity of 20 W/mK or greater so as to efficiently conduct heat of the light emitting section 7.

(Thermal Resistance)

The description above deals with respective materials of the members of the present invention with regard to thermal conductivity. The present invention can, however, also be described from a viewpoint of thermal resistance.

The term "thermal resistance" as used in the present specification refers to a value indicative of difficulty in heat conduction, and is represented by the following Formula (1):

$$\text{thermal resistance}=(1/\text{thermal conductivity})\cdot(\text{length of heat dissipation path/sectional area for heat dissipation}) \quad (1)$$

Increasing the thermal conductivity decreases the thermal resistance if the other parameters are unchanged. This indicates that increasing respective thermal conductivities of the light emitting section 7 and the gap layer causes their respective thermal resistances to decrease.

The thermal resistance can be decreased by a method, other than increasing the thermal conductivity, such as (i) increasing respective heat dissipation areas (that is, an area by which a member is in contact with another) of the light emitting section 7 and the gap layer and (ii) reducing respective thicknesses of the light emitting section 7 and the gap layer.

The thermal resistance simply needs to be a value indicative of difficulty in heat conduction. Thus, the present invention may be implemented on the basis of a thermal resistance concept other than the concept represented by Formula (1).

(Advantage of Headlamp 100)

The headlamp 100 is configured such that the heat conducting member 13 (i) is disposed so as to face the excitation light irradiation surface of the light emitting section 7 and (ii) absorbs heat of the light emitting section 7 so as to cool the light emitting section 7. The light emitting section 7 generates most heat on the excitation light irradiation surface. Thus, thermally connecting the heat conducting member 13 to the excitation light irradiation surface effectively cools the light emitting section 7.

As such, it is possible to (i) lengthen a life of a headlamp serving as a light source which uses a laser beam as excitation light and which has an extremely high luminance, and thus (ii) improve reliability of the headlamp.

The heat conducting member 13 receives heat from the light emitting section 7, and the heat is utilized to (i) prevent or remove dew condensation inside the headlamp 100 (particularly, on the surface of the reflecting mirror 8) or (ii) prevent the headlamp 100 from freezing or unfreeze it.

The above arrangement allows effective use of heat of the light emitting section 7, and thus eliminates the need to consume extra energy in order to, for example, prevent dew condensation. As a result, it is possible to reduce power consumption of the headlamp 100.

Embodiment 4

Figure 10:
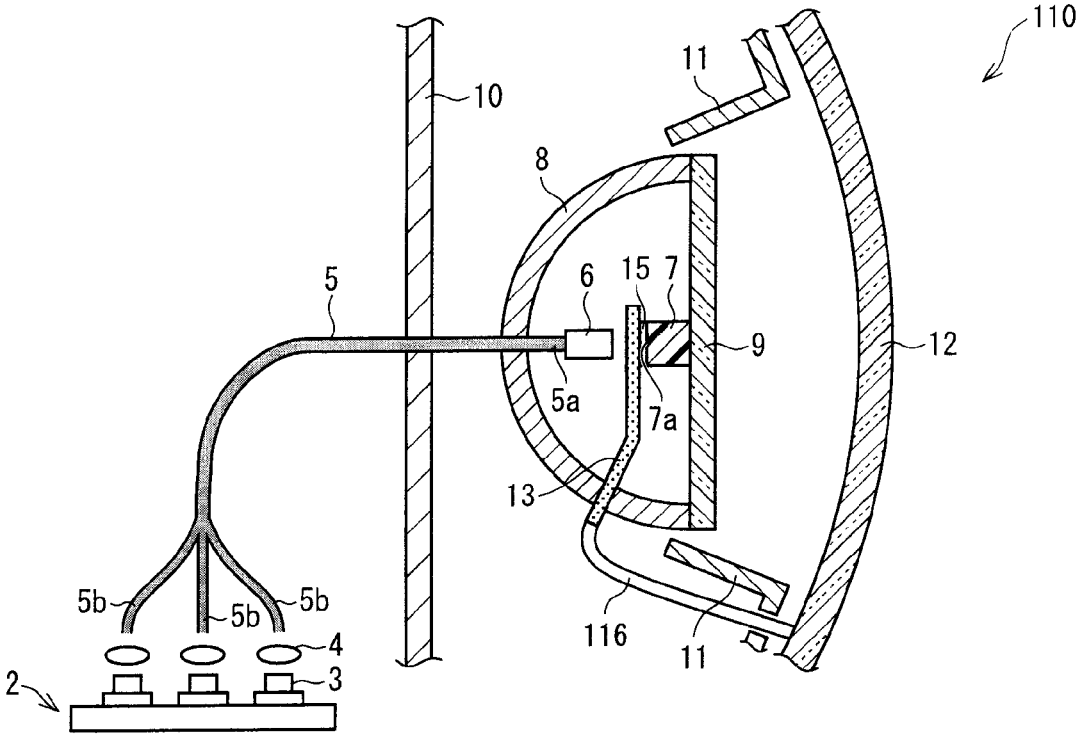
FIG. 10 is a view schematically illustrating a configuration of a headlamp in accordance with a fourth embodiment of the present invention.

The following describes a fourth embodiment of the present invention with reference to FIG. 10. Members similar to their respective equivalents in Embodiment 1 are each assigned the same reference numeral, and are thus not described here. FIG. 10 is a view schematically illustrating a configuration of a headlamp 110 in accordance with the present embodiment of the present invention.

In the headlamp 110 of the present embodiment, the heat conducting member 13 has an end connected to the reflecting mirror 8 and extending from the reflecting mirror 8, the end being connected to a first end of a heat pipe (second heat conducting member) 116.

The heat pipe 116 includes (i) a pipe made of a highly heat conductive metal such as copper and (ii) an operating fluid encased in the pipe. The heat pipe 116 may further include capillaries so that the operating fluid flows rapidly by capillary phenomenon.

The heat pipe 116 has a second end which extends through an opening of the extension 11 to be connected to the lens 12 so that heat can be conducted to the lens 12.

The heat pipe 116 allows heat of the light emitting section 7 which heat has been received by the heat conducting member 13 to be conducted to the lens 12. This arrangement warms the lens 12 and dissipates heat of the light emitting section 7 to outside air.

Since the lens 12 is directly exposed to outside air, snow may lie on the lens 12 in a cold district. The headlamp 110 warms the lens 12 with use of heat of the light emitting section 7, and can thus thaw such snow on the lens 12. While it is possible to thaw such snow on the lens 12 with use of a different heat source, using heat of the light emitting section 7 as such can save energy.

The heat conducting member for conducting heat of the heat conducting member 13 to the lens 12 is not limited to a heat pipe, and may alternatively be, for example, a thin wire.

Embodiment 5

The following describes a fifth embodiment of the present invention with reference to FIGS. 11 through 15. The present embodiment is described as a headlamp 200 which serves as an example of the illuminating device of the present invention.

(Configuration of Headlamp 200)

Figure 11:
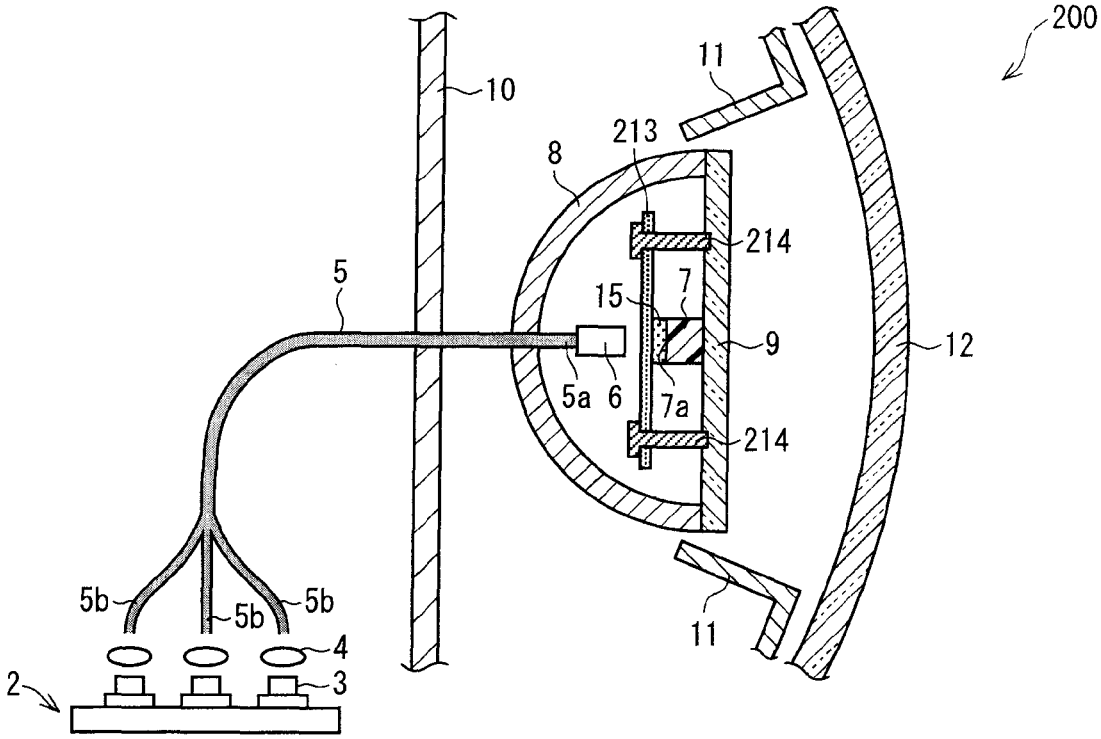
FIG. 11 is a cross-sectional view illustrating a configuration of a headlamp in accordance with a fifth embodiment of the present invention.

The description below first deals with a configuration of the headlamp 200 with reference to FIG. 11. FIG. 11 is a cross-sectional view illustrating a configuration of the headlamp 200. As illustrated in FIG. 11, the headlamp 200 includes a laser diode array 2, aspherical lenses 4, an optical fiber 5, a ferrule 6, a light emitting section 7, a reflecting mirror 8, a transparent plate (fall preventing mechanism; pressure applying mechanism; facing member) 9, a housing 10, an extension 11, a lens 12, a supporting member 213, a screw 214 (fall preventing mechanism; pressure applying mechanism), and a gap layer 15.

Figure 12:
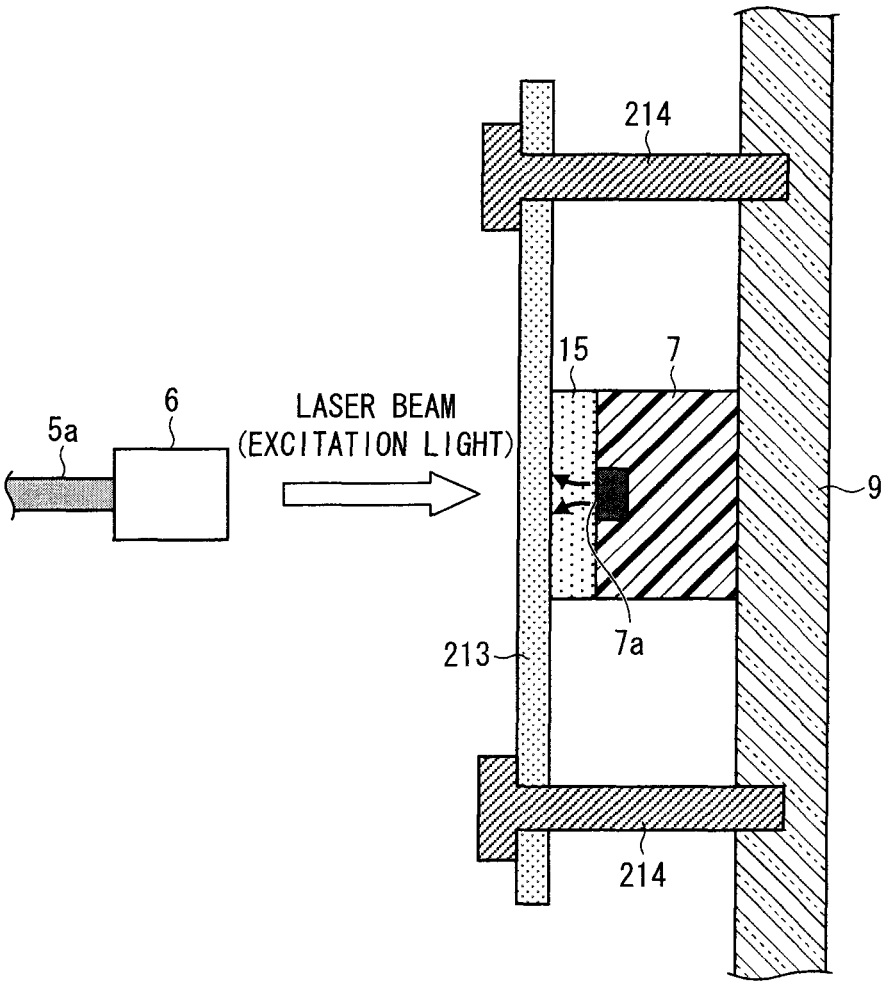
FIG. 12 is a structural view illustrating how a light emitting section and a supporting member both included in the headlamp closely contacts each other with use of a gap layer and screws.

The light emitting section 7, as illustrated in FIG. 12, closely contacts the supporting member 213 via the gap layer 15, and is thus supported by the supporting member 213 in position. Specifically, the light emitting section 7 closely and fixedly contacts, via the gap layer 15, a surface of the supporting member 213 which surface is opposite to a surface irradiated with a laser beam.

The supporting member 213 has opposite ends through which, for example, two screws 214 penetrate, and fixes the screws 214. The screws 214 have respective front ends buried in the transparent plate 9. FIG. 12 is a structural diagram illustrating how the light emitting section 7 and the supporting member 213 closely contact each other with use of the gap layer 15 and the two screws 214. The gap layer 15 may be not only a layer of cured transparent adhesive, but also a layer of a material which itself is not cured such as transparent heat dissipating grease.

The ferrule 6 may be fixed with respect to (i) the reflecting mirror 8 by use of, for example, a bar-shaped or tube-shaped member that extends out from the reflecting mirror 8 or (ii) the supporting member 213.

The transparent plate 9 may be used to press the light emitting section 7 against the supporting member 213. In other words, the light emitting section 7 may be sandwiched between the supporting member 213 and the transparent plate 9. As described above, the two screws 214 fixedly penetrate through the respective opposite ends of the supporting member 213, and have the respective front ends buried in the transparent plate 9. With this arrangement, the transparent plate 9 can apply a pressure that causes the light emitting section 7 and the supporting member 213 to press each other. In other words, the transparent plate 9, in which the screws 214 fixed by the supporting member 213 are inserted, functions as a pressure applying mechanism for applying a pressure to press the light emitting section 7 against the supporting member 213.

Pressing the light emitting section 7 against the supporting member 213 with use of the transparent plate 9 as above makes it possible to reliably keep supporting the light emitting section 7 in position even in a case where the gap layer 15 has a weakened close contact.

The transparent plate 9 may be adhered, contacted, or fused (hereinafter collectively referred to as close contact) to the light emitting section 7. Such close contact allows heat generated by the light emitting section 7 to be conducted to the transparent plate 9 more effectively.

(Supporting Member 213)

The supporting member 213 is provided so as to face the laser beam irradiation surface 7*a* of the light emitting section 7. The laser beam irradiation surface 7*a* is a surface which is irradiated with excitation light. The supporting member 213 is a light-transmitting member which receives heat of the light emitting section 7, and is thus thermally connected to the light emitting section 7 (that is, connected so that thermal energy can be transferred from the light emitting section 7). Specifically, the supporting member 213 and the light emitting section 7, as illustrated in FIG. 12, closely contact each other via the gap layer 15.

The supporting member 213 has opposite ends through which, for example, two respective screws 214 penetrate, and thus fixes the screws 214. The screws 214 have respective front ends buried in the transparent plate 9. Naturally, the number of the screws 214 is not limited to two. The supporting member 213 may alternatively have, for example, four corners through which four respective screws penetrate, and thus fix the four screws. This alternative arrangement presses the light emitting section 7 against the supporting member 213 more strongly.

Since the laser beam emitted from the laser diode 3 passes through the supporting member 213 before reaching the light emitting section 7, the supporting member 213 is preferably made of a material which is highly light-transmitting.

The supporting member 213 can be made of a material such as sapphire ($Al_2O_3$), magnesia (MgO), gallium nitride (GaN), and spinel ($MgAl_2O_4$).

The supporting member 213 may be in a shape of a plate with no bend, or have a bent portion and/or a curved portion. The supporting member 213 is, however, preferably flat (in the plate shape) at a portion to which the light emitting section 7 closely contacts the supporting member 213. This allows the light emitting section 7 to closely contact the supporting member 213 in a secure manner.

The supporting member 213 preferably has a thickness which is not less than 0.3 mm and not greater than 3.0 mm. If the thickness is less than 0.3 mm, the supporting member 213 cannot sufficiently dissipate heat of the light emitting section 7, and the light emitting section 7 may thus be impaired. If the thickness is greater than 3.0 mm, the supporting member 213 will absorb more of the laser beam emitted thereto, and efficiency in use of excitation light will in consequence decrease significantly.

(Variation of Supporting Member 213)

The supporting member 213 may alternatively include a portion which is light-transmitting (light-transmitting section) and a portion which is not light-transmitting (light blocking section). In this case, the light-transmitting section is disposed so as to cover the laser beam irradiation surface 7*a* of the light emitting section 7, whereas the light blocking section is disposed so as to surround the light-transmitting section.

The light blocking section may be a heat dissipating member made of a metal (for example, copper or aluminum). The light blocking section may alternatively be made of a light-transmitting material having a surface that is provided with a film which reflects illumination light such as a film made of aluminum or silver.

The present embodiment uses the gap layer 15, which is an adhesive layer, to adhere the light emitting section 7 to the supporting member 213. The present embodiment may be varied such that the light emitting section 7, as described above, closely contacts the supporting member 213 with simple use of a close contact material such as grease. Such variation is possible because the present embodiment, as described above, allows a pressure for pressing the light emitting section 7 against the supporting member 213 to be applied to the light emitting section 7. This arrangement eliminates the need to use an adhesive having a high adhesive strength, and thus simply requires close contact. Further, since it is possible to use a relatively inexpensive close contact material such as grease, the cost of producing the headlamp 200 can be reduced. The above grease may be replaced by, for example, a highly viscous oil or a transparent substrate provided on both sides with an adhesive (for example, transparent double-faced tape).

(Advantage of Headlamp 200)

The light emitting section 7, which emits light upon receipt of a laser beam, generates heat while emitting light as it is irradiated with the laser beam. In a case where the light emitting section 7 is repeatedly irradiated with the laser beam, the light emitting section 7 generates an increasing amount of heat. This leads to a difference in thermal expansion between the supporting member 213 and the light emitting section 7 due to a difference in coefficient of thermal expansion between them.

Thus, in a case where the light emitting section 7 is fixed to the supporting member 213 via the gap layer 15, which is an adhesive layer, or a close contact material such as grease without use of the above-described pressure applying mechanism including the transparent plate 9 and the screws 214, the above difference in thermal expansion causes a mechanical stress to a portion at which the supporting member 213 and the light emitting section 7 closely contact each other, and thus weakens close contact at the close contact portion. This makes it difficult for the supporting member 213 to keep supporting the light emitting section 7, possibly letting the light emitting section 7 fall.

The headlamp 200 uses the transparent plate 9 and the screws 214 to apply a pressure to the light emitting section 7 and the supporting member 213 in the direction toward each other. The pressure thus applied causes the light emitting section 7 to be pressed against the supporting member 213.

Thus, even in the case where the difference in thermal expansion between the supporting member 213 and the light emitting section 7 causes a mechanical stress, which in turn weakens close contact at the above-mentioned portion at which the supporting member 213 and the light emitting section 7 closely contact each other, the above arrangement presses the light emitting section 7 against the supporting member 213. The supporting member 213 can thus keep supporting the light emitting section 7.

(Variation 1)

Figure 13:
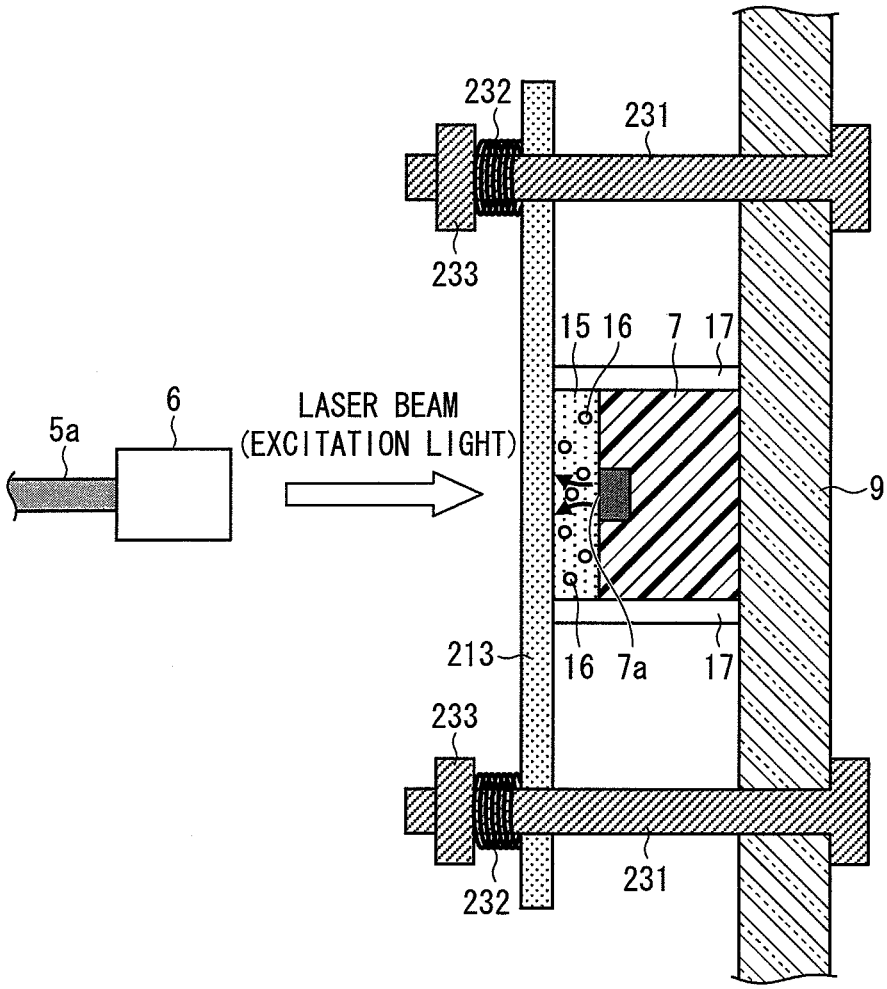
FIG. 13 is a view schematically illustrating a first variation of the headlamp.

FIG. 13 is a view schematically illustrating a configuration of Variation 1 of the headlamp 200 in accordance with the fifth embodiment. As illustrated in FIG. 13, Variation 1 is arranged such that the transparent plate 9 has through holes and that pins 231 (pressure applying mechanism) are hooked on the transparent plate 9. Specifically, the pins 231 each have (i) a discoid head and (ii) a neck, which is fitted in one of the through holes of the transparent plate 9 so that the pins 231 are attached to and fitted in the transparent plate 9.

The pins 231 further penetrate through respective through holes of the supporting member 213 in a manner in which play remains. The pins 231 each have a tip which sticks out from the corresponding through hole. The tip is provided with (i) a spring 232 (pressure applying mechanism) through which the tip is inserted and (ii) a nut 233 (pressure applying mechanism) which is threadedly engaged with the tip.

As described above, Variation 1 is configured such that the light emitting section 7 is fixedly pressed against the supporting member 213 with use of the transparent plate 9, the pins 231, the springs 232, and the nuts 233 so that a pressure is applied to the light emitting section 7 and the supporting member 213 in the direction toward each other.

The number of the pins 231 may be two as with the screws 214 of Embodiment 5. The number may alternatively be four or naturally any other number.

Variation 1 allows application of a pressure having a magnitude which more appropriately corresponds to a change in thermal expansion of the light emitting section 7 and the supporting member 213.

Variation 1 as well as Variations 2 and 3 described below includes a diffusing agent 16 in the gap layer 15. Since the laser beam has an extremely small light emitting point and is coherent light, it may harm the human body if it is emitted directly to the outside without being converted into fluorescence or diffused by the light emitting section 7. The diffusing agent 16 included in the gap layer 15 diffuses the laser beam emitted from the optical fiber 5 so that the light emitting point is expanded and the laser beam is converted into incoherent light.

Thus, even if the laser beam is not entirely converted into fluorescence or diffused by the light emitting section 7, the diffusing agent 16, which diffuses the laser beam in advance, reduces the possibility of coherent light leaking to the outside.

The reflective film 17 covers at least a portion of a surface of the gap layer 15 which surface is in contact with neither the light emitting section 7 nor the supporting member 213.

(Variation 2)

Figure 14:
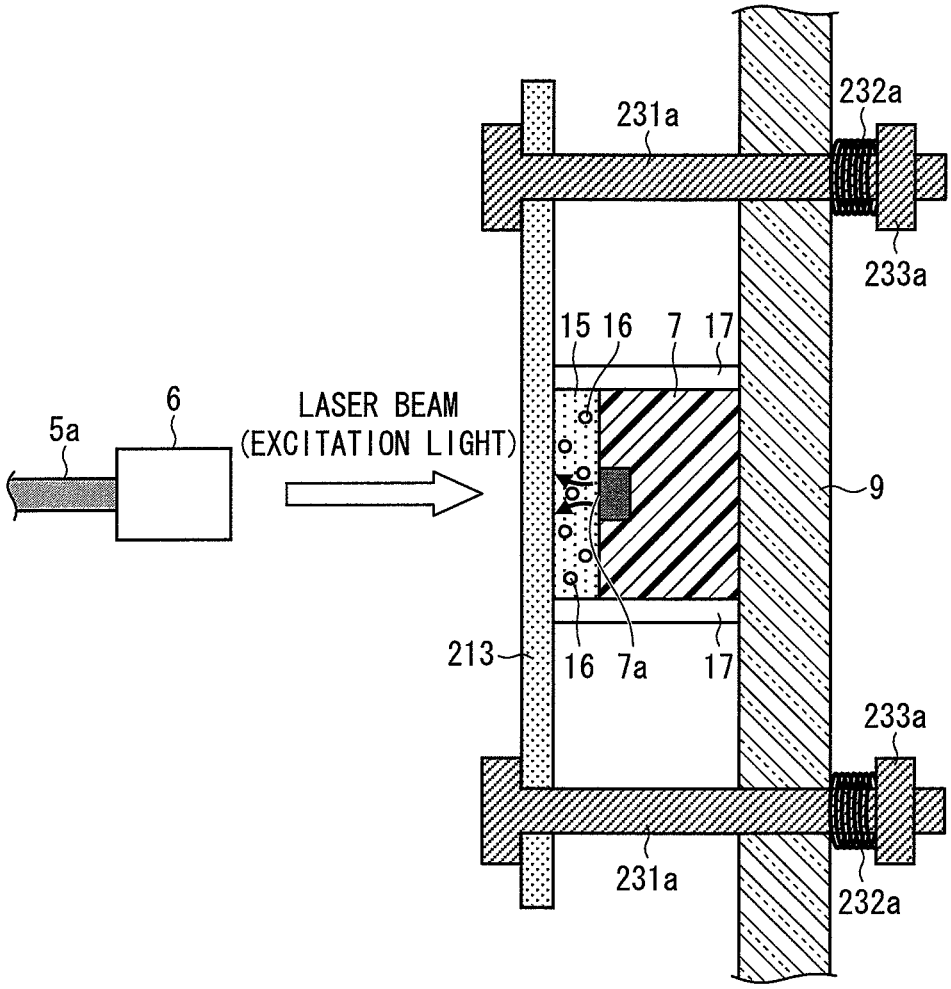
FIG. 14 is a view schematically illustrating a second variation of the headlamp.

FIG. 14 is a view schematically illustrating a configuration of Variation 2 of the headlamp 200 in accordance with the fifth embodiment. As illustrated in FIG. 14, Variation 2 is arranged such that the supporting member 213 has through holes and that pins 231*a* (pressure applying mechanism) are hooked on the supporting member 213. Specifically, the pins 231*a* each have (i) a discoid head and (ii) a neck, which is fitted in one of the through holes of the supporting member 213 so that the pins 231*a* are attached to and fitted in the supporting member 213.

The pins 231*a* further penetrate through respective through holes of the transparent plate 9 in a manner in which play remains. The pins 231*a* each have a tip which sticks out from the corresponding through hole. The tip is provided with (i) a spring 232*a* (pressure applying mechanism) through which the tip is inserted and (ii) a nut 233*a* (pressure applying mechanism) which is threadedly engaged with the tip.

As described above, Variation 2 is configured such that the light emitting section 7 is fixedly pressed against the supporting member 213 with use of the transparent plate 9, the pins 231*a*, the springs 232*a*, and the nuts 233*a* so that a pressure is applied to the light emitting section 7 and the supporting member 213 in the direction toward each other.

Variation 2 allows application of a pressure having a magnitude which more appropriately corresponds to a change in thermal expansion of the light emitting section 7 and the supporting member 213.

(Variation 3)

Figure 15:
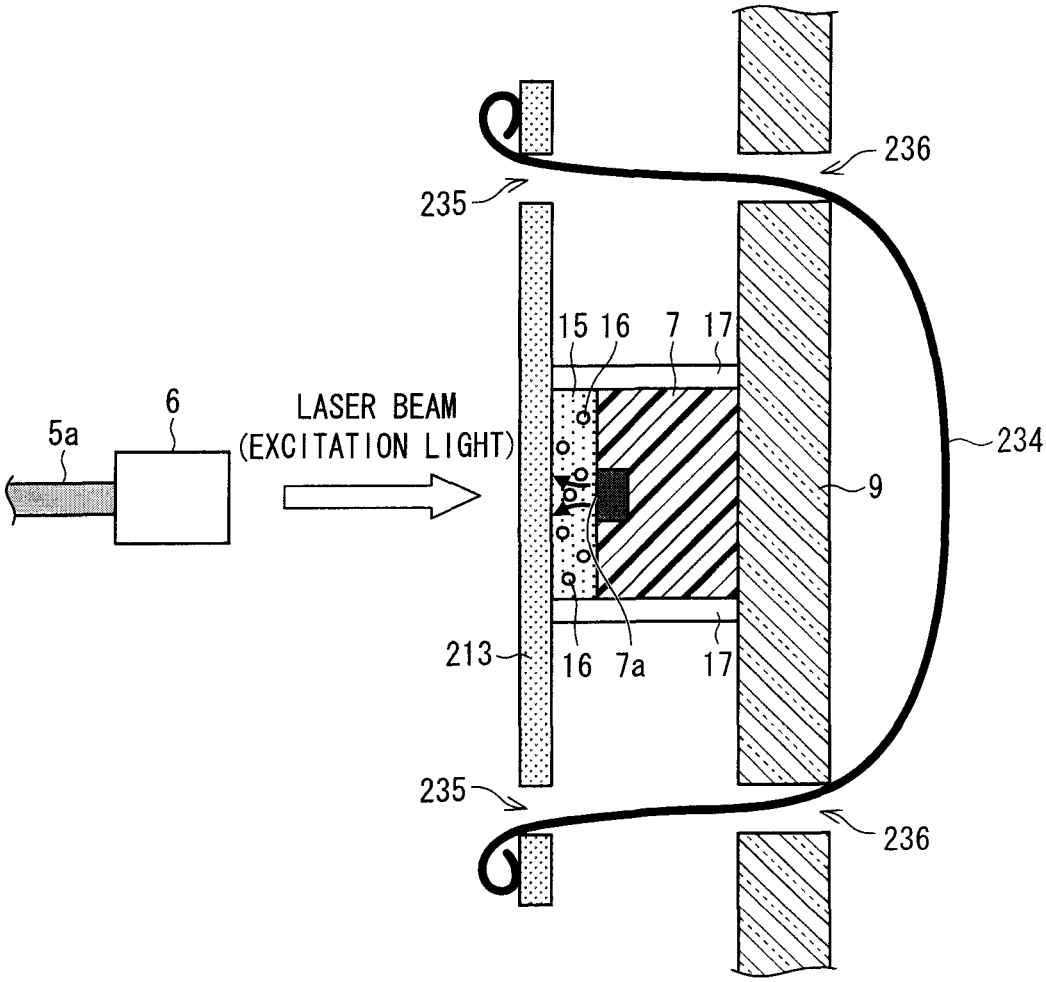
FIG. 15 is a view schematically illustrating a third variation of the headlamp.

FIG. 15 is a view schematically illustrating a configuration of Variation 3 of the headlamp 200 in accordance with the fifth embodiment. As illustrated in FIG. 15, Variation 3 is arranged such that (i) the supporting member 213 has through holes 235, (ii) the transparent plate 9 has through holes 236, and (iii) a spring 234 (pressure applying mechanism) penetrates through both the through holes 235 and 236 in a manner in which play remains. The spring 234 presses the light emitting section 7 against the supporting member 213 so as to fix the light emitting section 7. This configuration applies a pressure to the light emitting section 7 and the supporting member 213 in the direction toward each other.

Variation 3 allows application of a pressure having a magnitude which more appropriately corresponds to a change in thermal expansion of the light emitting section 7 and the supporting member 213.

Embodiment 6

Figure 16:
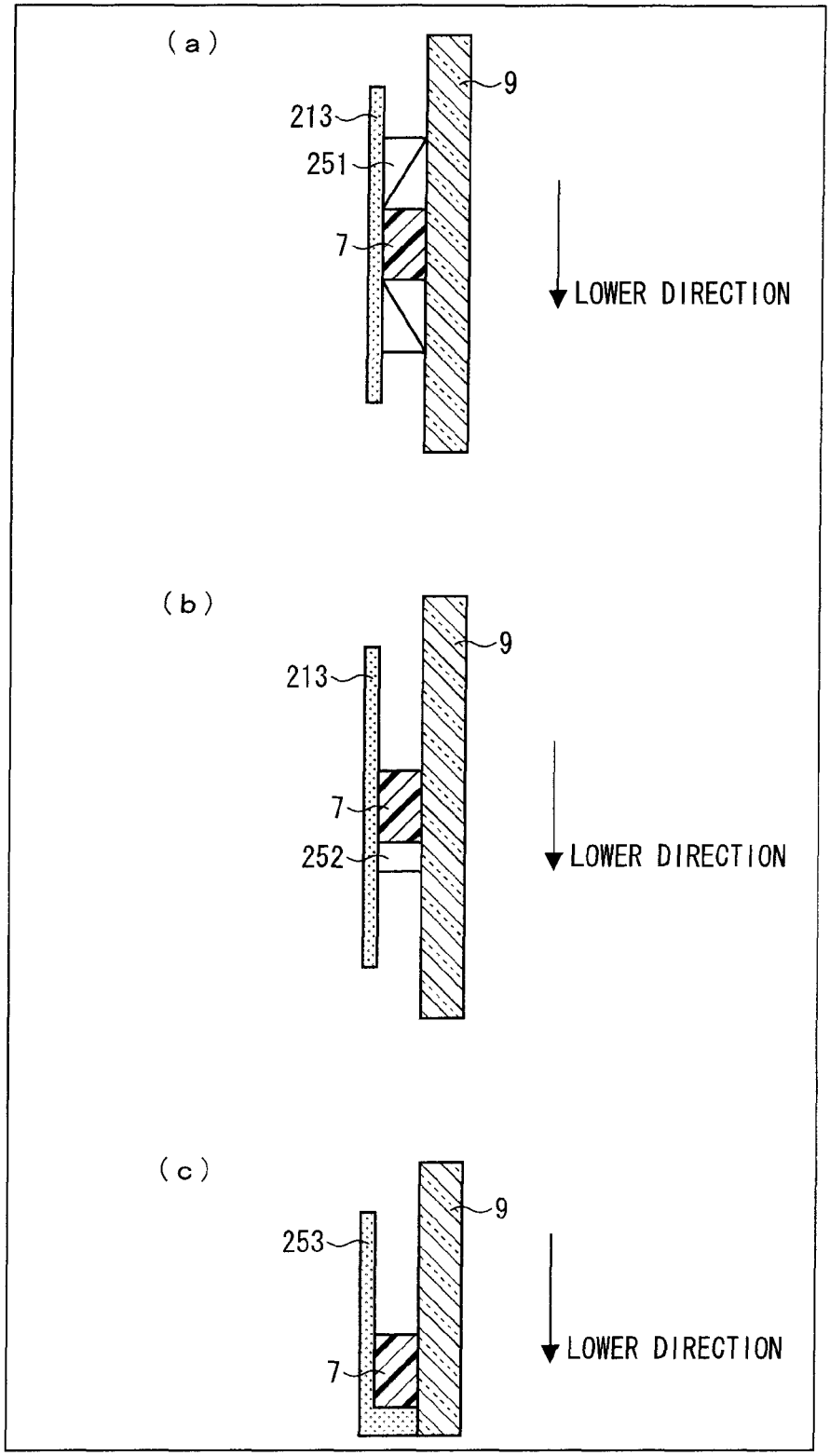
FIG. 16 is a view schematically illustrating a configuration of a headlamp in accordance with a sixth embodiment of the present invention.

The following describes a sixth embodiment of the present invention with reference to FIG. 16. Members similar to their respective equivalents in Embodiments 1 through 5 are each assigned the same reference numeral, and are thus not described here.

Embodiment 5 above is configured such that (i) the supporting member 213 has opposite ends through which the two respective screws 214 penetrate and that (ii) the screws 214 have their respective front ends buried in the transparent plate 9.

The present embodiment, in contrast, includes a member described below, specifically a metal ring, a fall preventing plate, or a light emitting section fixing structure, in addition to the screws 214 of Embodiment 5 (see FIG. 16). The use of the member such as a metal ring prevents the light emitting section 7 from falling off the supporting member 213, even in a case where close contact between the light emitting section 7 and the supporting member 213 is weakened. FIG. 16 omits the screws 214 for ease of view.

FIG. 16(*a*), for example, illustrates a configuration including a metal ring 251 (fall preventing mechanism) in addition to the screws 214 of Embodiment 5. With this configuration, the metal ring 251 reliably prevents a fall of the light emitting section 7 even in the case where close contact between the light emitting section 7 and the supporting member 213 is weakened. The metal ring 251 is not necessarily required to contact the light emitting section 7 along the entire periphery of the light emitting section 7. In a case where, for example, the light emitting section 7 is in a cuboid or cube shape, the metal ring 251 may be in contact with the light emitting section 7 at three or four points thereof. Naturally, the metal ring 251 is fixed in advance between the supporting member 213 and the transparent plate 9.

FIG. 16(*b*) illustrates a configuration including a fall preventing plate 252 (fall preventing mechanism) in addition to the screws 214 of Embodiment 5. With this configuration, the fall preventing plate 252 reliably prevents a fall of the light emitting section 7 even in the case where close contact between the light emitting section 7 and the supporting member 213 is weakened. The light emitting section 7 is simply required to be disposed on a top surface of the fall preventing plate 252. Naturally, the fall preventing plate 252 is fixed in advance between the supporting member 213 and the transparent plate 9.

FIG. 16(*c*) illustrates a configuration which includes, in addition to the screws 214 and the transparent plate 9 of Embodiment 5, a light emitting section fixing structure (fall preventing mechanism), that is, a supporting member 253 having a lower end with a projection. The supporting member 253 is provided, at its lower end, with, e.g., a plate-shaped member which is similar to the fall preventing plate 252 described above and which serves as the above projection. With this configuration, the light emitting section 7 is disposed on a bottom of a box constituted by the supporting member 253 and the transparent plate 9. The configuration reliably prevents a fall of the light emitting section 7 even in the case where close contact between the light emitting section and the supporting member 253 is weakened. This configuration eliminates the need itself to adhere the light emitting section 7 to the supporting member 253, and reliably fixes the light emitting section 7 to the supporting member 253.

Naturally, the above projection may alternatively be provided at a lower end of the transparent plate 9.

The present embodiment includes, in addition to the screws 214 of Embodiment 5, the metal ring 251, the fall preventing plate 252, or the light emitting section fixing structure. Instead of the screws 214 of Embodiment 5, a gap layer may be provided between the light emitting section 7 and the transparent plate 9 as in the case where the gap layer 15 is provided between the light emitting section 7 and the supporting member 213. In this case, even if (i) close contact of the gap layer 15 between the light emitting section 7 and the supporting member 213 or 253 is weakened and (ii) close contact of the gap layer between the light emitting section 7 and the transparent plate 9 is weakened so that neither of the supporting member 253 and the transparent plate 9 can support the light emitting section 7 any longer, the above-described member, namely the metal ring 251, the fall preventing plate 252, or the light emitting section fixing structure, prevents the light emitting section 7 from falling.

Embodiment 7

The following describes a seventh embodiment of the present invention with reference to FIGS. 17 through 22. The present embodiment is described as a headlamp 300 which serves as an example of the illuminating device of the present invention.

(Configuration of Headlamp 300)

Figure 17:
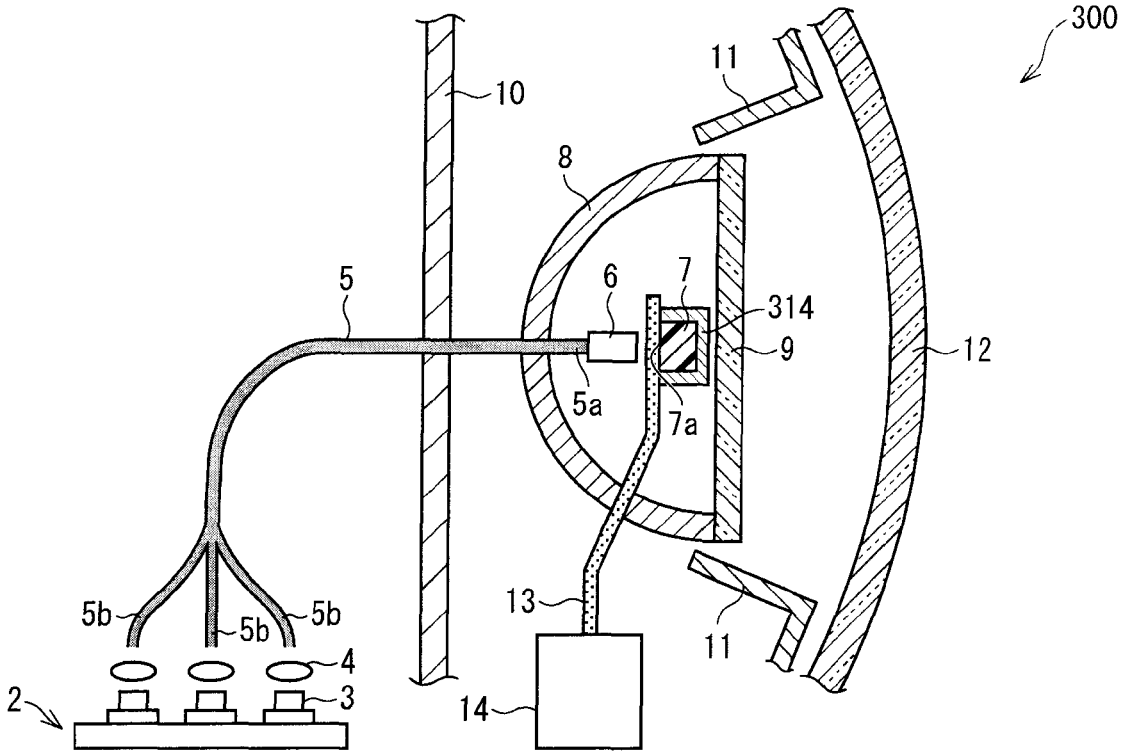
FIG. 17 is a cross-sectional view illustrating a configuration of a headlamp in accordance with a seventh embodiment of the present invention.
Figure 18:
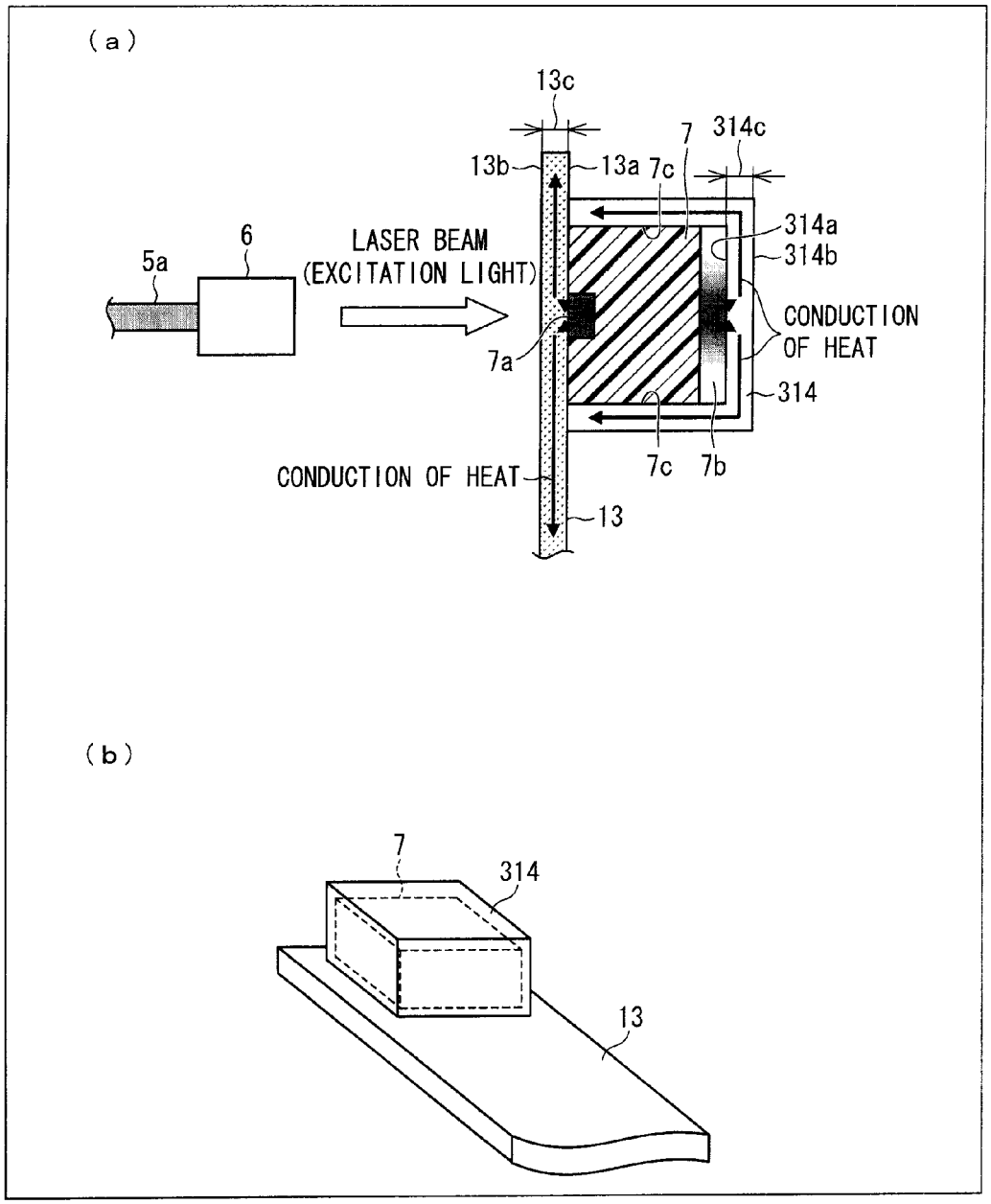
FIG. 18 is a structural view illustrating how a light emitting section and a heat conducting member both included in the headlamp are adhered to each other with use of a hollow member, where (*a*) is a cross-sectional view illustrating the structure, and (*b*) is a perspective view of the structure.

The description below first deals with a configuration of the headlamp 300 with reference to FIG. 17. FIG. 17 is a cross-sectional view illustrating a configuration of the headlamp 300. As illustrated in FIG. 17, the headlamp 300 includes a laser diode array 2, aspherical lenses 4, an optical fiber 5, a ferrule 6, a light emitting section 7, a reflecting mirror 8, a transparent plate 9, a housing 10, an extension 11, a lens 12, a heat conducting member (first heat conducting member) 13, a hollow member (second heat conducting member) 314, and a cooling section 14. FIG. 18 is a structural diagram illustrating how the heat conducting member 13 and the hollow member 314 are connected (adhered or welded) to each other. FIG. 18 illustrates in (*a*) a cross-sectional view of the structure and in (*b*) a perspective view thereof.

(Optical Fiber 5)

(Disposition of Optical Fiber 5)

The optical fiber 5 is a light guiding member which guides to the light emitting section 7 the laser beams emitted by the laser diodes 3, and is a bundle of a plurality of optical fibers. The optical fiber 5 has (i) a plurality of entering ends 5*b* each of which receives a laser beam, and (ii) a plurality of emitting ends 5*a* each of which emits a laser beam entered via a corresponding one of the entering ends 5*b*. The plurality of emitting ends 5*a* emit laser beams to respective regions on a laser beam irradiation surface (excitation light irradiation surface) 7*a* of the light emitting section 7.

The laser beam irradiation surface 7*a* is, as illustrated in FIGS. 17 and 18, a flat surface in a case where the light emitting section 7 is in a cuboid or cube shape. The light emitting section 7 is naturally not limited in shape to a cuboid or a cube, and may be in any shape as long as the light emitting section 7 has a solid body having a three dimensional spatial extent. In a case where, for example, the light emitting section 7 is in a spherical shape, the laser beam irradiation surface 7*a* is naturally a spherical surface.

The laser beam irradiation surface 7*a* illustrated in FIG. 18(*a*) is for a case in which the laser beam irradiates only a central portion of the light emitting section 7. In a case where the laser beam irradiates a first surface of the light emitting section 7 in its entirety which first surface faces the optical fiber 5, the laser beam irradiation surface 7*a* naturally corresponds to the entire first surface of the light emitting section 7.

(Heat Conducting Member 13)

The heat conducting member 13 is provided so as to face the laser beam irradiation surface (excitation light irradiation surface) 7*a* of the light emitting section 7. The laser beam irradiation surface 7*a* is a surface which is irradiated with excitation light. The heat conducting member 13 is a light-transmitting member which receives heat of the light emitting section 7, and is thus thermally connected to the light emitting section 7 (that is, connected so that thermal energy can be transferred from the light emitting section 7). Specifically, the heat conducting member 13 and the light emitting section 7 are, as illustrated in FIG. 18(*a*), adhered to each other with use of the hollow member 314. The light emitting section 7 is fitted in the hollow member 314. The heat conducting member 13 and the hollow member 314 are, as described above, connected (adhered or welded) to each other so that the light emitting section 7 is adhered to the heat conducting member 13.

The heat conducting member 13 is preferably a light-transmitting member. The heat conducting member 13 may alternatively be made of a material which is not light-transmitting (for example, a metal) as long as the heat conducting member 13 has an opening through which the laser beam passes.

(Hollow Member 314)

The hollow member 314 is provided so as to face an opposite surface 7*b* of the light emitting section 7, the opposite surface 7*b* being opposite to the laser beam irradiation surface 7*a*, which is a surface irradiated with excitation light. The hollow member 314 is a light-transmitting member which receives heat of the light emitting section 7, and is thus thermally connected to the light emitting section 7 (that is, connected so that thermal energy can be transferred from the light emitting section 7). Specifically, the light emitting section 7 is fitted in the hollow member 314 as illustrated in FIG. 18(*a*). The hollow member 314 is, as described above, connected (adhered or welded) to the heat conducting member 13 so that the light emitting section 7 inside the hollow member 314 is adhered to the heat conducting member 13.

The opposite surface 7*b*, located opposite to the laser beam irradiation surface 7*a*, is a flat surface as with the laser beam irradiation surface 7*a* in the case where the light emitting section 7 is in the cuboid or cube shape (see FIGS. 17 and 18). The light emitting section 7 is naturally not limited in shape to a cuboid or a cube, and may be in any shape as long as the light emitting section 7 has a solid body having a three dimensional spatial extent. In a case where, for example, the light emitting section 7 is in a spherical shape, the opposite surface 7*b* is naturally a spherical surface.

The opposite surface 7*b* generates, as illustrated in FIG. 18(*a*), (i) its most amount of heat in the vicinity of its center and (ii) a smaller amount of heat at a portion farther away from the vicinity of the center. This is because the light emitting section 7 is irradiated with excitation light at the laser beam irradiation surface 7*a*, that is, in the vicinity of a center of a side surface facing the emitting ends 5*a*, and the excitation light is thus mostly directed to the vicinity of the center of the opposite surface 7*b*.

The hollow member 314 is a hollow member in a cuboid or cube shape in the case where the light emitting section 7 is in the cuboid or cube shape (see FIG. 18(*b*)). The hollow member 314 has a surface connected to the heat conducting member 13, the surface having an opening. This causes the laser beam irradiation surface 7*a* of the light emitting section 7, fitted in the hollow member 314, to be adhered to the heat conducting member 13.

In other words, the hollow member 314 both covers the light emitting section 7 and causes the laser beam irradiation surface 7*a* of the light emitting section 7 to be adhered to the heat conducting member 13. Further, the hollow member 314 causes its inner wall to be adhered to (i) the opposite surface 7*b* of the light emitting section 7, the opposite surface 7*b* being opposite to the laser beam irradiation surface 7*a*, and (ii) each of four perpendicular surfaces 7*c* of the light emitting section 7, the perpendicular surfaces 7*c* being perpendicular to the laser beam irradiation surface 7*a*.

The hollow member 314, shaped and connected as above, dissipates to the outside of the headlamp 300 heat generated by the light emitting section 7. Specifically, the light emitting section 7 dissipates heat to the hollow member 314, the heat then being conducted through the inside of the hollow member 314 to reach a connection portion at which the heat conducting member 13 is connected to the hollow member 314. The heat is transferred from the hollow member 314 to the heat conducting member 13 at the connection portion.

The hollow member 314 preferably has a thermal conductivity of 20 W/mK or greater in order to dissipate heat of the light emitting section 7 efficiently. Further, the hollow member 314 is preferably made of a highly light-transmitting material because fluorescence emitted from the light emitting section 7 passes through the hollow member 314 to travel toward the lens 12.

In view of the above preferable points, the hollow member 314 is preferably made of a material such as sapphire ($Al_2O_3$), magnesia (MgO), gallium nitride (GaN), and spinel ($MgAl_2O_4$). Using one of the above materials achieves a thermal conductivity of 20 W/mK or greater.

The hollow member 314 preferably has a thickness 314*c* (see FIG. 18(*a*)) which is not less than 0.3 mm and not greater than 3.0 mm. The thickness 314*c* refers to a thickness along a direction extending from a first surface 314*a* of the hollow member 314 to a second surface 314*b* of the hollow member 314, the first surface 314*a* facing the light emitting section 7 and the second surface 314*b* being opposite to the first surface 314*a*. If the thickness is less than 0.3 mm, the hollow member 314 cannot sufficiently dissipate heat of the light emitting section 7, and the light emitting section 7 may thus be impaired. If the thickness is greater than 3.0 mm, the hollow member 314 will absorb more of fluorescence emitted from the light emitting section 7, and efficiency in use of excitation light will in consequence decrease significantly.

With an arrangement in which the hollow member 314 having an appropriate thickness is in contact with the light emitting section 7, it is possible to dissipate heat rapidly and efficiently, particularly in a case where a laser beam irradiating the light emitting section 7 is so extreme in intensity that the light emitting section 7 generates heat of, for example, greater than 1 W. The above arrangement thus prevents the light emitting section 7 from being damaged (impaired).

In a case where, in particular, the laser beam is intense, the light emitting section 7 generates heat in an amount which greatly exceeds an amount of heat dissipated from the heat conducting member 13. This indicates that the heat conducting member 13 is lower in heat dissipation efficiency for a portion farther away from the laser beam irradiation surface 7*a*, which is adhered to the heat conducting member 13. The heat dissipation efficiency is lowest at a portion near the opposite surface 7*b*, located farthest away from the laser beam irradiation surface 7*a*, which faces the heat conducting member 13. The hollow member 314 has an inner wall closely contacting the opposite surface 7*b*, and is thus capable of receiving heat from the opposite surface 7*b*.

The inner wall of the hollow member 314 is, needless to say, also adhered to each of the four surfaces 7*c* perpendicular to the laser beam irradiation surface 7*a*. The hollow member 314 is thus capable of receiving heat of the light emitting section 7 via the four surfaces 7*c* as well.

The hollow member 314 produces its effect in a case where, for example, (i) among fluorescent materials included in the light emitting section 7, a fluorescent material with a highest conversion efficiency has a conversion efficiency of 90%, (ii) the laser beam irradiation surface 7*a* of the light emitting section 7 is 2 $mm^2$ in area, and (iii) the laser beam has an intensity of 1 W or greater. In other words, the hollow member 314 provided in addition to the heat conducting member 13 effectively prevents a temperature rise in the light emitting section 7 in a case where the light emitting section 7 generates heat in an amount of 0.1 W or greater.

(Variation in Which Hollow Member 314 is Connected to Transparent Plate 9)

Figure 19:
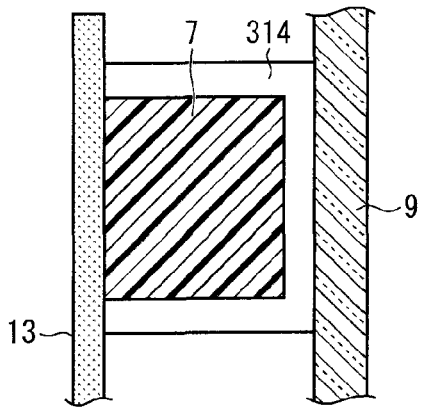
FIG. 19 is a cross-sectional view illustrating a first variation of the hollow member.

The transparent plate 9 may be used to cool the hollow member 314 as illustrated in FIG. 19. Specifically, the hollow member 314 may be thermally connected to the transparent plate 9 (that is, connected so that thermal energy can be transferred from the hollow member 314). This allows heat dissipated from the light emitting section 7 to the hollow member 314 to be in turn dissipated via the transparent plate 9. The transparent plate 9, which is large in volume as compared to the hollow member 314, has a heat capacity larger than that of the hollow member 314. Thus, in a case where the hollow member 314 is connected to the transparent plate 9 at a connection portion, there occurs a thermal gradient at the connection portion. The thermal gradient causes heat to be transferred from the hollow member 314 to the transparent plate 9. The transparent plate 9 is normally fixed to the housing 10 or the like (not shown). The heat transferred from the hollow member 314 to the transparent plate 9 is dissipated via the housing 10 or the like to the outside of the headlamp 300.

(Dispersing Agent)

The heat conducting member 13 and the hollow member 314 may each include a diffusing agent (not shown). Since the laser beam is coherent light, it may harm the human body if it is emitted directly to the outside without being converted into fluorescence or diffused by the light emitting section 7. Including the diffusing agent in the heat conducting member 13 and the hollow member 314 allows diffusion of the laser beam emitted from the optical fiber 5.

Thus, even if the laser beam is not entirely converted into fluorescence or diffused by the light emitting section 7, the diffusing agent, which diffuses the laser beam in advance, reduces the possibility of coherent light leaking to the outside.

The diffusing agent is preferably made of beads such as $SiO_2$ beads, $Al_2O_3$ beads, and diamond beads. The $SiO_2$ beads are in a perfectly spherical shape, and have a particle size which ranges from several nanometers to several micrometers. The $SiO_2$ beads are mixed in each of the heat conducting member 13 and the hollow member 314 at 0.1 to several percent. The diffusing agent is preferably contained in an amount which falls within a range approximately from 1 mg to 30 mg per gram of each of the heat conducting member 13 and the hollow member 314 because containing an excessive amount of the diffusing agent reduces a portion of the laser beam which portion reaches the light emitting section 7.

Containing a transparent, inorganic substance such as the above also improves the thermal conductivity of each of the heat conducting member 13 and the hollow member 314. $SiO_2$ has a thermal conductivity of 1.38 W/mK, which is higher than that of acrylic resin. The diamond beads have a thermal conductivity which ranges from 800 to 2000 W/mK, which is significantly higher than that of acrylic resin. Containing a transparent, inorganic substance as above significantly improves the thermal conductivity of each of the heat conducting member 13 and the hollow member 314 in consequence.

(Variation of Hollow Member 314)

Figure 20:
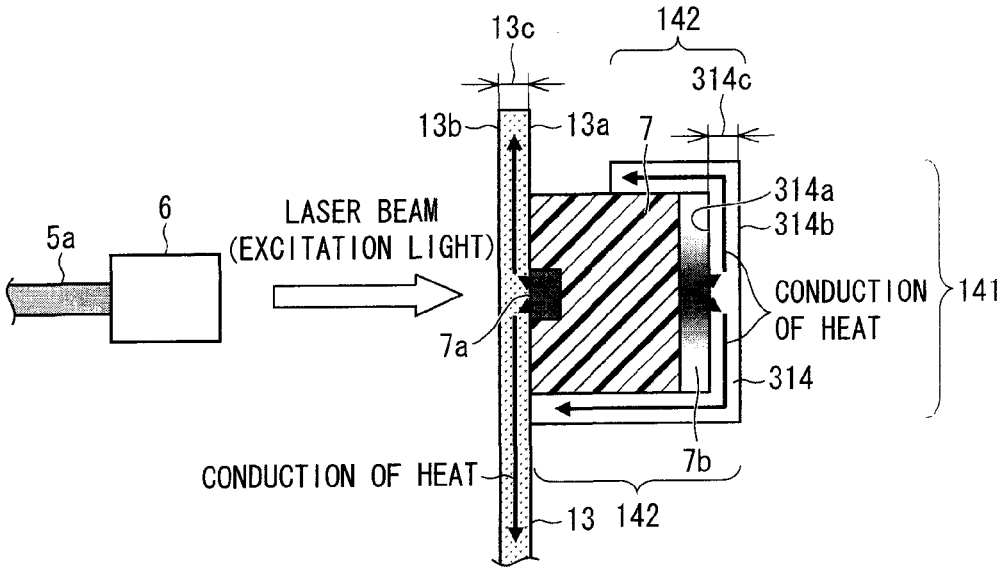
FIG. 20 is a cross-sectional view illustrating a second variation of the hollow member.

FIG. 20 is a cross-sectional view illustrating a variation of the hollow member 314. As illustrated in FIG. 20, the hollow member 314 is roughly divided into (i) an opposite surface close contact section (second heat conducting member) 141 closely contacting the opposite surface 7*b* of the light emitting section 7, the opposite surface 7*b* being opposite to the laser beam irradiation surface 7*a*, and (ii) a perpendicular surface close contact section (third heat conducting member) 142 closely contacting a part of the perpendicular surfaces 7*c*, which are perpendicular to the laser beam irradiation surface 7*a*.

The hollow member 314 illustrated in FIGS. 17 and 18 is an example including a portion corresponding to the perpendicular surface close contact section 142 illustrated in FIG. 20, the portion (i) closely contacting all the perpendicular surfaces 7*c* perpendicular to the laser beam irradiation surface 7*a* and (ii) being connected to the heat conducting member 13. This configuration causes the light emitting section 7 to closely contact the heat conducting member 13.

In contrast, the perpendicular surface close contact section 142 of the variation illustrated in FIG. 20 closely contacts a part of the perpendicular surfaces 7*c* perpendicular to the laser beam irradiation surface 7*a*. In other words, such a part of the perpendicular surfaces 7*c* perpendicular to the laser beam irradiation surface 7*a* is not covered by the hollow member 314 and is thus exposed.

The perpendicular surface close contact section 142 is connected to the heat conducting member 13 at a portion of the perimeter of the laser beam irradiation surface 7*a*, via which the light emitting section 7 closely contacts the heat conducting member 13. In this case, the perpendicular surface close contact section 142 is preferably connected to the heat conducting member 13 at a location vertically under the light emitting section 7 so as to prevent the light emitting section 7 from falling in the vertical direction. This configuration fixes a relative positional relationship between the heat conducting member 13 and the hollow member 314.

The variation illustrated in FIG. 20 can reduce an amount of a material of the hollow member 314 as compared to the hollow member 314 illustrated in FIGS. 17 and 18. The variation can thus reduce a material cost for the hollow member 314, and consequently reduce the cost of producing the headlamp 300.

Figure 21:
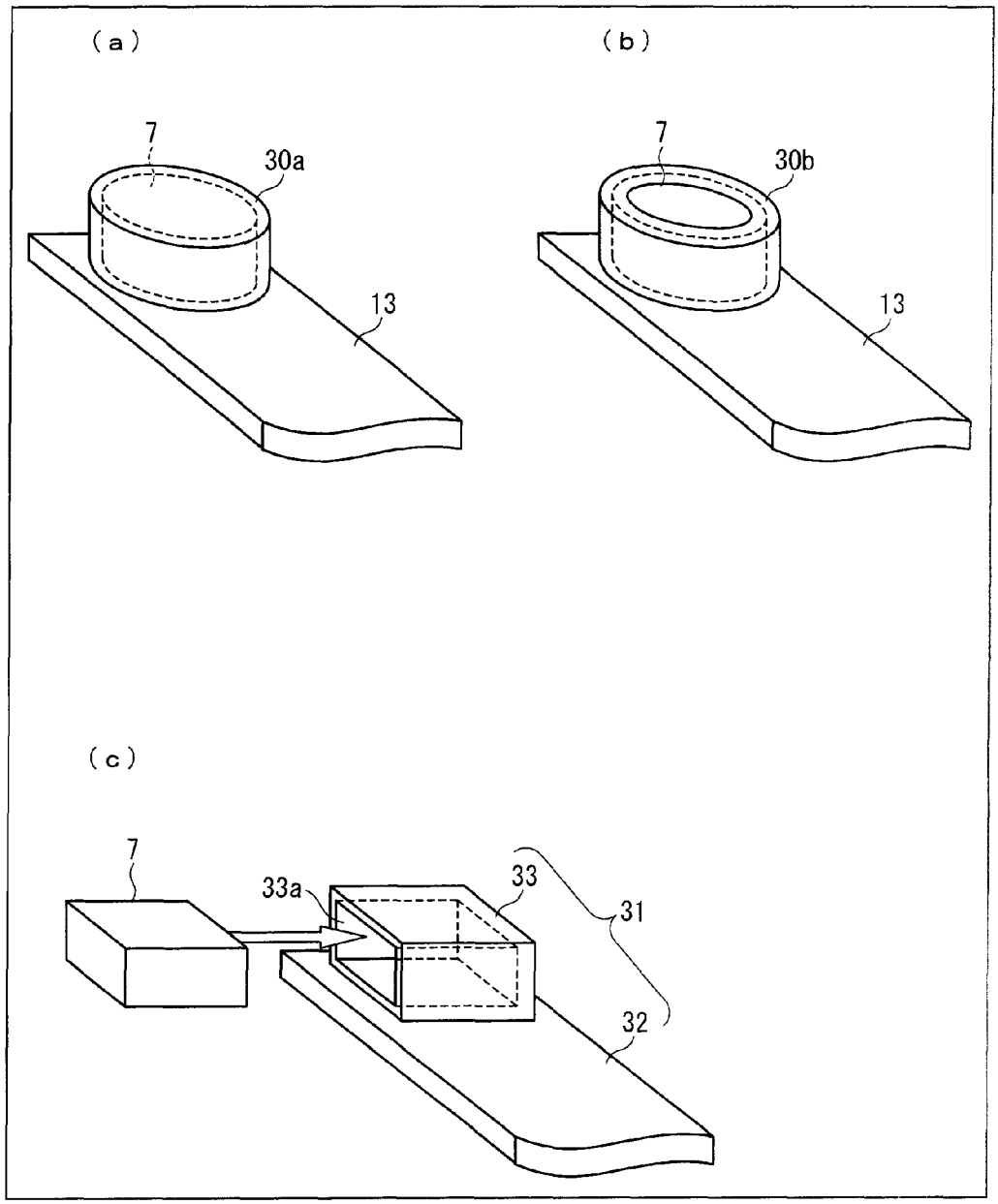
FIG. 21(*a*) through (*c*) are each a perspective view illustrating a variation of the hollow member.

FIGS. 21(*a*) through 21(*c*) are each a perspective view illustrating a different variation of the hollow member 314.

In a case where, for example, the light emitting section 7 is a cylindrical column in shape as illustrated in FIG. 21(*a*), the hollow member 314 may be varied to a cylindrical hollow member 30*a* which has a surface in contact with the fluorescence emitting surface of the light emitting section 7 and which is connected (adhered or welded) to the heat conducting member 13. The hollow member 30*a* has a surface via which it is connected to the heat conducting member 13, the surface having an opening.

Alternatively, the hollow member 314 may be varied to a hollow member 30*b* which has, as illustrated in FIG. 21(*b*), a surface that is in contact with the fluorescence emitting surface and that is partially open (particularly, at a central portion). This configuration prevents fluorescence loss which is caused by the hollow member 30*b* absorbing fluorescence emitted from the light emitting section 7. The hollow member 30*b* is preferably a light-transmitting member, but may be made of a material which is not light-transmitting (for example, a metal) as long as the hollow member 30*b* is open at the central portion.

A further alternative variation may include, as illustrated in FIG. 21(*c*), a light emitting section fixing member 31 which includes (i) a first section 32 corresponding to the heat conducting member 13 of FIG. 18(*b*) and (ii) a second section 33 corresponding to the hollow member 314 of FIG. 18(*b*). The light emitting section fixing member 31 is a member formed by integrating the heat conducting member 13 of FIG. 18(*b*) with the hollow member 314 of FIG. 18(*b*) with use of, for example, a mold.

In the above variation, the light emitting section 7 is fitted into the second section 33 as illustrated in FIG. 21(*c*) through an opening 33*a* of the second section 33. Naturally, even in the variation of FIG. 21(*c*), the light emitting section 7 may alternatively be disposed inside the second section 33 by (i) filling the second section 33 with the materials of the light emitting section 7, namely the fluorescent material and the fluorescent material retention substance, and (ii) sintering the materials.

In the variation illustrated in FIG. 21(*c*), the first section 32 and the second section 33 constituting the light emitting section fixing member 31 are integrated with each other, and are naturally in an extremely strong connection with each other.

This configuration consequently prevents (i) a problem of a positional shift of the first section 32 and the second section 33 relative to each other and (ii) a problem of a fall of either of the first section 32 and the second section 33.

(Method for Producing Headlamp 300)

Figure 22:
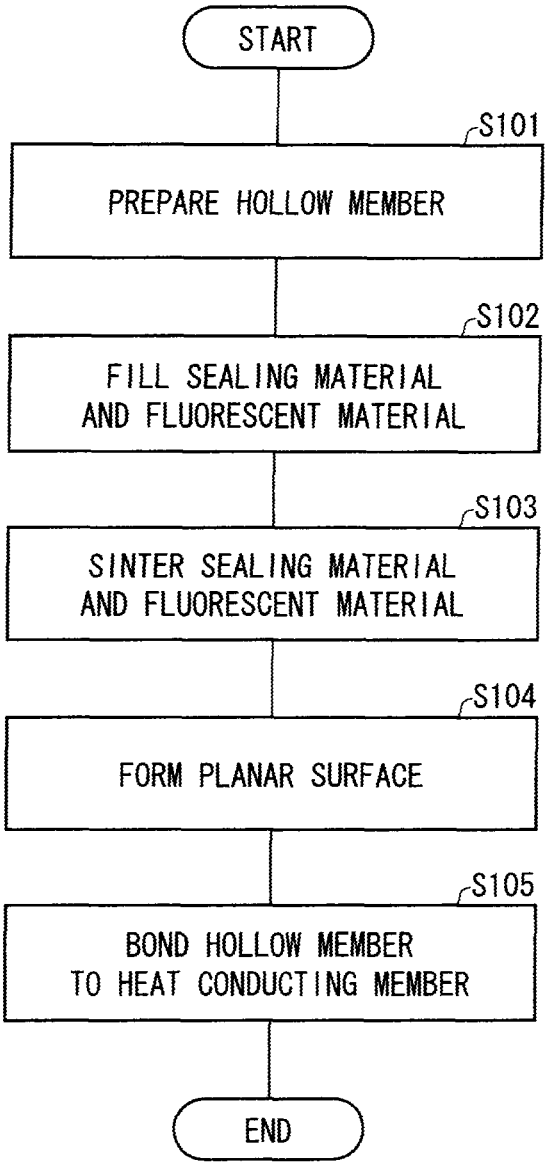
FIG. 22 is a flowchart showing steps of a process involved in a method for producing the headlamp.

The following describes an example method for producing the headlamp 300. FIG. 22 is a flowchart showing steps of a process involved in the method for producing the headlamp 300.

The process of FIG. 22 first makes, of sapphire (alumina) or quartz, a hollow member 314 in a shape of a transparent cup by ceramic injection molding (CIM) (step S101).

The hollow member 314 is 3 mm in outer diameter and 1 mm in height, and has at one of end portions of the hollow member 314 an inside hollow which is 2 mm in diameter and 0.5 mm in depth. The transparent cup may be made by carving instead of injection molding. In this case, the transparent cup can suitably be made of magnesia in addition to sapphire and quartz.

The hollow member 314 is required to be made of a material having a high melting point, which is at least 1000° C., or preferably 1500° C. or higher. Sapphire, quartz, and magnesia have their respective melting points of 2050° C., 1550° C., and 2850° C. Quartz is different from the other materials in that it does not have a definite melting point or softening point. Quartz gradually decreases in viscosity with a temperature rise above 1550° C.

The process next fills the transparent, cup-shaped hollow member 314, made by a method such as CIM and carving, with (i) inorganic glass frit serving as a sealing material and (ii) a mixture containing a fluorescent material dispersed therein (step S102).

The process then heats the filling to a temperature slightly higher than a melting point of the inorganic glass so as to (i) disperse the fluorescent material in the inorganic glass and thus (ii) make, inside the hollow member 314, a sintered body serving as a light emitting section 7 (step S103).

The inorganic glass is suitably a material which is normally referred to as low melting glass and which has a melting point of 600° C. or lower. The material may, however, have a melting point lower than a melting point of the transparent cup as long as the fluorescent material does not suffer from, for example, a change or impairment in quality.

The process next polishes the light emitting section 7, sintered inside the hollow member 314, together with the hollow member 314 to form a planar surface (step S104). In a case where the hollow member 314 is made of sapphire, the polishing uses a diamond slurry.

The process finally bonds the hollow member 314, having a planar surface formed above, to the heat conducting member 13 in such a manner that the respective planar surfaces face each other (step S105).

The above steps produce the headlamp 300, particularly the light emitting section 7, the heat conducting member 13, and the hollow member 314.

(Advantage of Headlamp 300)

The headlamp 300, when the light emitting section 7 generates heat, allows the heat conducting member 13 to receive heat from the laser beam irradiation surface 7*a* of the light emitting section 7, the laser beam irradiation surface 7*a* being a portion having the highest temperature rise.

In the headlamp 300, the heat conducting member 13 is lower in heat dissipation efficiency for a portion of the light emitting section 7 which portion is farther away from the heat conducting member 13. However, the hollow member 314 receives heat from the opposite surface 7*b* of the light emitting section 7, the opposite surface 7*b* being a portion which is opposite to the laser beam irradiation surface 7*a* and for which the heat conducting member 13 is lowest in heat dissipation efficiency.

As described above, the headlamp 300 can use the heat conducting member 13 and the hollow member 314 to efficiently dissipate heat generated by the light emitting section 7 (that is, improve heat absorption efficiency of the heat conducting members). This makes it possible to cool the light emitting section 7 more effectively. As such, it is possible to (i) lengthen a life of a headlamp serving as a light source which uses a laser beam as excitation light and which has an extremely high luminance, and thus (ii) improve reliability of the headlamp.

Embodiment 8

The following describes an eighth embodiment of the present invention with reference to FIGS. 23 through 27. Members similar to their respective equivalents in Embodiments 1 through 7 are each assigned the same reference numeral, and are thus not described here.

The present embodiment describes a laser downlight 400 as an example of an illuminating device of the present invention. The laser downlight 400 is an illuminating device which is disposed on a ceiling of a structure such as a building, vehicle or the like, and uses fluorescence as illumination light, which fluorescence is emitted upon irradiation of the light emitting section 7 with laser beams emitted from the laser diodes 3.

The present embodiment is an example laser downlight including a basic configuration of the headlamp 1 of Embodiment 1. The laser downlight may alternatively include a basic configuration of the headlamp of any of Embodiments 2 to 7.

Moreover, an illuminating device having a similar configuration to the laser downlight 400 may be disposed on a side wall or a floor of the structure. Where the illuminating device is disposed is not particularly limited.

Figure 23:
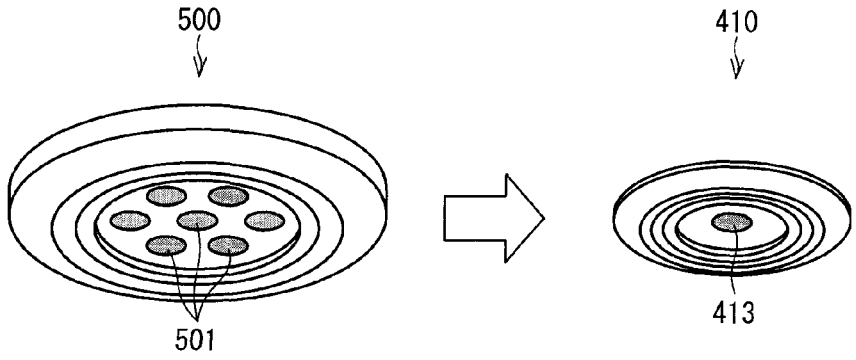
FIG. 23 is a view schematically illustrating external appearances of (i) a light emitting unit included in a laser downlight of an embodiment of the present invention and (ii) a conventional LED downlight.
Figure 24:
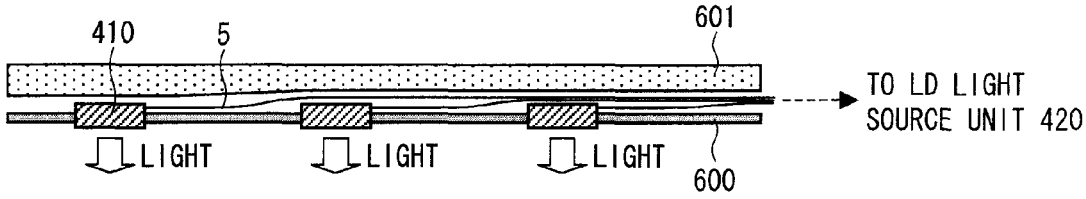
FIG. 24 is a cross sectional view illustrating a ceiling on which the laser downlight is disposed.
Figure 25:
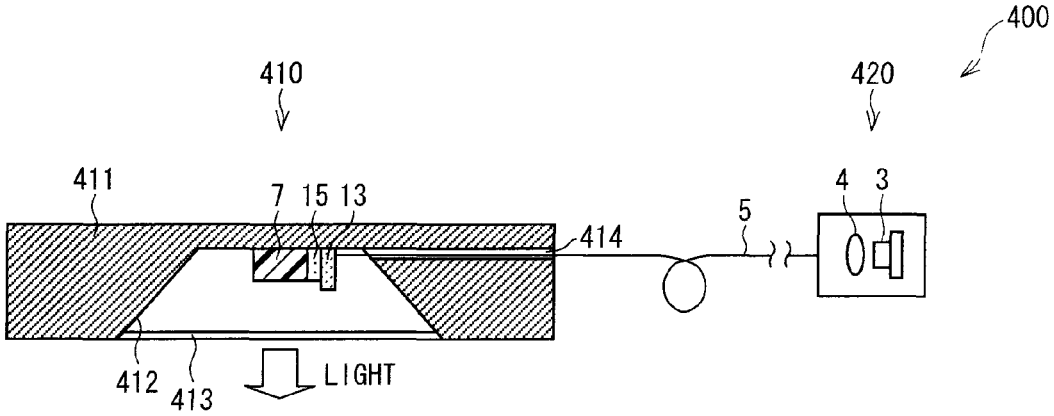
FIG. 25 is a cross sectional view illustrating the laser downlight.

FIG. 23 is a view schematically illustrating an external appearance of a light emitting unit 410 and a conventional LED downlight 500. FIG. 24 is a cross sectional view illustrating a ceiling on which the laser downlight 400 is disposed. FIG. 25 is a cross sectional view illustrating the laser downlight 400. As illustrated in FIGS. 23 to 25, the laser downlight 400 is embedded in a top panel 600, and includes (i) a light emitting unit 410 which emits illumination light and (ii) an LD light source unit 420 which supplies a laser beam to the light emitting unit 410 via the optical fiber 5. The LD light source unit 420 is disposed not on the ceiling, but at a location where the user can easily touch (e.g., on a side wall of the building). The LD light source unit 420 can be freely positioned as such since the LD light source unit 420 and the light emitting unit 410 are connected to each other via the optical fiber 5. The optical fiber 5 is disposed in a gap between the top panel 600 and a heat insulating material 401.

(Configuration of Light Emitting Unit 410)

The light emitting unit 410 includes, as illustrated in FIG. 25, a housing 411, the optical fiber 5, the light emitting section 7, a heat conducting member 13, and a light transmitting plate 413. The light emitting section 7 is adhered to the heat conducting member 13 via an adhesive layer 15. As in the above Embodiments, heat of the light emitting section 7 is conducted to the heat conducting member 13, so that the light emitting section 7 is cooled.

The housing 411 has a concave section 412, and the light emitting section 7 is disposed on a bottom surface of the concave section 412. The concave section 412 has a metal thin film formed on its surface, and therefore the concave section 412 functions as a reflecting mirror.

The housing 411 includes a path 414 formed through which the optical fiber 5 passes. The optical fiber 5 passes through the path 414 and extends to the heat conducting member 13. The optical fiber 5 emits laser beams from its emitting ends 5*a* which laser beams pass through the heat conducting member 13 and the adhesive layer 15 to reach the light emitting section 7.

The light transmitting plate 413 is a transparent or semi-transparent plate disposed so as to close an opening of the concave section 412. The light transmitting plate 413 functions similarly to the transparent plate 9: Fluorescence emitted from the light emitting section 7 is emitted through the light transmitting plate 413 as illumination light. The light transmitting plate 413 may be detachable from the housing 411, or may be omitted from the configuration.

Although the light emitting unit 410 in FIG. 23 has a circular outer edge, the shape of the light emitting unit 410 (more specifically, the housing 411) is not particularly limited in shape.

As different from the case of the headlamp, the downlight does not require an ideal point light source, and is merely required to have a single light emitting point. Hence, restrictions on the shape, size and disposition of the light emitting section 7 are fewer than those on the headlamp.

(Configuration of Light Source Unit 420)

The LD light source unit 420 includes a laser diode 3, an aspherical lens 4, and an optical fiber 5.

The entering end 5*b*, which is one end of the optical fiber 5, is connected to the LD light source unit 420. The laser beam emitted from the laser diode 3 enters the entering end 5*b* of the optical fiber 5 via the aspherical lens 4.

Only one pair of the laser diode 3 and the aspherical lens 4 is illustrated inside the LD light source unit 420 of FIG. 25. However, in a case where a plurality of light emitting units 410 are provided, a bundle of the optical fibers 5, each of which extends from a respective one of the light emitting units 410, may be guided to a single LD light source unit 420. In this case, a plurality of pairs of the laser diode 3 and the aspherical lens 4 are stored in one LD light source unit 420, and the LD light source unit 420 functions as a centralized power source box.

(Variation of how to Dispose Laser Downlight 400)

Figure 26:
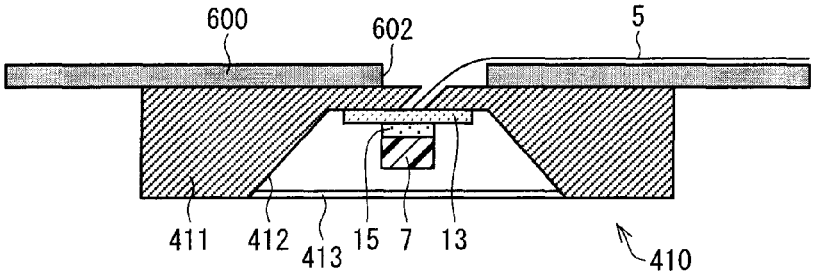
FIG. 26 is a cross sectional view illustrating a variation of how to dispose the laser downlight.

FIG. 26 is a cross sectional view illustrating a variation of how to dispose the laser downlight 400. As illustrated in FIG. 26, the variation of how to dispose the laser downlight 400 may be one in which the top panel 600 simply has a small hole 602 opened for passing through the optical fiber 5, and the laser downlight itself (light emitting unit 410) is adhered to the top panel 600, with full utilization of the thin and light-weight characteristics of the laser downlight 400. In this case, restrictions on disposing the laser downlight 400 are reduced, and construction costs can advantageously be reduced in amount to a remarkable extent.

In this configuration, the heat conducting member 13 is disposed so as to have a surface which the laser beam enters, the surface being in contact in its entirety with the bottom surface of the concave section 412. Thus, in a case where the housing 411 is made of a material which is high in thermal conductivity, the housing 411 can function as a cooling section for cooling the heat conducting member 13.

(Comparison of Laser Downlight 400 and Conventional LED Downlight 500)

As illustrated in FIG. 23, the conventional LED downlight 500 includes a plurality of light transmitting plates 501, from each of which illumination light is emitted. In other words, the LED downlight 500 includes a plurality of light emitting points. Due to the relatively small luminous flux of light emitted from each of the light emitting points, a luminous flux sufficient as illumination light cannot be achieved unless a plurality of the light emitting points are provided. This is why the LED downlight 500 includes the plurality of the light emitting points.

In comparison, the laser downlight 400 is an illuminating device that has a high luminous flux. Hence, the laser downlight 400 may have a single light emitting point. This attains an effect that a clear shadow is generated by use of the illumination light. Moreover, use of a high color rendering fluorescent material (e.g., a combination of several types of oxynitride fluorescent material) as the fluorescent material of the light emitting section 7 improves color rendering properties of the illumination light.

The above arrangement achieves color rendering properties almost as high as those of an incandescent bulb downlight. Combining a high color rendering fluorescent material with the laser diode 3 produces light having high color rendering properties which light cannot easily be produced by an LED downlight or a fluorescent lamp downlight. The light has, for example, not only a general color rendering index Ra of 90 or greater but also a special color rendering index R9 of 95 or greater.

Figure 27:
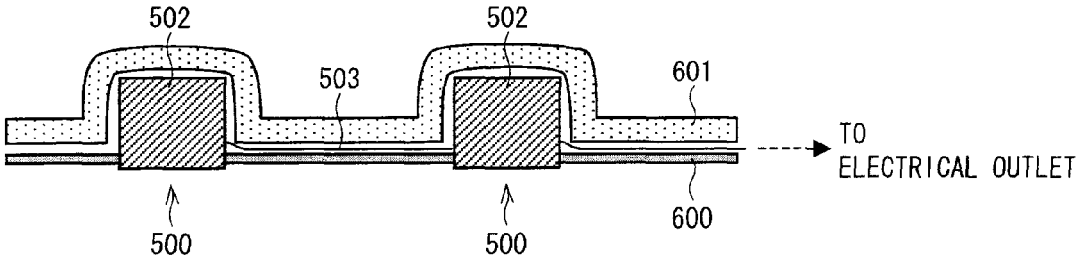
FIG. 27 is a cross sectional view illustrating a ceiling on which the LED downlight is disposed.

FIG. 27 is a cross sectional view illustrating a ceiling on which the LED downlight 500 is disposed. As illustrated in FIG. 27, in the LED downlight 500, a housing 502 is embedded in the top panel 600. This housing 502 contains an LED chip, a power source, and a cooling unit. The housing 502 is relatively large, and a concave section is formed at a part of the heat insulating material 601 in which part the housing 502 is disposed, so that the heat insulating material 601 fits with the shape of the housing 502. A power source line 503 extends from the housing 502 to be connected to a plug socket (not shown).

Such a configuration causes the following problems: First, a light source (LED chip) and a power source, each of which is a heat generating source, are provided between the top panel 600 and the heat insulating material 601. When the LED downlight 500 is used, the temperature of the ceiling increases due to these heat generating sources, thereby causing a decrease in cooling efficiency of the room.

Further, a power source and a cooling unit are required for each of the LED downlight 500 provided. This increases the total amount of costs.

In addition, since the housing 502 is a relatively large-sized member, it is often difficult to dispose the LED downlight 500 between the top panel 600 and the heat insulating material 601.

In comparison, the laser downlight 400 does not include a large heat-generating source in the light emitting unit 410. Therefore, the cooling efficiency of the room does not decrease. Consequently, it is possible to avoid an increase in the costs required for cooling the room.

Since there is no need to provide the power source and the cooling unit per light emitting unit 410, it is possible to reduce the size and thickness of the laser downlight 400. As a result, restrictions on the space for disposing the laser downlight 400 are reduced, thereby making it easy to dispose the laser downlight 400 in already-built houses.

The laser downlight 400 is small and thin, and the light emitting unit 410 can thereby be disposed on the surface of the top panel 600. As compared to the LED downlight 500, it is possible to reduce restrictions on disposition, which also allows for a remarkable reduction in construction fees.

FIG. 28 is a graph that compares specifications of the laser downlight 400 and those of the LED downlight 500. As shown in FIG. 28, with the laser downlight 400 of this example, the volume is reduced by 94% and the mass is reduced by 86%, as compared to the LED downlight 500.

Since the LD light source unit 420 can be disposed at a location which the user can reach easily, a laser diode 3 can be easily replaced, in a case where it breaks down, without any difficulty. Further, the optical fibers 5 extending from the plurality of light emitting units 410 are guided to a single LD light source unit 420. This allows collective management of the plurality of laser diodes 3. Accordingly, even if a plurality of laser diodes 3 are to be replaced, the replacement can be carried out easily.

In a case where the LED downlight 500 is of a type including the high color rendering fluorescent material, a luminous flux of approximately 500 μm is emitted with an electricity consumption of 10 W. In order to produce light of the same brightness with the laser downlight 400, an optical output of 3.3 W is required. With an LD efficiency of 35%, this optical output is equivalent to the electricity consumption of 10 W. Since the electricity consumption of the LED downlight 500 is also 10 W, there is not much remarkable difference between the LED downlight 500 and the laser downlight 400 in terms of electricity consumption. Consequently, the laser downlight 400 is capable of achieving the foregoing various advantages while consuming the same amount of electricity as the LED downlight 500.

As described above, the laser downlight 400 includes: an LD light source unit 420 including at least one laser diode 3 that emits a laser beam; at least one light emitting unit 410 including a light emitting section 7 and a concave section 412 that serves as a reflecting mirror; and an optical fiber 5 guiding the laser beam to the light emitting unit 410.

(Other Variations)

The present invention is not limited to the description of the embodiments above, but may be altered in various ways by a skilled person within the scope of the claims. Any embodiment based on a proper combination of technical means disclosed in different embodiments is also encompassed in the technical scope of the present invention.

For instance, a high-output LED may be used as the excitation light source. In this case, a light emitting device which emits white light can be produced by combining (i) an LED which emits light having a wavelength of 450 nm (blue color) with (ii) a yellow fluorescent material or with green and red fluorescent materials.

A solid laser other than the laser diode may be used as the excitation light source. It is, however, preferable that the laser diode be used since the laser diode makes it possible to reduce size of the excitation light source.

The present invention can alternatively be described as follows:

The light-emitting device may preferably be arranged such that the gap layer adheres the light emitting section and the heat conducting member to each other.

The above arrangement fixes the light emitting section to the heat conducting member with use of the gap layer.

The light-emitting device may preferably be arranged such that the gap layer is so flexible as to absorb a difference in coefficient of thermal expansion between the light emitting section and the heat conducting member.

The light emitting section and the heat conducting member are different from each other in coefficient of thermal expansion. Thus, in the arrangement in which the light emitting section and the heat conducting member are adhered to each other with use of a gap layer, the light emitting section may become detached from the heat conducting member due to the difference in coefficient of thermal expansion in a case where the light emitting section generates heat.

According to the above arrangement, the gap layer is so flexible (or viscous) as to absorb the difference in coefficient of thermal expansion between the light emitting section and the heat conducting member. The arrangement thus prevents the light emitting section from being detached from the heat conducting member due to heat generated by the light emitting section.

The light-emitting device may preferably further include: a fixing section for fixing a relative positional relationship between the light emitting section and the heat conducting member.

The above arrangement provides a fixing section that fixes a relative positional relationship between the light emitting section and the heat conducting member. The arrangement thus prevents the light emitting section from being detached from the heat conducting member even in a case where the gap layer is low in adhesiveness or a case where there has occurred a difference in coefficient of thermal expansion between the light emitting section and the heat conducting member.

The light-emitting device may preferably be arranged such that the fixing section is higher in thermal conductivity than the light emitting section.

According to the above arrangement, the fixing section is higher in thermal conductivity than the light emitting section. The fixing section thus efficiently absorbs heat generated by the light emitting section, and consequently cools the light emitting section.

The light-emitting device may preferably be arranged such that the gap layer includes a heat conducting particle which is in contact with the light emitting section and the heat conducting member.

The above arrangement causes heat of the light emitting section to be conducted to the heat conducting member with use of the heat conducting particle. The arrangement thus allows heat of the light emitting section to be efficiently conducted to the heat conducting member with use of the heat conducting particle even in a case where the gap layer includes a main component which is not so high in thermal conductivity.

The light-emitting device may preferably be arranged such that the gap layer includes a diffusing agent for diffusing the excitation light.

Since the excitation light is coherent light, it may harm the human body if it is emitted directly to the outside without being converted into fluorescence or diffused by the light emitting section.

According to the above arrangement, the gap layer includes a diffusing agent, which diffuses the excitation light. Thus, even if the excitation light is not entirely converted into fluorescence or diffused by the light emitting section, the gap layer, which diffuses the excitation light in advance, reduces the possibility of coherent light leaking to the outside.

The light-emitting device may preferably further include: a reflective film at least partially covering a surface of the gap layer which surface is in contact with neither the light emitting section nor the heat conducting member.

In the case where the gap layer includes a diffusing agent, the excitation light, as diffused by the diffusing agent, includes a component (stray light) which travels not toward the light emitting section but toward a side of the gap layer (that is, within a predetermined angle with a central axis extending in a direction perpendicular to the optical axis of the excitation light irradiating the light emitting section).

The above arrangement includes a reflective film which partially covers a surface of the gap layer which surface is in contact with neither the light emitting section nor the heat conducting member. The arrangement thus prevents at least a portion of the stray light to be emitted from the gap layer, so that such at least a portion of the stray light remains inside the gap layer.

The above arrangement consequently improves efficiency in use of excitation light in the case where the gap layer includes a diffusing agent.

The light-emitting device may preferably be arranged such that the gap layer has a thickness of 30 μm or less between the heat conducting member and the excitation light irradiation surface.

The gap layer having a thickness of 30 μm or less is low in thermal resistance even in a case where the gap layer is lower in thermal conductivity than the light emitting section. The above arrangement thus allows heat generated by the light emitting section to be efficiently conducted to the heat conducting member via the gap layer.

The light-emitting device may preferably be arranged such that the light emitting section has a thickness between the excitation light irradiation surface and a surface opposite to the excitation light irradiation surface, the thickness being at least 10 times a particle size of the fluorescent material and not greater than 2 mm.

In a case where the light emitting section is thin, heat thereof can be conducted to the heat conducting member efficiently as compared to a case where the light emitting section is thick. If, however, the light emitting section is too thin, the excitation light may not be converted into fluorescence, and may instead be emitted directly to the outside. If, on the other hand, the light emitting section is too thick, it may not only reduce heat dissipation efficiency of the heat conducting member for the light emitting section, but also blur a light distribution pattern of the light-emitting device.

The light emitting section thus preferably has a thickness which is at least 10 times the particle size of the fluorescent material and not greater than 2 mm. A simulation has shown that in a case where the light emitting section has a thickness which is at least 10 times the particle size of the fluorescent material, nearly all the excitation light is converted into fluorescence.

The light-emitting device may preferably be arranged such that the heat conducting member has a thickness of not smaller than 0.3 mm and not greater than 3.0 mm between (i) a first surface facing the excitation light irradiation surface and (ii) a second surface opposite to the first surface.

If the heat conducting member has a thickness which is less than 0.3 mm, it may not be able to dissipate heat of the light emitting section sufficiently, and the light emitting section may be impaired as a result. If, on the other hand, the heat conducting member has a thickness which is greater than 3.0 mm, it will absorb a larger proportion of the excitation light irradiating the light emitting section, and efficiency in use of the excitation light will be decreased significantly as a result. The heat conducting member thus preferably has a thickness of not smaller than 0.3 mm and not greater than 3.0 mm.

The technical scope of the present invention further encompasses an illuminating device and a vehicle headlamp each including the light-emitting device.

The light-emitting device may preferably be arranged such that the first heat conducting member is provided so as to face an excitation light irradiation surface of the light emitting section, the excitation light irradiation surface being irradiated with the excitation light, and transmits the excitation light.

According to the above arrangement, the first heat conducting member is provided so as to face the excitation light irradiation surface of the light emitting section, and absorbs heat of the light emitting section to cool it. Since the first heat conducting member is light-transmitting, the excitation light can pass through the first heat conducting member to reach the light emitting section. The light emitting section generates most heat on the excitation light irradiation surface. The first heat conducting member, provided so as to face the excitation light irradiation surface, consequently cools the light emitting section effectively.

The light-emitting device may preferably be arranged such that the heat received by the first heat conducting member is conducted to a reflecting mirror serving as the different member.

According to the above arrangement, heat of the light emitting section is conducted via the first heat conducting member to the reflecting mirror, so that the reflecting mirror is warmed. The arrangement thus prevents or removes dew condensation (or freezing) on a surface of the reflecting mirror.

The light-emitting device may preferably further include: a first light-transmitting member which is provided at an opening of a reflecting mirror and which transmits fluorescence emitted from the light emitting section as illumination light, wherein: the heat received by the first heat conducting member is conducted to the first light-transmitting member serving as the different member.

According to the above arrangement, heat of the light emitting section warms the first light-transmitting member. The first light-transmitting member is provided at an opening of a reflecting mirror, and transmits the illumination light so as to emit the illumination light to the outside of the light-emitting device. Since the first light-transmitting member is warmed, it is possible to, for example, prevent dew condensation on the first light-transmitting member.

The technical scope of the present invention further encompasses a vehicle headlamp including the light-emitting device. In such a vehicle headlamp, it is possible with use of heat of the light emitting section to (i) prevent or remove dew condensation, (ii) prevent freezing or unfreeze, or (iii) thaw snow, for the vehicle headlamp.

The vehicle headlamp may preferably further include: a second light-transmitting member for transmitting illumination light, emitted by the light-emitting device, so as to emit the illumination light to an outside of the vehicle headlamp; and a second heat conducting member for conducting heat, received by the first heat conducting member, to the second light-transmitting member.

According to the above arrangement, the vehicle headlamp includes a second light-transmitting member, through which illumination light emitted from the light-emitting device passes so as to be emitted to the outside of the vehicle headlamp. The second light-transmitting member is connected to the first heat conducting member via the second heat conducting member so that heat can be transferred from the first heat conducting member to the second light-transmitting member. Heat generated by the light emitting section and then received by the first heat conducting member is thus conducted to the second light-transmitting member. The above arrangement consequently warms the second light-transmitting member with use of such heat of the light emitting section.

As such, it is possible to (i) prevent or remove dew condensation, (ii) prevent freezing or unfreeze, or (iii) thaw snow, for the second light-transmitting member. Heat of the light emitting section can thus be used effectively.

The light-emitting device may preferably be arranged such that the fall preventing mechanism is a pressure applying mechanism which is in contact with the at least part of the outer surface of the light emitting section and which applies a pressure that causes said at least part of the outer surface and the supporting member to press each other so that the light emitting section is pressed against the supporting member.

According to the above arrangement, the pressure applying mechanism is in contact with at least part of the outer surface of the light emitting section, and applies a pressure that causes the at least part of the outer surface and the supporting member to press each other. The pressure thus applied presses the light emitting section against the supporting member.

Since the light emitting section is pressed against the supporting member in the above arrangement, the supporting member can keep supporting the light emitting section even if there has occurred a mechanical stress due to a difference in thermal expansion between the supporting member and the light emitting section, and close contact is consequently weakened as described above at a portion at which the supporting member and the light emitting section closely contact each other.

The light-emitting device may preferably be arranged such that the pressure applying mechanism includes a facing member which faces the supporting member so that the light emitting section is sandwiched between the supporting member and the facing member and which is in contact with at least part of a portion of the outer surface of the light emitting section, the portion being opposite to the supporting member; and the pressure applying mechanism applies a pressure that causes the supporting member and the facing member to press each other so that the light emitting section is fixed between the supporting member and the facing member.

The above arrangement positions the supporting member and the facing member so that they face each other so as to sandwich the light emitting section, and applies a pressure that causes the supporting member and the facing member to press each other. The pressure thus applied presses the supporting member and the facing member in such a direction as to press the light emitting section on both sides against each other.

With the above arrangement, it is possible to fix the light emitting section between the supporting member and the facing member even if there has occurred a mechanical stress due to a difference in thermal expansion between the supporting member and the light emitting section, and close contact is consequently weakened as described above at a portion at which the supporting member and the light emitting section closely contact each other.

The light-emitting device may preferably further include: a storing member which includes a concave section for storing the light emitting section, the concave section having a bottom section that is open and allowing the excitation light, directed from the excitation light source to the light emitting section, to pass through the bottom section, wherein: the storing member is sandwiched between the supporting member and the facing member so as to maintain a gap between the supporting member and the facing member.

According to the above arrangement, the light emitting section is stored inside the concave section of the storing member, and is sandwiched, together with the storing member, between the supporting member and the facing member. The bottom section of the concave section is open, and excitation light emitted from the excitation light source thus passes through the bottom section to irradiate the light emitting section.

Since there is a pressure applied to the supporting member and the facing member in the direction toward each other, the pressure will be applied directly to the light emitting section without the use of the storing member. Under such a pressure applied constantly for an extended period of time, the light emitting section may be crushed by the pressure, and may be damaged as a result.

In view of this, the above arrangement stores the light emitting section in the storing member, which maintains the gap between the supporting member and the facing member, so that the pressure applied to the supporting member and the facing member in the direction toward each other is not directly applied to only the light emitting section.

In a case where, for example, the storing member has a thickness substantially equal to a thickness of the light emitting section, the light emitting section is sandwiched between the supporting member and the facing member while a fixed gap is maintained therebetween. The respective thicknesses of the light emitting section and the storing member can each be defined by a distance thereof extending from the supporting member to the facing member.

The above arrangement makes it possible to fix the light emitting section between the supporting member and the facing member while preventing the light emitting section from being crushed and thus damaged.

The light-emitting device may preferably be arranged such that the concave section is defined by an inclined sidewall surface having a shape of a mortar which has an opening area that is larger as farther away from the bottom section; and the inclined sidewall surface reflects the illumination light.

In the above arrangement, the light emitting section emits, in response to excitation light, illumination light in all directions with itself as a center.

The storing member, which stores the light emitting section, has a concave section that is defined by an inclined sidewall surface having the shape of a mortar which has an opening area that is larger as farther away from the bottom section.

This arrangement causes light emitted from the light emitting section to, except for a portion of the light, reach the inclined sidewall surface so as to be reflected.

The above arrangement thus forms, from illumination light emitted in all directions with the light emitting section as a center, a pencil of rays that travels within a predetermined solid angle.

The light-emitting device may preferably further include: a reflecting member which faces the light emitting section so that the facing member is sandwiched between the light emitting section and the reflecting member and which reflects the illumination light that has passed through the facing member, wherein: the reflecting member is continuous with respect to the inclined sidewall surface via the facing member, and has a reflecting surface having a shape of a mortar which has an opening area that is larger as farther away from the facing member.

The above arrangement achieves an alignment in which the inclined sidewall surface, which defines the concave section of the storing member, is continuous with respect to the reflecting surface of the reflecting member. The arrangement thus forms a large, mortar-shaped reflecting surface from the inclined sidewall surface of the concave section and the reflecting surface of the reflecting member.

The above arrangement allows such a large, mortar-shaped reflecting surface to surround the light emitting section, and thus causes illumination light emitted from the light emitting section to be reflected by a reflecting surface a larger number of times.

The above arrangement consequently forms a pencil of rays that travels within a small solid angle as compared to the case in which illumination light is reflected with use of only the storing member.

The light-emitting device may preferably further include: a transmitting member which faces the light emitting section so that the supporting member is sandwiched between the light emitting section and the transmitting member and which allows the excitation light, directed from the excitation light source to the light emitting section, to pass through the transmitting member, wherein: the pressure applying mechanism further includes a screw which penetrates through a first one of the reflecting member and the transmitting member and which has an end buried in a second one of the reflecting member and the transmitting member.

The above arrangement causes the supporting member and the facing member, which sandwich the light emitting section, to be in turn sandwiched between the reflecting member and the transmitting member. The reflecting member and the transmitting member are fixed with use of a screw which penetrates through a first one of the reflecting member and the transmitting member and which has an end buried in a second one of the reflecting member and the transmitting member.

The above arrangement applies a pressure to the supporting member and the facing member, which are sandwiched between the reflecting member and the transmitting member. The pressure is applied in such a manner that the reflecting member and the transmitting member press the combination of the supporting member and the facing member on both sides against each other. The pressure in turn causes the supporting member and the facing member to press the light emitting section on both sides against each other.

The above arrangement keeps applying a constant pressure to the light emitting section sandwiched between the supporting member and the facing member, and consequently fixes the light emitting section between the supporting member and the facing member.

The light-emitting device may preferably further include: a transmitting member which faces the light emitting section so that the supporting member is sandwiched between the light emitting section and the transmitting member and which allows the excitation light, directed from the excitation light source to the light emitting section, to pass through the transmitting member, wherein: the supporting member closely contacts the light emitting section via a first gap layer, whereas the transmitting member closely contacts the light emitting section via a second gap layer; and the fall preventing mechanism prevents the light emitting section from falling off the supporting member in a case where close contact of both the first and second gap layers has been so weakened that neither of the supporting member and the transmitting member is able to support the light emitting section.

According to the above arrangement, the fall preventing mechanism prevents the light emitting section from falling in the case where close contact of both the first and second gap layers has been so weakened that neither of the supporting member and the transmitting member is able to support the light emitting section.

The technical scope of the present invention further encompasses an illuminating device and a vehicle headlamp each including the light-emitting device.

The light-emitting device may preferably further include: a third heat conducting member which is provided so as to (i) face a first surface of the light emitting section which first surface is a surface other than the excitation light irradiation surface and the opposite surface and (ii) receive heat of the light emitting section.

The above arrangement makes it possible to dissipate heat of the light emitting section from the first surface, which is a surface other than the excitation light irradiation surface and the opposite surface. The arrangement thus prevents a temperature rise in the light emitting section more effectively.

The light-emitting device may preferably be arranged such that the first heat conducting member, the second heat conducting member, and the third heat conducting member are each higher in thermal conductivity than the light emitting section.

According to the above arrangement, the first heat conducting member, the second heat conducting member, and the third heat conducting member are each higher in thermal conductivity than the light emitting section. The arrangement thus prevents a temperature rise in the light emitting section.

The light-emitting device may preferably be arranged such that the second heat conducting member and the third heat conducting member are integrally combined with each other.

According to the above arrangement, the second heat conducting member and the third heat conducting member are integrally combined with each other. This arrangement fixes a relative positional relationship between the second heat conducting member and the third heat conducting member.

The above arrangement consequently prevents (i) a problem of a positional shift of the second heat conducting member and the third heat conducting member relative to each other and (ii) a problem of a fall of either of the second heat conducting member and the third heat conducting member.

The light-emitting device may preferably be arranged such that the first heat conducting member and the third heat conducting member are integrally combined with each other.

According to the above arrangement, the first heat conducting member and the third heat conducting member are integrally combined with each other. This arrangement fixes a relative positional relationship between the first heat conducting member and the third heat conducting member.

The above arrangement consequently prevents (i) a problem of a positional shift of the first heat conducting member and the third heat conducting member relative to each other and (ii) a problem of a fall of either of the first heat conducting member and the third heat conducting member.

The light-emitting device may preferably be arranged such that the third heat conducting member fixes the relative positional relationship between the first heat conducting member and the second heat conducting member.

The above arrangement uses the third heat conducting member to fix a relative positional relationship between the first heat conducting member and the second heat conducting member.

In the case where, for example, the second heat conducting member and the third heat conducting member are integrally combined with each other, the third heat conducting member may be further combined with the first heat conducting member. In the case where the first heat conducting member and the third heat conducting member are integrally combined with each other, the third heat conducting member may be further combined with the second heat conducting member.

The above combination fixes the relative positional relationship between the first heat conducting member and the second heat conducting member.

The above arrangement consequently prevents (i) a problem of a positional shift of the first heat conducting member and the second heat conducting member relative to each other and (ii) a problem of a fall of either of the first heat conducting member and the second heat conducting member.

The light-emitting device may preferably be arranged such that the light emitting section is a sintered body obtained by (i) mixing a fluorescent material retention substance with a fluorescent material which is dispersed in the fluorescent material retention substance and which emits light upon irradiation of a laser beam and (ii) sintering a resulting mixture; and the sintered body closely contacts at least one of the first heat conducting member, the second heat conducting member, and the third heat conducting member.

According to the above arrangement, the light emitting section as a sintered body closely contacts at least one of the first heat conducting member, the second heat conducting member, and the third heat conducting member. The arrangement thus improves heat dissipation efficiency over a surface of the close contact, and consequently cools the light emitting section more effectively.

Since the fluorescent material included in the light emitting section is fragile, there has been a need to pay attention in handling the light emitting section as a separate member. The above arrangement, in view of this, causes the light emitting section to integrally and closely contact at least one of the first heat conducting member, the second heat conducting member, and the third heat conducting member. The arrangement thus facilitates handling the light emitting section during production, and further prevents (i) a problem of a positional shift of the light emitting section and (ii) a problem of a fall of the light emitting section.

The light-emitting device may preferably be arranged such that the first heat conducting member includes a diffusing agent for diffusing the excitation light.

Since the excitation light is coherent light, it may harm the human body if it is emitted directly to the outside without being converted into fluorescence or diffused by the light emitting section.

According to the above arrangement, the diffusing agent diffuses the excitation light. Thus, even if the excitation light is not entirely converted into fluorescence or diffused by the light emitting section, the first heat conducting member, which diffuses the excitation light in advance, reduces the possibility of coherent light leaking to the outside.

The light-emitting device may preferably be arranged such that the second heat conducting member includes a diffusing agent for diffusing the excitation light.

Since the excitation light is coherent light, it may harm the human body if it is emitted directly to the outside without being converted into fluorescence or diffused by the light emitting section.

According to the above arrangement, the diffusing agent diffuses excitation light which has passed through the light emitting section without being converted into fluorescence or diffused. This reduces the possibility of coherent light leaking to the outside.

The light-emitting device may preferably be arranged such that the light emitting section has a thickness between the excitation light irradiation surface and the opposite surface, the thickness being at least 10 times as large as a particle size of the fluorescent material and not greater than 2 mm.

In a case where the light emitting section is thin, heat thereof can be conducted to, for example, the first heat conducting member and the second heat conducting member efficiently as compared to a case where the light emitting section is thick. If, however, the light emitting section is too thin, the excitation light may not be converted into fluorescence, and may instead be emitted directly to the outside. If, on the other hand, the light emitting section is too thick, it may not only reduce heat dissipation efficiency of, for example, the first heat conducting member and the second heat conducting member for the light emitting section, but also blur a light distribution pattern of the light-emitting device.

The light emitting section thus preferably has a thickness which is at least 10 times the particle size of the fluorescent material and not greater than 2 mm. A simulation has shown that in a case where the light emitting section has a thickness which is at least 10 times the particle size of the fluorescent material, nearly all the excitation light is converted into fluorescence.

The light-emitting device may preferably be arranged such that the first heat conducting member, the second heat conducting member, and the third heat conducting member each have a thickness of not smaller than 0.3 mm and not greater than 3.0 mm between (i) a first surface in contact with the light emitting section and (ii) a second surface opposite to the first surface.

If any of the first heat conducting member, the second heat conducting member, and the third heat conducting member has a thickness which is less than 0.3 mm, it may not be able to dissipate heat of the light emitting section sufficiently, and the light emitting section may be impaired as a result. If, on the other hand, any of the first heat conducting member, the second heat conducting member, and the third heat conducting member has a thickness which is greater than 3.0 mm, it will absorb a larger proportion of, for example, the excitation light irradiating the light emitting section and fluorescence generated by the light emitting section. Efficiency in use of the excitation light will be decreased significantly as a result.

Thus, the first heat conducting member, the second heat conducting member, and the third heat conducting member each preferably have a thickness of not smaller than 0.3 mm and not greater than 3.0 mm.

INDUSTRIAL APPLICABILITY

The present invention is applicable to a light-emitting device and an illuminating device each having a high luminance and a long life. In particular, the present invention is applicable to a headlamp for, for example, a vehicle.

REFERENCE SIGNS LIST

1 headlamp (light-emitting device; vehicle headlamp)
2 laser diode array (excitation light source)
3 laser diode (excitation light source)
7 light emitting section
7*a* laser beam irradiation surface (excitation light irradiation surface)
8 reflecting mirror
9 transparent plate (fixing section; first light-transmitting member; fall preventing mechanism; pressure applying mechanism; facing member; transmitting member)
12 lens (second light-transmitting member)
13 heat conducting member (first heat conducting member)
15 adhesive layer (gap layer)
16 diffusing agent (heat conducting particle)
17 reflective film
18 transparent plate (fixing section)
20*a* hollow member (fixing section)
20*b* hollow member (fixing section)
20*c* fixing section
30 headlamp (light-emitting device; vehicle headlamp)
51 metal ring (fall preventing mechanism)
52 fall preventing plate (fall preventing mechanism)
53 supporting member (fall preventing mechanism)
81 reflecting mirror (reflecting member)
82 substrate
83 screw (fall preventing mechanism; pressure applying mechanism)
100 headlamp (light-emitting device; vehicle headlamp)
110 headlamp (light-emitting device; vehicle headlamp)
116 heat pipe (second heat conducting member)
141 opposite surface close contact section (second heat conducting member)
142 perpendicular surface close contact section (third heat conducting member)
200 headlamp (light-emitting device; vehicle headlamp)
213 supporting member
214 screw (fall preventing mechanism; pressure applying mechanism)
300 headlamp (light-emitting device; vehicle headlamp)
314 hollow member (second heat conducting member)
400 laser downlight (light-emitting device; illuminating device)

| Reference Signs List | |
|---|---|
| 1 | headlamp (light-emitting device; vehicle headlamp) |
| 2 | laser diode array (excitation light source) |
| 3 | laser diode (excitation light source) |

-continued

| Reference Signs List | |
|---|---|
| 7 | light emitting section |
| 7a | laser beam irradiation surface (excitation light irradiation surface) |
| 8 | reflecting mirror |
| 9 | transparent plate (fixing section; first light-transmitting member; fall preventing mechanism; pressure applying mechanism; facing member; transmitting member) |
| 12 | lens (second light-transmitting member) |
| 13 | heat conducting member (first heat conducting member) |
| 15 | adhesive layer (gap layer) |
| 16 | diffusing agent (heat conducting particle) |
| 17 | reflective film |
| 18 | transparent plate (fixing section) |
| 20a | hollow member (fixing section) |
| 20b | hollow member (fixing section) |
| 20c | fixing section |
| 30 | headlamp (light-emitting device; vehicle headlamp) |
| 51 | metal ring (fall preventing mechanism) |
| 52 | fall preventing plate (fall preventing mechanism) |
| 53 | supporting member (fall preventing mechanism) |
| 81 | reflecting mirror (reflecting member) |
| 82 | substrate |
| 83 | screw (fall preventing mechanism; pressure applying mechanism) |
| 100 | headlamp (light-emitting device; vehicle headlamp) |
| 110 | headlamp (light-emitting device; vehicle headlamp) |
| 116 | heat pipe (second heat conducting member) |
| 141 | opposite surface close contact section (second heat conducting member) |
| 142 | perpendicular surface close contact section (third heat conducting member) |
| 200 | headlamp (light-emitting device; vehicle headlamp) |
| 213 | supporting member |
| 214 | screw (fall preventing mechanism; pressure applying mechanism) |
| 300 | headlamp (light-emitting device; vehicle headlamp) |
| 314 | hollow member (second heat conducting member) |
| 400 | laser downlight (light-emitting device; illuminating device) |

The invention claimed is:

1. A light-emitting device, comprising:

an excitation light source for emitting excitation light;

a light emitting section including a fluorescent material which emits light in response to the excitation light, the light emitting section having an excitation light irradiation surface which is irradiated with the excitation light;

a light-transmitting heat conducting member which is provided so as to (i) face the excitation light irradiation surface and (ii) receive heat of the light emitting section; and a gap layer which fills a gap between the heat conducting member and the excitation light irradiation surface.

2. The light-emitting device according to claim 1, wherein:

the gap layer adheres the light emitting section and the heat conducting member to each other.

3. The light-emitting device according to claim 2, wherein:

the gap layer is so flexible as to absorb a difference in coefficient of thermal expansion between the light emitting section and the heat conducting member.

4. The light-emitting device according to claim 1, further comprising:

a fixing section for fixing a relative positional relationship between the light emitting section and the heat conducting member.

5. The light-emitting device according to claim 4, wherein:

the fixing section is higher in thermal conductivity than the light emitting section.

6. The light-emitting device according to claim 1, wherein:

the gap layer includes a heat conducting particle which is in contact with the light emitting section and the heat conducting member.

7. The light-emitting device according to claim 1, wherein:

the gap layer includes a diffusing agent for diffusing the excitation light.

8. The light-emitting device according to claim 7, further comprising:

a reflective film at least partially covering a surface of the gap layer which surface is in contact with neither the light emitting section nor the heat conducting member.

9. The light-emitting device according to claim 1, wherein:

the gap layer has a thickness of 30 μm or less between the heat conducting member and the excitation light irradiation surface.

10. The light-emitting device according to claim 1, wherein:

the light emitting section has a thickness between the excitation light irradiation surface and a surface opposite to the excitation light irradiation surface, the thickness being at least 10 times a particle size of the fluorescent material and not greater than 2 mm.

11. The light-emitting device according to claim 1, wherein:

the heat conducting member has a thickness of not smaller than 0.3 mm and not greater than 3.0 mm between (i) a first surface facing the excitation light irradiation surface and (ii) a second surface opposite to the first surface.

12. A illuminating device, comprising:

the light emitting device recited in claim 1.

13. A vehicle headlamp, comprising:

the light-emitting device recited in claim 1.

* * * * *